US010867779B2

(12) United States Patent
Richardson et al.

(10) Patent No.: US 10,867,779 B2
(45) Date of Patent: Dec. 15, 2020

(54) SPECTROMETRIC ANALYSIS

(71) Applicant: Micromass UK Limited, Wilmslow (GB)

(72) Inventors: Keith George Richardson, High Peak (GB); Steven Derek Pringle, Darwen (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 16/083,267

(22) PCT Filed: Mar. 6, 2017

(86) PCT No.: PCT/GB2017/050592

§ 371 (c)(1),
(2) Date: Sep. 7, 2018

(87) PCT Pub. No.: WO2017/153727

PCT Pub. Date: Sep. 14, 2017

(65) Prior Publication Data

US 2019/0096645 A1 Mar. 28, 2019

(30) Foreign Application Priority Data

Mar. 7, 2016 (GB) ..... 1603906.7
Mar. 7, 2016 (GB) ..... 1603907.5

(51) Int. Cl.

| | |
|---|---|
| ***H01J 49/00*** | (2006.01) |
| ***H01J 49/04*** | (2006.01) |
| ***H01J 49/26*** | (2006.01) |

(52) U.S. Cl.
CPC ..... *H01J 49/0036* (2013.01); *H01J 49/04* (2013.01); *H01J 49/26* (2013.01)

(58) Field of Classification Search
USPC ..... 250/282
See application file for complete search history.

(56) References Cited

U.S. PATENT DOCUMENTS

| | | | | |
|---|---|---|---|---|
| 3,275,032 | A | 9/1966 | Gruller | |
| 6,188,064 | B1 | 2/2001 | Koester | |
| 7,577,538 | B2 * | 8/2009 | Wang ..... | G06K 9/0057 250/281 |
| 7,847,244 | B2 | 12/2010 | Venter et al. | |

(Continued)

FOREIGN PATENT DOCUMENTS

| | | |
|---|---|---|
| CN | 1481502 A | 3/2004 |
| CN | 1997970 A | 7/2007 |

(Continued)

OTHER PUBLICATIONS

International Search Report and Written Opinion for International Application No. PCT/GB2017/050592 dated Jul. 20, 2017, 19 pages.

(Continued)

*Primary Examiner* — Phillip A Johnston

(57) ABSTRACT

A method of spectrometric analysis comprises obtaining one or more sample spectra for a sample. The one or more sample spectra are subjected to pre-processing and then multivariate and/or library based analysis so as to classify the sample. The pre-processing involves deisotoping the sample spectra.

19 Claims, 22 Drawing Sheets

(56) References Cited

U.S. PATENT DOCUMENTS

| | | | | |
|---|---|---|---|---|
| 8,321,144 | B2 * | 11/2012 | Henle | G06K 9/6203 702/19 |
| 8,375,032 | B2 * | 2/2013 | Birdwell | G06K 9/6224 707/737 |
| 8,604,421 | B2 * | 12/2013 | Skilling | G06K 9/0057 250/282 |
| 10,026,599 | B2 * | 7/2018 | Takats | A61B 5/015 |
| 2005/0255606 | A1 | 11/2005 | Ahmed et al. | |
| 2010/0078550 | A1 | 4/2010 | Wiseman et al. | |
| 2010/0320374 | A1 | 12/2010 | Jarrell et al. | |
| 2011/0049352 | A1 | 3/2011 | Ding et al. | |
| 2012/0309027 | A1 | 12/2012 | Anderson et al. | |
| 2014/0158879 | A1 | 6/2014 | Skilling et al. | |
| 2015/0034813 | A1 | 2/2015 | Brown et al. | |
| 2017/0138955 | A1 | 5/2017 | Anderson et al. | |
| 2019/0295833 | A1 | 9/2019 | Hart et al. | |

FOREIGN PATENT DOCUMENTS

| | | | |
|---|---|---|---|
| CN | 107646089 | A | 1/2018 |
| WO | 2016142692 | A1 | 9/2016 |

OTHER PUBLICATIONS

Skilling, J., et al., "A unified algorithm for deconvoluting electrospray ionization mass spectral data", Jul. 16, 2010, URL:http://www.waters.com/webassets/cms/li brary/docs/720003650en.pdf, retrieved on May 16, 2017.

Slawski, M., et al., "Isotope pattern deconvolution for peptide mass spectrometry by non-negative least squares/least absolute deviation template matching", BMC Bioinformatics, Biomed Central, 13(1), p. 291, Nov. 8, 2012.

Senko, et al., "Determination of monoisotopic masses and ion populations for large biomolecules from resolved isotopic distributions", Journal of the American Society for Mass Spectrometry, Elsevier Science Inc., 6 (4), p. 229-233, Apr. 1, 1995.

* cited by examiner

I
I
I

SPECTROMETRIC ANALYSIS

CROSS-REFERENCE TO RELATED APPLICATIONS

This application is a national phase filing claiming the benefit of and priority to International Patent Application No. PCT/GB2017/050592, filed on Mar. 6, 2017, which claims priority from and the benefit of United Kingdom patent application No. 1603906.7 filed on Mar. 7, 2016 and United Kingdom patent application No. 1603907.5 filed on Mar. 7, 2016. The entire contents of these applications are incorporated herein by reference.

FIELD OF THE INVENTION

The present invention relates generally to spectrometry and in particular to methods of spectrometric analysis in order to classify samples.

BACKGROUND

In known arrangements, a sample obtained from a target substance is ionised so as to produce analyte ions. The analyte ions are then subjected to mass and/or ion mobility analysis so as to produce sample spectra. The sample spectra are then subjected to spectrometric analysis in order to classify the sample. For example, it is known to utilise statistical analysis of spectrometric data in order to help distinguish and identify different classes of sample.

It is desired to provide improved methods of spectrometric analysis in order to classify samples. For example, it is generally desired to provide methods of spectrometric analysis that result in more accurate classifications and/or that consume less processing power.

SUMMARY

According to an aspect there is provided a method of spectrometric analysis comprising:

obtaining one or more sample spectra for a sample;

pre-processing the one or more sample spectra, wherein pre-processing the one or more sample spectra comprises a deisotoping process; and analysing the one or more pre-processed sample spectra so as to classify the sample, wherein analysing the one or more sample spectra comprises multivariate and/or library-based analysis.

Similarly, according another aspect there is provided a spectrometric analysis system comprising:

control circuitry arranged and adapted to:

obtain one or more sample spectra for a sample;

pre-process the one or more sample spectra, wherein pre-processing the one or more sample spectra comprises a deisotoping process; and analyse the one or more pre-processed sample spectra so as to classify the sample, wherein analysing the one or more sample spectra comprises multivariate and/or library-based analysis.

It has been identified that deisotoping can significantly reduce dimensionality in the one or more sample spectra. This is particularly useful when carrying out multivariate and/or library-based analysis of sample spectra so as to classify a sample since simpler and/or less resource intensive analysis may be carried out. Furthermore, it has been identified that deisotoping can help to distinguish between spectra by removing commonality due to isotopic distributions. Again, this is particularly useful when carrying out multivariate and/or library-based analysis of sample spectra so as to classify a sample. In particular, a more accurate or confident classification may be provided, for example due to greater separation between classes in multivariate space and/or greater differences between classification scores or probabilities in library based analysis. Embodiments can, therefore, facilitate classification of a sample.

The deisotoping process may comprise identifying one or more additional isotopic peaks in the one or more sample spectra and/or reducing or removing the one or more additional isotopic peaks in or from the one or more sample spectra.

The deisotoping process may comprise generating a deisotoped version of the one or more sample spectra in which one or more additional isotopic peaks are reduced or removed.

The deisotoping process may comprise isotopic deconvolution.

The deisotoping process may comprise an iterative process, optionally comprising iterative forward modelling.

The deisotoping process may comprise a probabilistic process, optionally a Bayesian inference process.

The deisotoping process may comprise a Monte Carlo method.

The deisotoping process may comprise one or more of: nested sampling; massive inference; and maximum entropy.

The deisotoping process may comprise generating a set of trial hypothetical monoisotopic sample spectra.

Each trial hypothetical monoisotopic sample spectra may be generated using probability density functions for one or more of: mass, intensity, charge state, and number of peaks, for a class of sample.

The deisotoping process may comprise deriving a likelihood of the one or more sample spectra given each trial hypothetical monoisotopic sample spectrum.

The deisotoping process may comprise generating a set of modelled sample spectra having isotopic peaks from the set of trial hypothetical monoisotopic sample spectra.

Each modelled sample spectra may be generated using known average isotopic distributions for a class of sample.

The deisotoping process may comprise deriving a likelihood of the one or more sample spectra given each trial hypothetical monoisotopic sample spectrum by comparing a modelled sample spectrum to the one or more sample spectra.

The deisotoping process may comprise regenerating a trial hypothetical monoisotopic sample spectrum that gives a lowest likelihood Ln until the regenerated trial hypothetical monoisotopic sample spectrum gives a likelihood $Ln+1>Ln$.

The deisotoping process may comprise regenerating the trial hypothetical monoisotopic sample spectra until a maximum likelihood Lm is or appears to have been reached for the trial hypothetical monoisotopic sample spectra or until another termination criterion is met.

The deisotoping process may comprise generating a representative set of one or more deisotoped sample spectra from the trial hypothetical monoisotopic sample spectra.

The deisotoping process may comprise combining the representative set of one or more deisotoped sample spectra into a combined deisotoped sample spectrum. The combined deisotoped sample spectrum may be the deisotoped version of the one or more sample spectra referred to above.

One or more peaks in the combined deisotoped sample spectrum may correspond to one or more peaks in the representative set of one or more deisotoped sample spectra that have: at least a threshold probability of presence in the representative set of one or more deisotoped sample spectra; less than a threshold mass uncertainty in the representative set of one or more deisotoped sample spectra; and/or less than a threshold intensity uncertainty in the representative set of one or more deisotoped sample spectra.

The combination may comprise identifying clusters of peaks across the representative set of sample spectra.

One or more peaks in the combined deisotoped sample spectrum may each comprise a summation, average, quantile or other statistical property of a cluster of peaks identified across the representative set of one or more deisotoped sample spectra.

The average may be a mean average or a median average of the peaks in a cluster of peaks identified across the representative set of one or more deisotoped sample spectra.

The deisotoping process may comprise one or more of: a least squares process, a non-negative least squares process; and a (fast) Fourier transform process.

The deisotoping process may comprise deconvolving the one or more sample spectra with respect to theoretical mass and/or isotope and/or charge distributions. The theoretical mass and/or isotope and/or charge distributions may be derived from known and/or typical and/or average properties of one or more classes of sample.

The theoretical mass and/or isotope and/or charge distributions may be derived from known and/or typical and/or average properties of a spectrometer, for example that was used to obtain the one or more sample spectra.

The theoretical distributions may vary within each of the one or more classes of sample. For example, spectral peak width may vary with mass to charge ratio and/or the isotopic distribution may vary with molecular mass.

The theoretical mass and/or isotope and/or charge distributions may be modelled using one or more probability density functions.

Obtaining the one or more sample spectra may comprise obtaining the sample using a sampling device The sampling device may comprise or form part of an ion source.

The sampling device may comprise one or more ion sources selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; (xxviii) a Laser Ablation Electrospray Ionisation ("LAESI") ion source; and (xxix) Surface Assisted Laser Desorption Ionisation ("SALDI").

The sample may comprise an aerosol, smoke or vapour sample.

Obtaining the one or more sample spectra may comprise generating the aerosol, smoke or vapour sample using a sampling device.

The sampling device may comprise or form part of an ambient ionisation or ambient ion source.

The sampling device may comprise one or more ion sources selected from the group consisting of: (i) a rapid evaporative ionisation mass spectrometry ("REIMS") ion source; (ii) a desorption electrospray ionisation ("DESI") ion source; (iii) a laser desorption ionisation ("LDI") ion source; (iv) a thermal desorption ion source; (v) a laser diode thermal desorption ("LDTD") ion source; (vi) a desorption electro-flow focusing ("DEFFI") ion source; (vii) a dielectric barrier discharge ("DBD") plasma ion source; (viii) an Atmospheric Solids Analysis Probe ("ASAP") ion source; (ix) an ultrasonic assisted spray ionisation ion source; (x) an easy ambient sonic-spray ionisation ("EASI") ion source; (xi) a desorption atmospheric pressure photoionisation ("DAPPI") ion source; (xii) a paperspray ("PS") ion source; (xiii) a jet desorption ionisation ("JeDI") ion source; (xiv) a touch spray ("TS") ion source; (xv) a nano-DESI ion source; (xvi) a laser ablation electrospray ("LAESI") ion source; (xvii) a direct analysis in real time ("DART") ion source; (xviii) a probe electrospray ionisation ("PESI") ion source; (xix) a solid-probe assisted electrospray ionisation ("SPA-ESI") ion source; (xx) a cavitron ultrasonic surgical aspirator ("CUSA") device; (xxi) a focussed or unfocussed ultrasonic ablation device; (xxii) a microwave resonance device; and (xxiii) a pulsed plasma RF dissection device.

The sampling device may comprise or form part of a point of care ("POC") diagnostic or surgical device.

The sampling device may comprise an electrosurgical device, a diathermy device, an ultrasonic device, a hybrid ultrasonic electrosurgical device, a surgical water jet device, a hybrid electrosurgery device, an argon plasma coagulation device, a hybrid argon plasma coagulation device and water jet device and/or a laser device. The term "water" used here may include a solution such as a saline solution.

The sampling device may comprise or form part of a rapid evaporation ionization mass spectrometry ("REIMS") device.

Generating the aerosol, smoke or vapour sample may comprise contacting a target with one or more electrodes.

The one or more electrodes may comprise or form part of: (i) a monopolar device, wherein said monopolar device optionally further comprises a separate return electrode or electrodes; (ii) a bipolar device, wherein said bipolar device optionally further comprises a separate return electrode or electrodes; or (iii) a multi phase RF device, wherein said RF device optionally further comprises a separate return electrode or electrodes. Bipolar sampling devices can provide particularly useful sample spectra for classifying aerosol, smoke or vapour samples.

Generating the aerosol, smoke or vapour sample may comprise applying an AC or RF voltage to the one or more electrodes in order to generate the aerosol, smoke or vapour sample.

Applying the AC or RF voltage to the one or more electrodes may comprise applying one or more pulses of the AC or RF voltage to the one or more electrodes.

Applying the AC or RF voltage to the one or more electrodes may cause heat to be dissipated into a target.

Generating the aerosol, smoke or vapour sample may comprise irradiating a target with a laser.

Generating the aerosol, smoke or vapour sample may comprise direct evaporation or vaporisation of target material from a target by Joule heating or diathermy.

Generating the aerosol, smoke or vapour sample may comprise directing ultrasonic energy into a target.

The aerosol, smoke or vapour sample may comprise uncharged aqueous droplets optionally comprising cellular material.

At least 50%, 55%, 60%, 65%, 70%, 75%, 80%, 85%, 90% or 95% of the mass or matter generated which forms the aerosol, smoke or vapour sample may be in the form of droplets.

The Sauter mean diameter ("SMD", d32) of the aerosol, smoke or vapour sample may be in a range selected from the group consisting of: (i) ≤ or ≥5 μm; (ii) 5-10 μm; (iii) 10-15 μm; (iv) 15-20 μm; (v) 20-25 μm; and (vi) ≤ or ≥25 μm.

The aerosol, smoke or vapour sample may traverse a flow region with a Reynolds number (Re) in a range selected from the group consisting of: (i) ≤ or ≥2000; (ii) 2000-2500; (iii) 2500-3000; (iv) 3000-3500; (v) 3500-4000; and (vi) ≤ or ≥4000.

Substantially at the point of generating the aerosol, smoke or vapour sample, the aerosol, smoke or vapour sample may comprise droplets having a Weber number (We) in a range selected from the group consisting of: (i) ≤ or ≥50; (ii) 50-100; (iii) 100-150; (iv) 150-200; (v) 200-250; (vi) 250-300; (vii) 300-350; (viii) 350-400; (ix) 400-450; (x) 450-500; (xi) 500-550; (xii) 550-600; (xiii) 600-650; (xiv) 650-700; (xv) 700-750; (xvi) 750-800; (xvii) 800-850; (xviii) 850-900; (xix) 900-950; (xx) 950-1000; and (xxi) ≤ or ≥1000.

Substantially at the point of generating the aerosol, smoke or vapour sample, the aerosol, smoke or vapour sample may comprise droplets having a Stokes number ($S_k$) in a range selected from the group consisting of: (i) 1-5; (ii) 5-10; (iii) 10-15; (iv) 15-20; (v) 20-25; (vi) 25-30; (vii) 30-35; (viii) 35-40; (ix) 40-45; (x) 45-50; and (xi) ≤ or ≥50.

Substantially at the point of generating the aerosol, smoke or vapour sample, the aerosol, smoke or vapour sample may comprise droplets having a mean axial velocity in a range selected from the group consisting of: (i) ≤ or ≥20 m/s; (ii) 20-30 m/s; (iii) 30-40 m/s; (iv) 40-50 m/s; (v) 50-60 m/s; (vi) 60-70 m/s; (vii) 70-80 m/s; (viii) 80-90 m/s; (ix) 90-100 m/s; (x) 100-110 m/s; (xi) 110-120 m/s; (xii) 120-130 m/s; (xiii) 130-140 m/s; (xiv) 140-150 m/s; and (xv) ≤ or ≥150 m/s.

The sample may comprise a bulk solid, liquid or gas sample.

The sample may be obtained from a target.

The sample may be obtained from one or more regions of a target.

The target may comprise target material.

The target may comprise native and/or unmodified target material.

The native and/or unmodified target material may be unmodified by the addition of a matrix and/or reagent.

The sample may be obtained from the target without the target requiring prior preparation.

The target may comprise non-native and/or modified target material

The non-native and/or modified target may be modified by the addition of a matrix and/or reagent.

The sample may be obtained from the target following prior preparation of the target.

The target may be from or form part of a human or non-human animal subject (e.g., a patient).

The target may comprise organic matter, biological tissue, biological matter, a bacterial colony or a fungal colony.

The biological tissue may comprise human tissue or non-human animal tissue.

The biological tissue may comprise in vivo biological tissue.

The biological tissue may comprise ex vivo biological tissue.

The biological tissue may comprise in vitro biological tissue.

The biological tissue may comprise one or more of: (i) adrenal gland tissue, appendix tissue, bladder tissue, bone, bowel tissue, brain tissue, breast tissue, bronchi, coronal tissue, ear tissue, esophagus tissue, eye tissue, gall bladder tissue, genital tissue, heart tissue, hypothalamus tissue, kidney tissue, large intestine tissue, intestinal tissue, larynx tissue, liver tissue, lung tissue, lymph nodes, mouth tissue, nose tissue, pancreatic tissue, parathyroid gland tissue, pituitary gland tissue, prostate tissue, rectal tissue, salivary gland tissue, skeletal muscle tissue, skin tissue, small intestine tissue, spinal cord, spleen tissue, stomach tissue, thymus gland tissue, trachea tissue, thyroid tissue, ureter tissue, urethra tissue, soft and connective tissue, peritoneal tissue, blood vessel tissue and/or fat tissue; (ii) grade I, grade II, grade III or grade IV cancerous tissue; (iii) metastatic cancerous tissue; (iv) mixed grade cancerous tissue; (v) a sub-grade cancerous tissue; (vi) healthy or normal tissue; and/or (vii) cancerous or abnormal tissue.

The target may comprise inorganic matter and/or non-biological matter.

Obtaining the one or more sample spectra may comprise obtaining the sample over a period of time in seconds that is within a range selected from the group consisting of: (i) ≤ or ≥0.1; (ii) 0.1-0.2; (iii) 0.2-0.5; (iv) 0.5-1.0; (v) 1.0-2.0; (vi) 2.0-5.0; (vii) 5.0-10.0; and (viii) ≤ or ≥10.0. Longer periods of time can increase signal to noise ratio and improve ion statistics whilst shorter periods of time can speed up the spectrometric analysis process. In some embodiments, one or more reference and/or known samples may be obtained over a longer period of time to improve signal to noise ratio. In some embodiments, one or more unknown samples may be obtained over a shorter period of time to speed up the classification process.

The one or more sample spectra may comprise one or more sample mass and/or mass to charge ratio and/or ion mobility (drift time) spectra. Plural sample ion mobility spectra may be obtained using different ion mobility drift gases, or dopants may be added to the drift gas to induce a change in drift time, for example of one or more species. The plural sample spectra may then be combined. Combining the plural sample spectra may comprise a concatenation, (e.g., weighted) summation, average, quantile or other statistical property for the plural spectra or parts thereof, such as one or more selected peaks.

Obtaining the one or more sample spectra may comprise generating a plurality of analyte ions from the sample.

Obtaining the one or more sample spectra may comprise ionising at least some of the sample so as to generate a plurality of analyte ions.

Obtaining the one or more sample spectra may comprise generating a plurality of analyte ions upon generating an aerosol, smoke or vapour sample.

Obtaining the one or more sample spectra may comprise directing at least some of the sample into a vacuum chamber of a mass and/or ion mobility spectrometer.

Obtaining the one or more sample spectra may comprise ionising at least some of the sample within a vacuum chamber of a mass and/or ion mobility spectrometer so as to generate a plurality of analyte ions.

Obtaining the one or more sample spectra may comprise causing the sample to impact upon a collision surface located within a vacuum chamber of a mass and/or ion mobility spectrometer so as to generate a plurality of analyte ions.

Obtaining the one or more sample spectra may comprise generating a plurality of analyte ions using ambient ionisation.

Obtaining the one or more sample spectra may comprise generating a plurality of analyte ions in positive ion mode and/or negative ion mode. The mass and/or ion mobility spectrometer may obtain data in negative ion mode only, positive ion mode only, or in both positive and negative ion modes. Positive ion mode spectrometric data may be combined with negative ion mode spectrometric data. Combining the spectrometric data may comprise a concatenation, (e.g., weighted) summation, average, quantile or other statistical property for plural spectra or parts thereof, such as one or more selected peaks. Negative ion mode can provide particularly useful sample spectra for classifying some samples, such as samples from targets comprising lipids.

Obtaining the one or more sample spectra may comprise mass, mass to charge ratio and/or ion mobility analysing a plurality of analyte ions.

Various embodiments are contemplated wherein analyte ions are subjected either to: (i) mass analysis by a mass analyser such as a quadrupole mass analyser or a Time of Flight mass analyser; (ii) ion mobility analysis (IMS) and/or differential ion mobility analysis (DMA) and/or Field Asymmetric Ion Mobility Spectrometry (FAIMS) analysis; and/or (iii) a combination of firstly ion mobility analysis (IMS) and/or differential ion mobility analysis (DMA) and/or Field Asymmetric Ion Mobility Spectrometry (FAIMS) analysis followed by secondly mass analysis by a mass analyser such as a quadrupole mass analyser or a Time of Flight mass analyser (or vice versa). Various embodiments also relate to an ion mobility spectrometer and/or mass analyser and a method of ion mobility spectrometry and/or method of mass analysis.

Obtaining the one or more sample spectra may comprise mass, mass to charge ratio and/or ion mobility analysing the sample, or a plurality of analyte ions derived from the sample.

Obtaining the one or more sample spectra may comprise generating a plurality of precursor ions.

Obtaining the one or more sample spectra may comprise generating a plurality of fragment ions and/or reaction ions from precursor ions.

Obtaining the one or more sample spectra may comprise scanning, separating and/or filtering a plurality of analyte ions.

The plurality of analyte ions may be scanned, separated and/or filtered according to one or more of: mass; mass to charge ratio; ion mobility; and charge state.

Scanning, separating and/or filtering the plurality of analyte ions may comprise onwardly transmitting a plurality of ions having mass or mass to charge ratios in Da or Th (Da/e) within one or more ranges selected from the group consisting of: (i) ≤ or ≥200; (ii) 200-400; (iii) 400-600; (iv) 600-800; (v) 800-1000; (vi) 1000-1200; (vii) 1200-1400; (viii) 1400-1600; (ix) 1600-1800; (x) 1800-2000; and (xi) ≤ or ≥2000.

Scanning, separating and/or filtering the plurality of analyte ions may comprise at least partially or fully attenuating a plurality of ions having mass or mass to charge ratios in Da or Th (Da/e) within one or more ranges selected from the group consisting of: (i) ≤ or ≥200; (ii) 200-400; (iii) 400-600; (iv) 600-800; (v) 800-1000; (vi) 1000-1200; (vii) 1200-1400; (viii) 1400-1600; (ix) 1600-1800; (x) 1800-2000; and (xi) ≤ or ≥2000.

Ions having a mass or mass to charge ratio within a range of 600-2000 Da or Th (Da/e) can provide particularly useful sample spectra for classifying some samples, such as samples obtained from bacteria. Ions having a mass or mass to charge ratio within a range of 600-900 Da or Th (Da/e) can provide particularly useful sample spectra for classifying some samples, such as samples obtained from tissues.

Obtaining the one or more sample spectra may comprise partially attenuating a plurality of analyte ions.

The partial attenuation may be applied so as to avoid ion detector saturation.

The partial attenuation may be applied automatically upon detecting that ion detector saturation has occurred or upon predicting that ion detector saturation will occur.

The partial attenuation may be switched (e.g., on or off, higher or lower, etc.) so as to provide sample spectra having different degrees of attenuation.

The partial attenuation may be switched periodically.

Obtaining the one or more sample spectra may comprise detecting a plurality of analyte ions using an ion detector device.

The ion detector device may comprise or form part of a mass and/or ion mobility spectrometer. The mass and/or ion mobility spectrometer may comprise one or more: ion traps; ion mobility separation (IMS) devices (e.g., drift tube and/or IMS travelling wave devices, etc.); and/or mass analysers or filters. The one or more mass analysers or filters may comprise a quadrupole mass analyser or filter and/or Time-of-Flight (TOF) mass analyser.

Obtaining the one or more sample spectra may comprise generating a set of analytical value-intensity groupings or "tuplets" (e.g., time-intensity pairs, time-drifttime-intensity tuplets) for the one or more sample spectra, with each grouping comprising: (i) one or more analytical values, such as times, time-based values, or operational parameters; and (ii) one or more corresponding intensities. The operational parameters used for various modes of operation are discussed in more detail below. For example, the operational parameters may include one or more of: collision energy; resolution; lens setting; ion mobility parameter (e.g., gas pressure, dopant status, gas type, etc.).

A set of analytical value-intensity groupings may be obtained for each of one or more modes of operation.

The one or more modes of operation may comprise substantially the same or repeated modes of operation. The one or more modes of operation may comprise different modes of operation. Possible differences between modes of operation are discussed in more detail below.

The one or more modes of operation may comprise substantially the same or repeated modes of operation that use the substantially the same operational parameters. The one or more modes of operation may comprise different modes of operation that use different operational parameters. The operational parameters that may be varied are discussed in more detail below The set of analytical value-intensity groupings may be, or may be used to derive, a set of sample intensity values for the one or more sample spectra.

Obtaining the one or more sample spectra may comprise a binning process to derive a set of analytical value-intensity groupings and/or a set of sample intensity values for the one or more sample spectra. The set of time-intensity groupings may comprise a vector of intensities, with each point in the one or more analytical dimension(s) (e.g., mass to charge, ion mobility, operational parameter, etc.) being represented by an element of the vector.

The binning process may comprise accumulating or histogramming ion detections and/or intensity values in a set of plural bins.

Each bin in the binning process may correspond to one or more particular ranges of times or time-based values, such as masses, mass to charge ratios, and/or ion mobilities. When plural analytical dimensions are used (e.g., mass to charge, ion mobility, operational parameter, etc.), the bins may be regions in the analytical space. The shape of the region may be regular or irregular.

The bins in the binning process may each have a width equivalent to:

a width in Da or Th (Da/e) in a range selected from a group consisting of: (i) ≤ or ≥0.01; (ii) 0.01-0.05; (iii) 0.05-0.25; (iv) 0.25-0.5; (v) 0.5-1.0; (vi) 1.0-2.5; (vii) 2.5-5.0; and (viii) ≤ or ≥5.0; and/or a width in milliseconds in a range selected from a group consisting of: (i)≤ or ≥0.01; (ii) 0.01-0.05; (iii) 0.05-0.25; (iv) 0.25-0.5; (v) 0.5-1.0; (vi) 1.0-2.5; (vii) 2.5-5.0; (viii) 5.0-10; (ix) 10-25; (x) 25-50; (xi) 50-100; (xii) 100-250; (xiii) 250-500; (xiv) 500-1000; and (xv) ≤ or ≥1000.

It has been identified that bins having widths equivalent to widths in the range 0.01-1 Da or Th (Da/e) can provide particularly useful sample spectra for classifying some samples, such as samples obtained from tissues.

The bins may or may not all have the same width.

The widths of the bin in the binning process may vary according to a bin width function.

The bin width function may vary with a time or time-based value, such as mass, mass to charge ratio and/or ion mobility.

The bin width function may be non-linear (e.g., logarithmic-based or power-based, such as square or square-root based). The bin width function may take into account the fact that the time of flight of an ion may not be directly proportional to its mass, mass to charge ratio, and/or ion mobility. For example, the time of flight of an ion may be directly proportional to the square-root of its mass to charge ratio.

The bin width function may be derived from the known variation of instrumental peak width with time or time-based value, such as mass, mass to charge ratio and/or ion mobility.

The bin width function may be related to known or expected variations in spectral complexity or peak density. For example, the bin width may be chosen to be smaller in regions of the one or more spectra which are expected to contain a higher density of peaks.

Obtaining the one or more sample spectra may comprise receiving the one or more sample spectra from a first location at a second location.

The method may comprise transmitting the one or more sample spectra from the first location to the second location.

The first location may be a remote or distal sampling location and/or the second location may be a local or proximal analysis location. This can allow, for example, the one or more sample spectra to be obtained at a disaster location (e.g., earthquake zone, war zone, etc.) but analysed at a relatively safer or more convenient location.

One or more sample spectra or parts thereof may be periodically transmitted and/or received at a frequency in Hz in a range selected from a group consisting of: (i) ≤ or ≥0.1; (ii) 0.1-0.2; (iii) 0.2-0.5; (iv) 0.5-1.0; (v) 1.0-2.0; (vi) 2.0-5.0; (vii) 5.0-10.0; and (viii) ≤ or ≥10.0.

One or more sample spectra or parts thereof may be transmitted and/or received when the sample spectra or parts thereof are above an intensity threshold.

The intensity threshold may be based on a statistical property of the one or more sample spectra or parts thereof, such as one or more selected peaks.

The statistical property may be based on a total ion current (TIC), a base peak intensity, an average or quantile intensity value or an average or quantile of some function of intensity for the one or more sample spectra or parts thereof, such as one or more selected peaks.

The average intensity may be a mean average or a median average for the one or more sample spectra or parts thereof, such as one or more selected peaks.

Other measures, e.g., of spectral quality, may be used to select one or more spectra or parts thereof for transmission such as signal to noise ratio, the presence or absence of one or more spectral peaks (for example contaminants), the presence of data flags indicating potential issues with data quality, etc.

Obtaining the one or more sample spectra for the sample may comprise retrieving the one or more sample spectra from electronic storage of the spectrometric analysis system.

The method may comprise storing the one or more sample spectra in electronic storage of the spectrometric analysis system.

The electronic storage may form part of or may be coupled to a spectrometer, such as a mass and/or ion mobility spectrometer, of the spectrometric analysis system.

Obtaining the one or more sample spectra may comprise decompressing a compressed version of the one or more sample spectra, for example subsequent to receiving or retrieving the compressed version of the one or more sample spectra.

The method may comprise compressing the one or more sample spectra, for example prior to transmitting or storing the compressed version of the one or more sample spectra.

Obtaining the one or more sample spectra may comprise obtaining one or more sample spectra from one or more unknown samples.

Obtaining the one or more sample spectra may comprise obtaining one or more sample spectra to be identified using one or more classification models and/or libraries.

Obtaining the one or more sample spectra may comprise obtaining one or more sample spectra from one or more known samples.

Obtaining the one or more sample spectra may comprise obtaining one or more reference sample spectra to be used to develop and/or modify one or more classification models and/or libraries.

Pre-processing the one or more sample spectra may be performed by pre-processing circuitry of the spectrometric analysis system.

The pre-processing circuitry may form part of or may be coupled to a spectrometer, such as a mass and/or ion mobility spectrometer, of the spectrometric analysis system.

Any one or more of the following pre-processing steps may be performed in any desired and suitable order.

Pre-processing the one or more sample spectra may comprise combining plural obtained sample spectra or parts thereof, such as one or more selected peaks.

Combining the plural obtained sample spectra may comprise a concatenation, (e.g., weighted) summation, average, quantile or other statistical property for the plural spectra or parts thereof, such as one or more selected peaks.

The average may be a mean average or a median average for the plural spectra or parts thereof, such as one or more selected peaks.

Pre-processing the one or more sample spectra may comprise a background subtraction process.

The background subtraction process may comprise obtaining one or more background noise profiles and subtracting the one or more background noise profiles from the one or more sample spectra to produce one or more background-subtracted sample spectra.

The one or more background noise profiles may be derived from the one or more sample spectra themselves. However, adequate background noise profiles for a sample spectrum can often be difficult to derive from the sample spectrum itself, particularly where relatively little sample or poor quality sample is available such that the sample spectrum comprises relatively weak peaks and/or comprises poorly defined noise.

Accordingly, in some embodiments, the one or more background noise profiles may be derived from one or more background reference sample spectra other than the sample spectra themselves.

The one or more background noise profiles may comprise one or more background noise profiles for each class of one or more classes of sample.

The one or more background noise profiles may be stored in electronic storage of the spectrometric analysis system.

The electronic storage may form part of or may be coupled to a spectrometer, such as a mass and/or ion mobility spectrometer, of the spectrometric analysis system.

Thus, embodiments may comprise:

obtaining one or more background reference sample spectra for one or more samples;

deriving one or more background noise profiles for the one or more background reference sample spectra, wherein the one or more background noise profiles comprise one or more background noise profiles for each class of one or more classes of sample;

and storing the one or more background noise profiles in electronic storage for use when pre-processing and analysing one or more sample spectra obtained from a different sample to the one or more samples.

The method may comprise performing a background subtraction process on the one or more background reference spectra using the one or more background noise profiles so as to provide one or more background-subtracted reference spectra.

The method may comprise developing a classification model and/or library using the one or more background-subtracted reference spectra.

Embodiments may comprise:

obtaining one or more sample spectra for a sample;

pre-processing the one or more sample spectra, wherein pre-processing the one or more sample spectra comprises a background subtraction process, wherein the background subtraction process comprises retrieving one or more background noise profiles from electronic storage and subtracting the one or more background noise profiles from the one or more sample spectra to produce one or more background-subtracted sample spectra, wherein the one or more background noise profiles are derived from one or more background reference sample spectra obtained for one or more samples that are different to the sample, and wherein the one or more background noise profiles comprise one or more background noise profiles for each class of one or more classes of sample;

and analysing the one or more background-subtracted sample spectra so as to classify the sample.

Reference sample spectra for classes of sample often have a characteristic (e.g., periodic) background noise profile due to particular ions that tend to be generated when ionising samples of that class. Thus, a well-defined background noise profile can be derived in advance for a particular class of sample using one or more background reference sample spectra obtained for samples of that class. The one or more background reference sample spectra may, for example, be obtained from a relatively higher quality or larger amount of sample. These embodiments can, therefore, allow a well-defined background noise profile to be used during a background subtraction process for one or more different sample spectra, particularly in the case where those different sample spectra comprise weak peaks and/or poorly defined noise.

The sample and one or more different samples may or may not be from the same target and/or subject.

The one or more background noise profiles may comprise one or more normalised (e.g., scaled and/or offset) background noise profiles.

The one or more background noise profiles may be normalised based on a statistical property of the one or more background reference sample spectra or parts thereof, such as one or more selected peaks.

The statistical property may be based on a total ion current (TIC), a base peak intensity, an average or quantile intensity value or an average or quantile of some function of intensity for the one or more background reference sample spectra or parts thereof, such as one or more selected peaks.

The average intensity may be a mean average or a median average for the one or more background reference sample spectra or parts thereof, such as one or more selected peaks.

The one or more background noise profiles may be normalised and/or offset such that they have a selected combined intensity, such as a selected summed intensity or a selected average intensity (e.g., 0 or 1).

The one or more normalised background noise profiles may be appropriately scaled and/or offset so as to correspond to the one or more sample spectra before performing the background subtraction process on the one or more sample spectra.

The one or more normalised background noise profiles may be scaled and/or offset based on statistical property of the one or more sample spectra or parts thereof, such as one or more selected peaks.

The statistical property may be based on a total ion current (TIC), a base peak intensity, an average or quantile intensity value or an average or quantile of some function of intensity for the one or more sample spectra or parts thereof, such as one or more selected peaks.

The average intensity may be a mean average or a median average for the one or more sample spectra or parts thereof, such as one or more selected peaks.

Alternatively, the one or more sample spectra may be appropriately normalised (e.g., scaled and/or offset) so as to correspond to the normalised background noise profiles before performing the background subtraction process on the one or more sample spectra.

The one or more sample spectra may be normalised based on statistical property of the one or more sample spectra or parts thereof, such as one or more selected peaks.

The statistical property may be based on a total ion current (TIC), a base peak intensity, an average or quantile intensity value or an average or quantile of some function of intensity for the one or more sample spectra or parts thereof, such as one or more selected peaks.

The average intensity may be a mean average or a median average for the one or more sample spectra or parts thereof, such as one or more selected peaks.

The one or more sample spectra may be normalised and/or offset such that they have a selected combined intensity, such as a selected summed intensity or a selected average intensity (e.g., 0 or 1).

The normalisation to use may be determined by fitting the one or more background profiles to the one or more sample spectra. The normalisation may be optimal or close to optimal. Fitting the one or more background profiles to the one or more sample spectra may use one or more parts of the spectra that do not, or are not likely to contain, non-background data.

The background subtraction process may be performed on the one or more sample spectra using each of the one or more background noise profiles to produce one or more background-subtracted sample spectra for each class of one or more classes of sample.

Analysing the one or more sample spectra may comprise analysing each of the one or more background-subtracted sample spectra so as to provide a distance, classification score or probability for each class of the one or more classes of sample.

Each distance, classification score or probability may indicate the likelihood that the sample belongs to the class of sample that pertains to the one or more background noise profiles that were used to produce the background-subtracted sample spectra.

The sample may be classified into one or more classes of sample having less than a threshold distance or at least a threshold classification score or probability and/or a lowest distance or highest classification score or probability.

The distance, classification score or probability may be provided using a classification model and/or library that was developed using the one or more background reference spectra that were used to derive the one or more background noise profiles. The one or more background reference spectra may have been subjected to a background subtraction process using the one or more background noise profiles so as to provide one or more background subtracted reference spectra prior to building the classification model and/or library using the one or more background subtracted reference spectra.

Each background noise profile may be derived using a technique as described in US 2005/0230611. However, as will be appreciated, in US 2005/0230611 a background noise profile is not derived from a spectrum for a sample and stored for use with a spectrum for a different sample as in embodiments.

Regardless of whether the one or more background noise profiles are derived from the one or more sample spectra themselves or from one or more background reference sample spectra, the one or more background noise profiles may each be derived from one or more sample spectra as follows.

Each background noise profile may be derived by translating a window over the one or more sample spectra or by dividing each of the one or more sample spectra into plural, e.g., overlapping, windows.

The window may or the windows may each correspond to a particular range of times or time-based values, such as masses, mass to charge ratios and/or ion mobilities.

The window may or the windows may each have a width equivalent to a width in Da or Th (Da/e) in a range selected from a group consisting of: (i) ≤ or ≥5; (ii) 5-10; (iii) 10-25; (iv) 25-50; (v) 50-100; (vi) 100-250; (vii) 250-500; and (viii) ≤ or ≥500.

The size of the window or windows may be selected to be sufficiently wide that an adequate statistical picture of the background can be formed and/or the size of the window or windows may be selected to be narrow enough that the (e.g., periodic) profile of the background does not change significantly within the window.

Each background noise profile may be derived by dividing each of the one or more sample spectra, e.g., the window or each of the windows of the one or more sample spectra, into plural segments. There may be M segments in a window, where M may be in a range selected from a group consisting of: (i) ≥2; (ii) 2-5 (iii) 5-10; (iv) 10-20; (v) 20-50; (vi) 50-100; (vii) 100-200; and (viii) ≤ or ≥200.

The segments may each correspond to a particular range of times or time-based values, such as masses, mass to charge ratios and/or ion mobilities.

The segments may each have a width equivalent to a width in Da or Th (Da/e) in a range selected from a group consisting of: (i) ≤ or ≥0.5; (ii) 0.5-1; (iii) 1-2.5; (iv) 2.5-5; (v) 5-10; (vi) 10-25; (vii) 25-50; and (viii) ≤ or ≥50.

The size of the segments may be selected to correspond to an integer number of repeat units of a periodic profile that may be, or may be expected to be, in the background and/or the size of the segments may be selected such that the window or each window contains sufficiently many segments for adequate statistical analysis of the background. In some embodiments, the size of a window is an odd number of segments. This allows there to be a single central segment in the plural segments, giving the process symmetry. Each background noise profile may be derived by dividing each of the one or more sample spectra, e.g., the window or each window and/or each segment of the one or more sample spectra, into plural sub-segments. There may be N sub-segments in a segment, where N may be in a range selected from a group consisting of: (i) ≥2; (ii) 2-5 (iii) 5-10; (iv) 10-20; (v) 20-50; (vi) 50-100; (vii) 100-200; and (viii) ≤ or ≥200.

The sub-segments may each correspond to a particular range of times or time-based values, such as masses, mass to charge ratios and/or ion mobilities.

The sub-segments may each have a width equivalent to a width in Da or Th (Da/e) in a range selected from a group consisting of: (i) ≤ or ≥0.05; (ii) 0.05-0.1; (iii) 0.1-0.25; (iv) 0.25-0.5; (v) 0.5-1; (vi) 1-2.5; (vii) 2.5-5; and (viii) ≤ or ≥5.

The background noise profile value for each nth sub-segment (where $1 \leq n \leq N$), e.g., of a given (e.g., central) segment and/or in a window at a given position, may comprise a combination of the intensity values for the nth sub-segment and the nth sub-segments, e.g., of other segments and/or in the window at the given position, that correspond to the nth sub-segment.

The combination may comprise a (e.g., weighted) summation, average, quantile or other statistical property of the intensity values for the sub-segments.

The average may be a mean average or a median average for intensity values for the sub-segments.

The background noise profile may be derived by fitting a piecewise polynomial to the spectrum. The piecewise polynomial describing the background noise profile may be fitted such that a selected proportion of the spectrum lies below the polynomial in each segment of the piecewise polynomial.

The background noise profile may be derived by filtering in the frequency domain, for example using (e.g., fast) Fourier transforms. The filtering may remove components of the one or more sample spectra that vary relatively slowly with time or time-based value, such as mass, mass to charge ratio and/or ion mobility, The filtering may remove components of the one or more sample spectra that are periodic in time or a time derived time or time-based value, such as mass, mass to charge ratio and/or ion mobility.

The background noise profile values and corresponding time or time-based values for the sub-segments, segments and/or windows may together form the background noise profile for the sample spectrum.

The one or more background noise profiles may each be derived from plural sample spectra.

The plural sample spectra may be combined and then a background noise profile may be derived for the combined sample spectra.

Alternatively, a background noise profile may be derived for each of the plural sample spectra and then the background noise profiles may be combined.

The combination may comprise a (e.g., weighted) summation, average, quantile or other statistical property of the sample spectra or background noise profiles. The average may be a mean average or a median average of the sample spectra or background noise profiles.

Pre-processing the one or more sample spectra may comprise a time value to time-based value conversion process, e.g., a time value to mass, mass to charge ratio and/or ion mobility value conversion process.

The conversion process may comprise converting time-intensity groupings (e.g., flight time-intensity pairs or drift time-intensity pairs) to time-based value-intensity groupings (e.g., mass-intensity pairs, mass to charge ratio-intensity pairs, mobility-intensity pairs, collisional cross-section-intensity pairs, etc.).

The conversion process may be non-linear (e.g., logarithmic-based or power-based, such as square or square-root based). This non-linear conversion may account for the fact that the time of flight of an ion may not be directly proportional to its mass, mass to charge ratio, and/or ion mobility, for example the time of flight of an ion may be directly proportional to the square-root of its mass to charge ratio.

Pre-processing the one or more sample spectra may comprise performing a time or time-based correction, such as a mass, mass to charge ratio and/or ion mobility correction. The time or time-based correction process may comprise a (full or partial) calibration process.

The time or time-based correction may comprise a peak alignment process.

The time or time-based correction process may comprise a lockmass and/or lockmobility (e.g., lock collision cross-section (CCS)) process.

The lockmass and/or lockmobility process may comprise providing lockmass and/or lockmobility ions having one or more known spectral peaks (e.g., at known times or time-based values, such as masses, mass to charge ratios or ion mobilities) together with a plurality of analyte ions.

The lockmass and/or lockmobility process may comprise correcting the one or more sample spectra using the one or more known spectral peaks.

The lockmass and/or lockmobility process may comprise one point lockmass and/or lockmobility correction (e.g., scale or offset) or two point lockmass and/or lockmobility correction (e.g., scale and offset).

The lockmass and/or lockmobility process may comprise measuring the position of each of the one or more known spectral peaks (e.g., during the current experiment) and using the position as a reference position for correction (e.g., rather than using a theoretical or calculated position, or a position derived from a separate experiment). Alternatively, the position may be a theoretical or calculated position, or a position derived from a separate experiment.

The one or more known spectral peaks may be present in the one or more sample spectra either as endogenous or spiked species.

The lockmass and/or lockmobility ions may be provided by a matrix solution, for example IPA.

Pre-processing the one or more sample spectra may comprise normalising and/or offsetting and/or scaling the intensity values of the one or more sample spectra.

The intensity values of the one or more sample spectra may be normalised and/or offset and/or scaled based on a statistical property of the one or more sample spectra or parts thereof, such as one or more selected peaks.

The statistical property may be based on a total ion current (TIC), a base peak intensity, an average or quantile intensity value or an average or quantile of some function of intensity for the one or more sample spectra or parts thereof, such as one or more selected peaks.

The average intensity may be a mean average or a median average for the one or more sample spectra or parts thereof, such as one or more selected peaks.

The normalising and/or offsetting and/or scaling process may be different for different parts of the one or more sample spectra.

The normalising and/or offsetting and/or scaling process may vary according to a normalising and/or offsetting and/or scaling function, e.g., that varies with a time or time-based value, such as mass, mass to charge ratio and/or ion mobility.

Different parts of the one or more sample spectra may be separately subjected to a different normalising and/or offsetting and/or scaling process and then recombined.

Pre-processing the one or more sample spectra may comprise applying a function to the intensity values in the one or more sample spectra.

The function may be non-linear (e.g., logarithmic-based or power-based, for example square or square-root-based).

The function may comprise a variance stabilising function that substantially removes a correlation between intensity variance and intensity in the one or more sample spectra.

The function may enhance one or more particular regions in the one or more sample spectra, such as low, medium and/or high masses, mass to charge ratios, and/or ion mobilities.

The one or more particular regions may be regions identified as having relatively lower intensity variance, for example as identified from one or more reference sample spectra.

The particular regions may be regions identified as having relatively lower intensity, for example as identified from one or more reference sample spectra.

The function may diminish one or more particular other regions in the one or more sample spectra, such as low, medium and/or high masses, mass to charge ratios, and/or ion mobilities.

The one or more particular other regions may be regions identified as having relatively higher intensity variance, for example as identified from one or more reference sample spectra.

The particular other regions may be regions identified as having relatively higher intensity, for example as identified from one or more reference sample spectra.

The function may apply a normalising and/or offsetting and/or scaling, for example described above.

Pre-processing the one or more sample spectra may comprise retaining and/or selecting one or more parts of the one or more sample spectra for further pre-processing and/or analysis based on a time or time-based value, such as a mass, mass to charge ratio and/or ion mobility value. This selection may be performed either prior to or following peak detection. When peak detection is performed prior to selection, the uncertainty in the measured peak position (resulting from ion statistics and calibration uncertainty) may be used as part of the selection criteria.

Pre-processing the one or more sample spectra may comprise retaining and/or selecting one or more parts of the one or more sample spectra that are equivalent to a mass or mass to charge ratio range in Da or Th (Da/e) within one or more ranges selected from the group consisting of: (i) ≤ or ≥200; (ii) 200-400; (iii) 400-600; (iv) 600-800; (v) 800-1000; (vi) 1000-1200; (vii) 1200-1400; (viii) 1400-1600; (ix) 1600-1800; (x) 1800-2000; and (xi) ≤ or ≥2000.

Pre-processing the one or more sample spectra may comprise discarding and/or disregarding one or more parts of the one or more sample spectra from further pre-processing and/or analysis based on a time or time-based value, such as a mass, mass to charge ratio and/or ion mobility value.

Pre-processing the one or more sample spectra may comprise discarding and/or disregarding one or more parts of the one or more sample spectra that are equivalent to a mass or mass to charge ratio range in Da or Th (Da/e) within one or more ranges selected from the group consisting of: (i) ≤ or ≥200; (ii) 200-400; (iii) 400-600; (iv) 600-800; (v) 800-1000; (vi) 1000-1200; (vii) 1200-1400; (viii) 1400-1600; (ix) 1600-1800; (x) 1800-2000; and (xi) ≤ or ≥2000.

This process of retaining and/or selecting and/or discarding and/or disregarding one or more parts of the one or more sample spectra from further pre-processing and/or analysis based on a time or time-based value, such as a mass, mass to charge ratio and/or ion mobility value may be referred to herein as "windowing".

The windowing process may comprise discarding and/or disregarding one or more parts of the one or more sample spectra known to comprise: one or more lockmass and/or lockmobility peaks; and/or one or more peaks for background ions. These parts of the one or more sample spectra typically are not useful for classification and indeed may interfere with classification.

The one or more predetermined parts of the one or more sample spectra that are retained and/or selected and/or discarded and/or disregarded may be one or more regions in multidimensional analytical space (e.g., mass or mass to charge ratio and ion mobility (drift time) space).

One or more analytical dimensions (e.g., relating to a time or time-based value, such as a mass, mass to charge ratio and/or ion mobility value) used for windowing may not be used for further processing and/or analysis once windowing has been performed. For example, where ion mobility is used for windowing and ion mobility is then not used for further processing and/or analysis, the one or more sample spectra may be treated as one or more non-mobility sample spectra.

As discussed above, ions having a mass and/or mass to charge ratios within a range of 600-2000 Da or Th (Da/e) can provide particularly useful sample spectra for classifying some samples, such as samples obtained from bacteria. Also, ions having a mass and/or mass to charge ratio within a range of 600-900 Da or Th (Da/e) can provide particularly useful sample spectra for classifying some samples, such as samples obtained from tissues.

Pre-processing the one or more sample spectra may comprise disregarding, suppressing or flagging regions of the one or more sample spectra that are affected by space charge effects and/or detector saturation and/or ADC saturation and/or data rate limitations.

Pre-processing the one or more sample spectra may comprise a filtering and/or smoothing process. This filtering and/or smoothing process may remove unwanted, e.g., higher frequency, fluctuations in the one or more sample spectra.

The filtering and/or smoothing process may comprise a Savitzky-Golay process.

Pre-processing the one or more sample spectra may comprise a data reduction process, such as a thresholding, peak detection/selection and/or binning process.

The data reduction process may reduce the number of intensity values to be subjected to analysis. The data reduction process may increase the accuracy and/or efficiency and/or reduce the burden of the analysis.

Pre-processing the one or more sample spectra may comprise a thresholding process.

The thresholding process may comprise retaining one or more parts of the one or more sample spectra that are above an intensity threshold or intensity threshold function, e.g., that varies with a time or time-based value, such as mass, mass to charge ratio and/or ion mobility.

The thresholding process may comprise discarding and/or disregarding one or more parts of the one or more sample spectra that are below an intensity threshold or intensity threshold function, e.g., that varies with a time or time-based value, such as mass, mass to charge ratio and/or ion mobility.

The intensity threshold or intensity threshold function may be based on a statistical property of the one or more sample spectra or parts thereof, such as one or more selected peaks.

The statistical property may be based on a total ion current (TIC), a base peak intensity, an average or quantile intensity value or an average or quantile of some function of intensity for the one or more sample spectra or parts thereof, such as one or more selected peaks.

The average intensity may be a mean average or a median average for the one or more sample spectra or parts thereof, such as one or more selected peaks.

The thresholding process may comprise discarding and/or disregarding one or more parts of the one or more sample spectra known to comprise: one or more lockmass and/or lockmobility peaks; and/or one or more peaks for background ions. These parts of the one or more sample spectra typically are not useful for classification and indeed may interfere with classification.

The one or more predetermined parts of the one or more sample spectra that are retained and/or selected and/or discarded and/or disregarded may be one or more regions in multidimensional analytical space (e.g., mass or mass to charge ratio and ion mobility (drift time) space).

One or more analytical dimensions (e.g., relating to a time or time-based value, such as a mass, mass to charge ratio and/or ion mobility value) used for thresholding may not be used for further processing and/or analysis once thresholding has been performed. For example, where ion mobility is used for thresholding and ion mobility is then not used for further processing and/or analysis, the one or more sample spectra may be treated as one or more non-mobility sample spectra.

Pre-processing the one or more sample spectra may comprise a peak detection/selection process.

The peak detection/selection process may comprise finding the gradient or second derivate of the one or more sample spectra and using a gradient threshold or second derivate threshold and/or zero crossing in order to identify rising edges and/or falling edges of peaks and/or peak turning points or maxima.

The peak detection/selection process may comprise a probabilistic peak detection/selection process.

The peak detection process may comprise a USDA (US Department of Agriculture) peak detection process.

The peak detection/selection process may comprise generating one or more peak matching scores. Each of the one or more peak matching scores may be based on a ratio of detected peak intensity to theoretical peak intensity for species suspected to be present in the sample.

One or more peaks may be selected based on the one or more peak matching scores. For example, one or more peaks may be selected that have at least a threshold peak matching score or the highest peak matching score.

The peak detection/selection process may comprise comparing plural sample spectra and identifying common peaks (e.g., using a peak clustering method).

The peak detection/selection process may comprise performing a multidimensional peak detection. The peak detection/selection process may comprise performing a two dimensional or three dimensional peak detection where the two or three dimensions are time or time-based values, such as mass, mass to charge ratio, and/or ion mobility.

Pre-processing the one or more sample spectra may comprise a re-binning process.

The re-binning process may comprise accumulating or histogramming ion detections and/or intensity values in a set of plural bins.

Each bin in the re-binning process may correspond to one or more particular ranges of times or time-based values, such as mass, mass to charge ratio and/or ion mobility. When plural analytical dimensions are used (e.g., mass to charge, ion mobility, operational parameter, etc.), the bins may be regions in the analytical space. The shape of the region may be regular or irregular.

The bins in the re-binning process may each have a width equivalent to:

a width in Da or Th (Da/e) in a range selected from a group consisting of: (i) ≤ or ≥0.01; (ii) 0.01-0.05; (iii) 0.05-0.25; (iv) 0.25-0.5; (v) 0.5-1.0; (vi) 1.0-2.5; (vii) 2.5-5.0; and (viii) ≤ or ≥5.0; and/or a width in milliseconds in a range selected from a group consisting of: (i) ≤ or ≥0.01; (ii) 0.01-0.05; (iii) 0.05-0.25; (iv) 0.25-0.5; (v) 0.5-1.0; (vi) 1.0-2.5; (vii) 2.5-5.0; (viii) 5.0-10; (ix) 10-25; (x) 25-50; (xi) 50-100; (xii) 100-250; (xiii) 250-500; (xiv) 500-1000; and (xv) ≤ or ≥1000.

This re-binning process may reduce the dimensionality (i.e., number of intensity values) for the one or more sample spectra and therefore increase the speed of the analysis.

As discussed above, bins having widths equivalent to widths in the range 0.01-1 Da or Th (Da/e) may provide particularly useful sample spectra for classifying some samples, such as sample obtained from tissues.

The bins may or may not all have the same width.

The bin widths in the re-binning process may vary according to a bin width function, e.g., that varies with a time or time-based value, such as mass, mass to charge ratio and/or ion mobility.

The bin width function may be non-linear (e.g., logarithmic-based or power-based, such as square or square-root-based. The function may take into account the fact that the time of flight of an ion may not be directly proportional to its mass, mass to charge ratio, and/or ion mobility, for example the time of flight of an ion may be directly proportional to the square-root of its mass to charge ratio.

The bin width function may be derived from the known variation of instrumental peak width with time or time-based value, such as mass, mass to charge ratio and/or ion mobility.

The bin width function may be related to known or expected variations in spectral complexity or peak density. For example, the bin width may be chosen to be smaller in regions of the one or more spectra which are expected to contain a higher density of peaks.

Pre-processing the one or more sample spectra may comprise performing a (e.g., further) time or time-based correction, such as a mass, mass to charge ratio or ion mobility correction.

The (e.g., further) time or time-based correction process may comprise a (full or partial) calibration process.

The (e.g., further) time or time-based correction may comprise a (e.g., detected/selected) peak alignment process.

The (e.g., further) time or time-based correction process may comprise a lockmass and/or lockmobility (e.g., lock collision cross-section (CCS)) process.

The lockmass and/or lockmobility process may comprise providing lockmass and/or lockmobility ions having one or more known spectral peaks (e.g., at known times or time-based values, such as masses, mass to charge ratios or ion mobilities) together with a plurality of analyte ions.

The lockmass and/or lockmobility process may comprise aligning the one or more sample spectra using the one or more known spectral peaks.

The lockmass and/or lockmobility process may comprise one point lockmass and/or lockmobility correction (e.g., scale or offset) or two point lockmass and/or lockmobility correction (e.g., scale and offset).

The lockmass and/or lockmobility process may comprise measuring the position of each of the one or more known spectral peaks (e.g., during the current experiment) and using the position as a reference position for correction (e.g., rather than using a theoretical or calculated position, or a position derived from a separate experiment). Alternatively, the position may be a theoretical or calculated position, or a position derived from a separate experiment.

The one or more known spectral peaks may be present in the one or more sample spectra either as endogenous or spiked species.

The lockmass and/or lockmobility ions may be provided by a matrix solution, for example IPA.

Pre-processing the one or more sample spectra may comprise (e.g., further) normalising and/or offsetting and/or scaling the intensity values of the one or more sample spectra.

The intensity values of the one or more sample spectra may be normalised and/or offset and/or scaled based on a statistical property of the one or more sample spectra or parts thereof, such as one or more selected peaks.

The statistical property may be based on a total ion current (TIC), a base peak intensity, an average or quantile intensity value or an average or quantile of some function of intensity for the one or more sample spectra or parts thereof, such as one or more selected peaks.

The average intensity may be a mean average or a median average for the one or more sample spectra or parts thereof, such as one or more selected peaks.

The (e.g., further) normalising and/or offsetting and/or scaling may prepare the intensity values for analysis, e.g., multivariate, univariate and/or library-based analysis.

The intensity values may be normalised and/or offset and/or scaled so as to have a particular average (e.g., mean or median) value, such as 0 or 1.

The intensity values may be normalised and/or offset and/or scaled so as to have a particular minimum value, such as −1, and/or so as to have a particular maximum value, such as 1.

Pre-processing the one or more sample spectra may comprise pre-processing plural sample spectra, for example in a manner as described above.

Pre-processing the one or more sample spectra may comprise combining the plural pre-processed sample spectra or parts thereof, such as one or more selected peaks.

Combining the plural pre-processed sample spectra may comprise a concatenation, (weighted) summation, average, quantile or other statistical property for the plural spectra or parts thereof, such as one or more selected peaks.

The average may be a mean average or a median average for the plural spectra or parts thereof, such as one or more selected peaks.

Analysing the one or more sample spectra may comprise analysing the one or more sample spectra in order: (i) to distinguish between healthy and diseased tissue; (ii) to distinguish between potentially cancerous and non-cancerous tissue; (iii) to distinguish between different types or grades of cancerous tissue; (iv) to distinguish between different types or classes of target material; (v) to determine whether or not one or more desired or undesired substances may be present in the target; (vi) to confirm the identity or authenticity of the target; (vii) to determine whether or not one or more impurities, illegal substances or undesired substances may be present in the target; (viii) to determine whether a human or animal patient may be at an increased risk of suffering an adverse outcome; (ix) to make or assist in the making a diagnosis or prognosis; and/or (x) to inform a surgeon, nurse, medic or robot of a medical, surgical or diagnostic outcome.

Analysing the one or more sample spectra may comprise classifying the sample into one or more classes.

Analysing the one or more sample spectra may comprise classifying the sample as belonging to one or more classes within a classification model and/or library.

The one of more classes may relate to the type, identity, state and/or composition of sample, target and/or subject.

The one of more classes may relate to one or more of: (i) a type and/or subtype of disease (e.g., cancer, cancer type, etc.); (ii) a type and/or subtype of infection (e.g., genus, species, sub-species, gram group, antibiotic or antimicrobial resistance, etc.); (iii) an identity of target and/or subject (e.g., cell, biomass, tissue, organ, subject and/or organism identity); (iv) healthy/unhealthy state or quality (e.g., cancerous, tumorous, malignant, diseased, septic, infected, contaminated, necrotic, stressed, hypoxic, medicated and/or abnormal); (v) degree of healthy/unhealthy state or quality (e.g., advanced, aggressive, cancer grade, low quality, etc.); (vi) chemical, biological or physical composition; (vii) a type of target and/or subject (e.g., genotype, phenotype, sex etc.); (viii) target and/or subject phenotype and/or genotype; and (ix) an actual or expected target and/or subject outcome (e.g., life expectancy, life quality, recovery time, remission rate, surgery success rate, complication rate, complication type, need for further treatment rate, and treatment type typically needed (e.g., surgery, chemotherapy, radiotherapy, medication; hormone treatment, level of dose, etc.), etc.).

The one of more classes can be used to inform decisions, such as whether and how to carry out surgery, therapy and/or diagnosis for a subject. For example, whether and how much target tissue should be removed from a subject and/or whether and how much adjacent non-target tissue should be removed from a subject.

It has been recognised that there can be strong correlation between target and/or subject genotype and/or phenotype on the one hand and expected target and/or subject outcome (e.g., treatment success) on the other. It has further been recognised that knowledge of actual or expected subject outcome relating to samples can be extremely useful for informing decisions, for example treatment decisions, such as whether and how to carry out surgery, therapy and/or diagnosis for a subject. These embodiments can, therefore, provide particularly useful classifications for samples.

The term "phenotype" may be used to refer to the physical and/or biochemical characteristics of a cell whereas the term "genotype" may be used to refer to the genetic constitution of a cell.

The term "phenotype" may be used to refer to a collection of a cell's physical and/or biochemical characteristics, which may optionally be the collection of all of the cell's physical and/or biochemical characteristics; and/or to refer to one or more of a cell's physical and/or biochemical characteristics. For example, a cell may be referred to as having the phenotype of a specific cell type, e.g., a breast cell, and/or as having the phenotype of expressing a specific protein, e.g., a receptor, e.g., HER2 (human epidermal growth factor receptor 2).

The term "genotype" may be used to refer to genetic information, which may include genes, regulatory elements, and/or junk DNA. The term "genotype" may be used to refer to a collection of a cell's genetic information, which may optionally be the collection of all of the cell's genetic information; and/or to refer to one or more of a cell's genetic information. For example, a cell may be referred to as having the genotype of a specific cell type, e.g., a breast cell, and/or as having the genotype of encoding a specific protein, e.g., a receptor, e.g., HER2 (human epidermal growth factor).

The genotype of a cell may or may not affect its phenotype, as explained below.

The relationship between a genotype and a phenotype may be straightforward. For example, if a cell includes a functional gene encoding a particular protein, such as HER2, then it will typically be phenotypically HER2-positive, i.e., have the HER2 protein on its surface, whereas if a cell lacks a functional HER2 gene, then it will have a HER2-negative phenotype.

A mutant genotype may result in a mutant phenotype. For example, if a mutation destroys the function of a gene, then the loss of the function of that gene may result in a mutant phenotype. However, factors such as genetic redundancy may prevent a genotypic trait to result in a corresponding phenotypic trait. For example, human cells typically have two copies of each gene, one from each parent. Talking the example of a genetic disease, a cell may comprise one mutant (diseased) copy of a gene and one non-mutant (healthy) copy of the gene, which may or may not result in a mutant (diseased) phenotype, depending on whether the mutant gene is recessive or dominant. Recessive genes do not, or not significantly, affect a cell's phenotype, whereas dominant genes do affect a cell's phenotype.

It must also be borne in mind that many genotypic changes may have no phenotypic effect, e.g., because they are in junk DNA, i.e., DNA which seems to serve no sequence-dependent purpose, or because they are silent mutations, i.e., mutations which do not change the coding information of the DNA because of the redundancy of the genetic code.

The phenotype of a cell may be determined by its genotype in that a cell requires genetic information to carry out cellular processes and any particular protein may only be generated within a cell if the cell contains the relevant genetic information. However, the phenotype of a cell may also be affected by environmental factors and/or stresses, such as, temperature, nutrient and/or mineral availability, toxins and the like. Such factors may influence how the genetic information is used, e.g., which genes are expressed and/or at which level. Environmental factors and/or stresses may also influence other characteristics of a cell, e.g., heat may make membranes more fluid.

If a functional transgene is inserted into a cell at the correct genomic position, then this may result in a corresponding phenotype The insertion of a transgene may affect a cell's phenotype, but an altered phenotype may optionally only be observed under the appropriate environmental conditions. For example, the insertion of a transgene encoding a protein involved in a synthesis of a particular substance will only result in cells that produce that substance if and when the cells are provided with the required starting materials.

Optionally, the method may involve the analysis of the phenotype and/or genotype of a cell population.

The genotype and/or phenotype of cell population may be manipulated, e.g., to analyse a cellular process, to analyse a disease, such as cancer, to make a cell population more suitable for drug screening and/or production, and the like. Optionally, the method may involve the analysis of the effect of such a genotype and/or phenotype manipulation on the cell population, e.g., on the genotype and/or phenotype of the cell population.

As discussed above, it has been recognised that knowledge of actual or expected subject outcome relating to samples can be extremely useful for informing decisions, for example treatment decisions, such as whether and how to carry out surgery, therapy and/or diagnosis for a subject. These embodiments can, therefore, provide particularly useful classifications for samples.

The one or more classes of genotype and/or phenotype and/or expected outcome for the one or more targets and/or subjects may be indicative of one or more of: (i) life expectancy; (ii) life quality; (iii) recovery time; (iv) remission rate; (v) surgery success rate; (vi) complication rate; (vii) complication type; (viii) need for further treatment rate; and (ix) treatment type typically needed (e.g., surgery, chemotherapy, radiotherapy, medication; hormone treatment, level of dose, etc.).

The one or more classes of genotype and/or phenotype and/or expected outcome for the one or more targets and/or subjects may be indicative of an outcome of following a particular course of action (e.g., treatment).

The method may comprise following the particular course of action when the outcome of following the particular course of action is indicated as being relatively good, e.g., longer life expectancy; better life quality; shorter recovery time; higher remission rate; higher surgery success rate; lower complication rate; less severe complication type; lower need for further treatment rate; and/or less severe further treatment type typically needed.

The method may comprise not following the particular course of action when the outcome of following the particular course of action is indicated as being relatively poor, e.g., shorter life expectancy; worse life quality; longer recovery time; lower remission rate; lower surgery success rate; higher complication rate; more severe complication type; higher need for further treatment rate; and/or more severe further treatment type typically needed.

The particular course of action may be: (i) an amputation; (ii) a debulking; (iii) a resection; (iv) a transplant; or (v) a (e.g., bone or skin) graft.

The method may comprise monitoring and/or separately testing one or more targets and/or subjects in order to determine and/or confirm the genotype and/or phenotype and/or outcome.

Analysing the one or more sample spectra may be performed by analysis circuitry of the spectrometric analysis system.

The analysis circuitry may form part of or may be coupled to a spectrometer, such as a mass and/or ion mobility spectrometer, of the spectrometric analysis system.

Analysing the one or more sample spectra may comprise unsupervised analysis of the one or more sample spectra (e.g., for dimensionality reduction) and/or supervised analysis (e.g., for classification) of the one or more sample spectra. Analysing the one or more sample spectra may comprise unsupervised analysis (e.g., for dimensionality reduction) followed by supervised analysis (e.g., for classification).

Analysing the one or more sample spectra may comprise using one or more of: (i) univariate analysis; (ii) multivariate analysis; (iii) principal component analysis (PCA); (iv) linear discriminant analysis (LDA); (v) maximum margin criteria (MMC); (vi) library-based analysis; (vii) soft independent modelling of class analogy (SIMCA); (viii) factor analysis (FA); (ix) recursive partitioning (decision trees); (x) random forests; (xi) independent component analysis (ICA); (xii) partial least squares discriminant analysis (PLS-DA); (xiii) orthogonal (partial least squares) projections to latent structures (OPLS); (xiv) OPLS discriminant analysis (OPLS-DA); (xv) support vector machines (SVM); (xvi) (artificial) neural networks; (xvii) multilayer perceptron; (xviii) radial basis function (RBF) networks; (xix) Bayesian analysis; (xx) cluster analysis; (xxi) a kernelized method; (xxii) subspace discriminant analysis; (xxiii) k-nearest neighbours (KNN); (xxiv) quadratic discriminant analysis (QDA); (xxv) probabilistic principal component Analysis (PPCA); (xxvi) non negative matrix factorisation; (xxvii) k-means factorisation; (xxviii) fuzzy c-means factorisation; and (xxix) discriminant analysis (DA).

Analysing the one or more sample spectra may comprise a combination of the foregoing analysis techniques, such as PCA-LDA, PCA-MMC, PLS-LDA, etc.

Analysing the one or more sample spectra may comprise developing a classification model and/or library using one or more reference sample spectra.

The one or more reference sample spectra may each have been or may each be obtained and/or pre-processed, for example in a manner as described above.

A set of reference sample intensity values may be derived from each of the one or more reference sample spectra, for example in a manner as described above.

In multivariate analysis, each set of reference sample intensity values may correspond to a reference point in a multivariate space having plural dimensions and/or plural intensity axes.

Each dimension and/or intensity axis may correspond to a particular time or time-based value, such as a particular mass, mass to charge ratio and/or ion mobility.

Each dimension and/or intensity axis may also correspond to a particular mode of operation.

Each dimension and/or intensity axis may correspond to a range, region or bin (e.g., comprising (an identified cluster of) one or more peaks) in an analytical space having one or more analytical dimensions. Where plural analytical dimensions are used (e.g., mass to charge, ion mobility, operational parameter, etc.), each dimension and/or intensity axis in multivariate space may correspond to a region or bin (e.g., comprising one or more peaks) in the analytical space. The shape of the region or bin may be regular or irregular. The multivariate space may be represented by a reference matrix having have rows associated with respective reference sample spectra and columns associated with respective time or time-based values and/or modes of operation, or vice versa, the elements of the reference matrix being the reference sample intensity values for the respective time or time-based values and/or modes of operation of the respective reference sample spectra.

The multivariate analysis may be carried out on the reference matrix in order to define a classification model having one or more (e.g., desired or principal) components and/or to define a classification model space having one or more (e.g., desired or principal) component dimensions or axes.

A first component and/or component dimension or axis may be in a direction of highest variance and each subsequent component and/or component dimension or axis may be in an orthogonal direction of next highest variance.

The classification model and/or classification model space may be represented by one or more classification model vectors or matrices (e.g., one or more score matrices, one or more loading matrices, etc.). The multivariate analysis may also define an error vector or matrix, which does not form part of, and is not "explained" by, the classification model.

The reference matrix and/or multivariate space may have a first number of dimensions and/or intensity axes, and the classification model and/or classification model space may have a second number of components and/or dimensions or axes.

The second number may be lower than the first number.

The second number may be selected based on a cumulative variance or "explained" variance of the classification model being above an explained variance threshold and/or based on an error variance or an "unexplained" variance of the classification model being below an unexplained variance threshold.

The second number may be lower than the number of reference sample spectra.

Analysing the one or more sample spectra may comprise principal component analysis (PCA). In these embodiments, a PCA model may be calculated by finding eigenvectors and eigenvalues. The one or more components of the PCA model may correspond to one or more eigenvectors having the highest eigenvalues.

The PCA may be performed using a non-linear iterative partial least squares (NIPALS) algorithm or singular value decomposition. The PCA model space may define a PCA space. The PCA may comprise probabilistic PCA, incremental PCA, non-negative PCA and/or kernel PCA.

Analysing the one or more sample spectra may comprise linear discriminant analysis (LDA).

Analysing the one or more sample spectra may comprise performing linear discriminant analysis (LDA) (e.g., for classification) after performing principal component analysis (PCA) (e.g., for dimensionality reduction). The LDA or PCA-LDA model may define an LDA or PCA-LDA space. The LDA may comprise incremental LDA.

As discussed above, analysing the one or more sample spectra may comprise a maximum margin criteria (MMC) process.

Analysing the one or more sample spectra may comprise performing a maximum margin criteria (MMC) process (e.g., for classification) after performing principal component analysis (PCA) (e.g., for dimensionality reduction). The MMC or PCA-MMC model may define an MMC or PCA-MMC space.

As discussed above, analysing the one or more sample spectra may comprise library-based analysis.

Library-based analysis is particularly suitable for classification of samples, for example in real-time. An advantage of library based analysis is that a classification score or probability may be calculated independently for each library entry. The addition of a new library entry or data representing a library entry may also be done independently for each library entry. In contrast, multivariate or neural network based analysis may involve rebuilding a model, which can be time and/or resource consuming. These embodiments can, therefore, facilitate classification of a sample.

In library-based analysis, analysing the one or more sample spectra may comprise deriving one or more sets of metadata for the one or more sample spectra.

Each set of metadata may be representative of a class of one or more classes of sample.

Each set of metadata may be stored in an electronic library.

Each set of metadata for a class of sample may be derived from a set of plural reference sample spectra for that class of sample.

Each set of plural reference sample spectra may comprise plural channels of corresponding (e.g., in terms of time or time-based value, e.g., mass, mass to charge ratio, and/or ion mobility) intensity values, and wherein each set of metadata comprises an average value, such as mean or median, and/or a deviation value for each channel.

Use of this metadata is described in more detail below.

Analysing the one or more sample spectra may comprise defining one or more classes within a classification model and/or library.

The one or more classes may be defined within a classification model and/or library in a supervised and/or unsupervised manner.

Analysing the one or more sample spectra may comprise defining one or more classes within a classification model and/or library manually or automatically according to one or more class criteria.

The one or more class criteria for each class may be based on one or more of: (i) a distance (e.g., squared or root-squared distance and/or Mahalanobis distance and/or (variance) scaled distance) between one or more pairs of reference points for reference sample spectra within a classification model space; (ii) a variance value between groups of reference points for reference sample spectra within a classification model space; and (iii) a variance value within a group of reference points for reference sample spectra within a classification model space.

The one or more classes may each be defined by one or more class definitions.

The one or more class definitions may comprise one or more of: (i) a set of one or more reference points for reference sample spectra, values, boundaries, lines, planes, hyperplanes, variances, volumes, Voronoi cells, and/or positions, within a classification model space; and (ii) one or more positions within a hierarchy of classes.

Analysing the one or more sample spectra may comprise identifying one or more outliers in a classification model and/or library.

Analysing the one or more sample spectra may comprise removing one or more outliers from a classification model and/or library.

Analysing the one or more sample spectra may comprise subjecting a classification model and/or library to cross-validation to determine whether or not the classification model and/or library is successfully developed.

The cross-validation may comprise leaving out one or more reference sample spectra from a set of plural reference sample spectra used to develop a classification model and/or library.

The one or more reference sample spectra that are left out may relate to one or more particular targets and/or subjects.

The one or more reference sample spectra that are left out may be a percentage of the set of plural reference sample spectra used to develop the classification model and/or library, the percentage being in a range selected from a group consisting of: (i) ≤ or ≥0.1%; (ii) 0.1-0.2%; (iii) 0.2-0.5%; (iv) 0.5-1.0%; (v) 1.0-2.0%; (vi) 2.0-5%; (vii) 5-10.0%; and (viii) ≤ or ≥10.0%.

The cross-validation may comprise using the classification model and/or library to classify one or more reference sample spectra that are left out of the classification model and/or library.

The cross-validation may comprise determining a cross-validation score based on the proportion of reference sample spectra that are correctly classified by the classification model and/or library.

The cross-validation score may be a rate or percentage of reference sample spectra that are correctly classified by the classification model and/or library.

The classification model and/or library may be considered successfully developed when the sensitivity (true-positive rate or percentage) of the classification model and/or library is greater than a sensitivity threshold and/or when the specificity (true-negative rate or percentage) of the classification model and/or library is greater than a specificity threshold.

Analysing the one or more sample spectra may comprise using a classification model and/or library, for example a classification model and/or library as described above, to classify one or more sample spectra as belonging to one or more classes of sample.

The one or more sample spectra may each have been or may each be obtained and/or pre-processed, for example in a manner as described above.

A set of sample intensity values may be derived from each of the one or more sample spectra, for example in a manner as described above. For example, a different set of background-subtracted sample intensity values may be derived for each class of one or more classes of sample.

In multivariate analysis, each set of sample intensity values may correspond to a sample point in a multivariate space having plural dimensions and/or plural intensity axes. Each dimension and/or intensity axis may correspond to a particular time or time-based value.

Each dimension and/or intensity axis may correspond to a particular mode of operation.

Each set of sample intensity values may be represented by a sample vector, the elements of the sample vector being the intensity values for the respective time or time-based values and/or modes of operation of the one or more sample spectra.

A sample point and/or vector for the one or more sample spectra may be projected into a classification model space so as to classify the one or more sample spectra.

Previously developed multivariate modes spaces are particularly suitable for later classification of samples, for example in real-time. These embodiments can, therefore, facilitate classification of a sample.

The sample point and/or vector may be projected into the classification model space using one or more vectors or matrices of the classification model (e.g., one or more loading matrices, etc.).

The one or more sample spectra may be classified as belonging to a class based on the position of the projected sample point and/or vector in the classification model space.

In library-based analysis, analysing the one or more sample spectra may comprise calculating one or more probabilities or classification scores based on the degree to which the one or more sample spectra correspond to one or more classes of sample represented in an electronic library.

As discussed above, one or more sets of metadata that are each representative of a class of one or more classes of sample may be stored in the electronic library.

Analysing the one or more sample spectra may comprise, for each of the one or more classes, calculating a likelihood of each intensity value in a set of sample intensity values for the one or more sample spectra given the set of metadata stored in the electronic library that is representative of that class. As discussed above, a different set of background-subtracted sample intensity values may be derived for each class of one or more classes of sample.

Each likelihood may be calculated using a probability density function.

The probability density function may be based on a generalised Cauchy distribution function.

The probability density function may be a Cauchy distribution function, a Gaussian (normal) distribution function, or other probability density function based on a combination of a Cauchy distribution function and a Gaussian (normal) distribution function.

Plural likelihoods calculated for a class may be combined (e.g., multiplied) to give a probability that the one or more sample spectra belongs to that class.

Alternatively, analysing the one or more sample spectra may comprise, for each of the one or more classes, calculating a classification score (e.g., a distance score, such as a root-mean-square score) for a intensity values in the set of intensity values for the one or more sample spectra using the metadata stored in the electronic library that is representative of that class.

A probability or classification score may be calculated for each one of plural classes, for example in the manner described above.

The probabilities or classification scores for the plural classes may be normalised across the plural classes.

The one or more sample spectra may be classified as belonging to a class based on the one or more (e.g., normalised) probabilities or classification scores.

Analysing the one or more sample spectra may comprise classifying one or more sample spectra as belonging to one or more classes in a supervised and/or unsupervised manner.

Analysing the one or more sample spectra may comprise classifying one or more sample spectra manually or automatically according to one or more classification criteria. The one or more classification criteria may be based on one or more class definitions.

The one or more class definitions may comprise one or more of: (i) a set of one or more reference points for reference sample spectra, values, boundaries, lines, planes, hyperplanes, variances, volumes, Voronoi cells, and/or positions, within a classification model space; and (ii) one or more positions within a hierarchy of classes.

The one or more classification criteria may comprise one or more of: (i) a distance (e.g., squared or root-squared distance and/or Mahalanobis distance and/or (variance) scaled distance) between a projected sample point for one or more sample spectra within a classification model space and a set of one or more reference points for one or more reference sample spectra, values, boundaries, lines, planes, hyperplanes, volumes, Voronoi cells, or positions, within the classification model space being below a distance threshold or being the lowest such distance; (ii) one or more projected sample points for one or more sample spectra within a classification model space being one side or other of one or more reference points for one or more reference sample spectra, values, boundaries, lines, planes, hyperplanes, or positions, within the classification model space; (iii) one or more projected sample points within a classification model space being within one or more volumes or Voronoi cells within the classification model space; (iv) a probability that one or more projected sample points for one or more sample spectra within a classification model space belong to a class being above a probability threshold or being the highest such probability; and (v) a probability or classification score being above a probability or classification score threshold or being the highest such probability or classification score.

The one or more classification criteria may be different for different types of class. The one or more classification criteria for a first type of class may be relatively less stringent and the one or more classification criteria for a second type of class may be relatively more stringent. This may increase the likelihood that the sample is classified as being in a class belonging to the first type of class and/or may reduce the likelihood that the sample is classified as being in a class belonging to the second type of class. This may be useful when incorrect classification in a class belonging to the first type of class is more acceptable than incorrect classification in a class belonging to the second type of class. The first type of class may comprise unhealthy and/or undesirable and/or lower quality target matter and the second type of class may comprise healthy and/or desirable and/or higher quality target matter, or vice versa.

Analysing the one or more sample spectra may comprise modifying a classification model and/or library.

Modifying the classification model and/or library may comprise adding one or more previously unclassified sample spectra to one or more reference sample spectra used to develop the classification model and/or library to provide an updated set of reference sample spectra.

Modifying the classification model and/or library may comprise deriving one or more background noise profiles for one or more previously unclassified sample spectra and storing the one or more background noise profiles in electronic storage for use when pre-processing and analysing one or more further sample spectra obtained from a further different aerosol, smoke or vapour sample.

Modifying the classification model and/or library may comprise re-developing the classification model and/or library using the updated set of reference sample spectra. Modifying the classification model and/or library may comprise re-defining one or more classes of the classification model and/or library using the updated set of reference sample spectra. This can account for targets whose characteristics may change over time, such as developing cancers, evolving microorganisms, etc.

As discussed above, the one or more sample spectra may be obtained using a sampling device. In these embodiments, analysing the one or more sample spectra may take place while the sampling device remains in use.

Analysing one or more sample spectra while a sampling device remains in use can allow a classification model and/or library to be developed and/or modified and/or used for classification substantially in real-time. These embodiments are, therefore, particularly advantageous for applications, for example where real-time analysis is desired.

Analysing the one or more sample spectra may comprise developing and/or modifying a classification model and/or library while the sampling device remains in use, for example while and/or subsequent to obtaining one or more reference sample spectra.

Analysing the one or more sample spectra may comprise using a classification model and/or library while the sampling device remains in use, for example while and/or subsequent to obtaining one or more sample spectra.

The method may comprise stopping a mode of operation, for example to avoid unwanted sampling and/or target or subject damage.

The method may comprise selecting a mode of operation so as to classify the sample.

The method may comprise changing from a first mode of operation to a second different mode of operation, or vice versa, so as to classify the sample.

Selecting a mode of operation and/or changing between first and second different modes of operations can reduce or resolve ambiguity in one or more sample spectra classifications, provide one or more sample spectra sub-classifications, and/or provide confirmation of one or more sample spectra classifications. Selecting a mode of operation and/or changing between first and second different modes of operations can also facilitate accurate classification of a sample, for example by improving the quality, e.g., peak strength, signal to noise, etc., in the sample spectra and/or improve the relevancy or accuracy of the classification. These embodiments are, therefore, particularly advantageous.

The mode of operation may be selected and/or changed based on a classification for a target and/or subject sample and/or a classification for one or more previous sample spectra.

The target and/or subject sample and/or one or more previous sample spectra may have been obtained from the same target and/or subject as the one or more sample spectra.

The one or more previous sample spectra may have been obtained and/or pre-processed and/or analysed in a manner as described above.

The mode of operation may be selected and/or changed manually or automatically. The mode of operation may be selected and/or changed based on a likelihood of a previous classification being correct. For example, a relatively lower likelihood may cause a different mode of operation to be used whereas a relatively higher likelihood may not. Selecting and/or changing the mode of operation may comprise selecting and/or changing a mode of operation for obtaining sample spectra.

The mode of operation for obtaining sample spectra may be selected and/or changed with respect to: (i) the condition of the target or subject that is sampled when obtaining a sample (e.g., stressed, hypoxic, medicated, etc.); (ii) the type of device used to obtain a sample (e.g., needle, probe, forceps, etc.); (iii) the device settings used when obtaining a sample (e.g., the potentials, frequencies, etc., used); (iv) the device mode of operation when obtaining a sample (e.g., probing mode, pointing mode, cutting mode, resecting mode, coagulating mode, desiccating mode, fulgurating mode, cauterising mode, etc.); (v) the type of ion source used; (vi) the sampling time over which a sample is obtained; (vii) the ion mode used to generate analyte ions for a sample (e.g., positive ion mode and/or negative ion mode); (viii) the spectrometer settings used when obtaining the one or more sample spectra (e.g., potentials, potential waveforms (e.g., waveform profiles and/or velocities), frequencies, gas types and/or pressures, dopants, etc., used); (ix) the use, number and/or type of fragmentation or reaction steps (e.g., MS/MS, $MS^n$, $MS^E$, higher energy or lower energy fragmentation or reaction steps, Electron-Transfer Dissociation (ETD), etc.); (x) the use, number and/or type of mass or mass to charge ratio separation or filtering steps (e.g., the range of masses or mass to charge ratios that are scanned, selected or filtered); (xi) the use, number and/or type of ion mobility separation or filtering steps (e.g., the range of drift times that are scanned, selected or filtered, the gas types and/or pressures, dopants, etc., used); (xii) the use, number and/or type of charge state separation or filtering steps (e.g., the charge states that are scanned, selected or filtered); (xiii) the type of ion detector used when obtaining one or more sample spectra; (xiv) the ion detector settings (e.g., the potentials, frequencies, gains, etc., used); and (xv) the binning process (e.g., bin widths) used.

Selecting and/or changing the mode of operation may comprise selecting and/or changing a mode of operation for pre-processing sample spectra.

The mode of operation for pre-processing sample spectra may be selected and/or changed with respect to one or more of: (i) the number and type of spectra that are combined; (ii) the background subtraction process; (iii) the conversion/correction process; (iv) the normalising, offsetting, scaling and/or function application process; the windowing process (e.g., range(s) of masses, mass to charge ratios, or ion mobilities that are retained or selected); (v) the filtering/smoothing process; (vi) the data reduction process; (vii) the thresholding process; (viii) the peak detection/selection process; (ix) the deisotoping process; (x) the re-binning process; (xi) the (further) correction process; and (xii) the (further) normalising, offsetting, scaling and/or function application process.

Selecting and/or changing the mode of operation may comprise selecting and/or changing a mode of operation for analysing sample spectra.

The mode of operation for analysing the one or more sample spectra may be selected and/or changed with respect to one or more of: (i) the one or more types of classification analysis (e.g., multivariate, univariate, library-based, supervised, unsupervised, etc.) used; (ii) the one or more particular classification models and/or libraries used; (iii) the one or more particular reference sample spectra used for the classification model and/or library; (iv) the one or more particular classes or class definitions used.

The method may comprise obtaining and/or pre-processing and/or analysing one or more sample spectra for a sample using a first mode of operation.

The method may comprise obtaining and/or pre-processing and/or analysing one or more sample spectra for a sample using a second mode of operation.

A mode of operation may comprise one or more of: (i) mass, mass to charge ratio and/or ion mobility spectrometry; (ii) spectroscopy, including Raman and/or Infra-Red (IR) spectroscopy; and (iii) Radio-Frequency (RF) impedance ultrasound.

As discussed above, the one or more sample spectra may be obtained using a sampling device. In these embodiments, the mode of operation may be selected and/or changed while the sampling device remains in use.

The method may comprise using a first mode of operation to provide a first classification for a particular target and/or subject, and using a second different mode of operation to provide a second classification for the same particular target and/or subject.

Using first and second modes of operation to obtain first and second classifications for a particular target and/or subject can reduce or resolve ambiguity in one or more sample spectra classifications, provide one or more sample spectra sub-classifications, and/or provide confirmation of one or more sample spectra classifications. Using first and second modes of operation to obtain first and second classifications for a particular target and/or subject can also facilitate accurate classification of a sample, for example by appropriately changing the mode of operation so as to improve the quality, e.g., peak strength, signal to noise, etc., in the sample spectra and/or improve the relevancy or accuracy of the classification. These embodiments are, therefore, particularly advantageous.

The first mode of operation may be used before or after or at substantially the same time as the second mode of operation.

The first mode of operation may provide a first classification score based on the likelihood of the first classification being correct. The second different mode of operation may provide a second classification score based on the likelihood of the second classification being correct.

The first classification score and second classification score may be combined so as to provide a combined classification score.

The combined classification score may be based on (e.g., weighted) summation, multiplication or average of the first classification score and second classification score.

The sample may be classified based on the combined classification score.

In some embodiments, the second classification may be the same as the first classification or may be a sub-classification within the first classification or may be a classification that contains the first classification. The second classification may confirm the first classification.

Alternatively, the second classification may not be the same as the first classification and/or may not be a sub-classification within the first classification and/or may not be a classification that contains the first classification. The second classification may contradict the first classification.

As discussed above, the one or more sample spectra may be obtained using a sampling device. In these embodiments, the mode of operation may be changed while the sampling device remains in use.

In some embodiments, obtaining the one or more sample spectra may comprise obtaining one or more (e.g., known) reference sample spectra and one or more (e.g., unknown) sample spectra for the same particular target and/or subject, and analysing the one or more sample spectra may comprise developing and/or modifying and/or using a classification model and/or library tailored for the particular target and/or subject.

Using a classification model and/or library developed and/or modified specifically for a particular target and/or subject can improve the relevancy and/or accuracy of the classification for the particular target and/or subject. These embodiments are, therefore, particularly advantageous.

As discussed above, the one or more sample spectra may be obtained using a sampling device. In these embodiments, the classification model and/or library for the particular target and/or subject may be developed and/or modified and/or used while the sampling device remains in use.

Plural classification models and/or libraries, for example each having one or more classes, may be developed and/or modified and/or used as described above in any aspect or embodiment.

Analysing the one or more sample spectra may produce one or more results. The one or more results may comprise one or more classification models and/or libraries and/or class definitions and/or classification criteria and/or classifications for the sample. The one or more results may correspond to one or more regions of a target and/or subject.

The results may be used by control circuitry of the spectrometric analysis system.

The control circuitry may form part of or may be coupled to a spectrometer, such as a mass and/or ion mobility spectrometer, of the spectrometric analysis system.

The method may comprise stopping a mode of operation, for example in a manner as discussed above, based on the one or more results.

The method may comprise selecting and/or changing a mode of operation, for example in a manner as discussed above, based on the one or more results.

The method may comprise developing and/or modifying a classification model and/or library, for example in a manner as discussed above, based on the one or more results.

The method may comprise outputting the one or more results to electronic storage of the spectrometric analysis system.

The electronic storage may form part of or may be coupled to a spectrometer, such as a mass and/or ion mobility spectrometer, of the spectrometric analysis system.

The method may comprise transmitting the one or more results to a first location from a second location.

The method may comprise receiving the one or more results at a first location from a second location.

As discussed above, the first location may be a remote or distal sampling location and/or the second location may be a local or proximal analysis location. This can allow, for example, the one or more sample spectra to be analysed at a safer or more convenient location but used at a disaster location (e.g., earthquake zone, war zone, etc.) at which the one or more sample spectra were obtained.

As discussed above, the one or more sample spectra may be obtained using a sampling device. In these embodiments, the method may comprise providing feedback based on the one or more results while the sampling device remains in use while the sampling device remains in use.

Providing feedback based on one or more results while a sampling device remains in use can make timely (e.g., intra-operative) use of a sample classification. These embodiments are, therefore, particularly advantageous.

Providing feedback may comprise outputting the one or more results to one or more feedback devices of the spectrometric analysis system.

The one or more feedback devices may comprise one or more of: a haptic feedback device, a visual feedback device, and/or an audible feedback device.

Providing the one or more results may comprise displaying the one or more results, e.g., using a visual feedback device.

Displaying the one or more results may comprise displaying one or more of: (i) one or more classification model spaces comprising one or more reference points for one or more reference sample spectra; (ii) one or more classification model spaces comprising one or more sample points for one or more sample spectra; (iii) one or more library entries (e.g., metadata) for one or more classes of sample; (iv) one or more class definitions for one or more classes of sample; (v) one or more classification criteria for one or more classes of sample; (vi) one or more probabilities or classification scores for the sample; (vii) one or more classifications for the sample; and/or (viii) one or more scores or loadings for a classification model.

Displaying the one or more results may comprise displaying the one or more results graphically and/or alphanumerically.

Displaying the one or more results graphically may comprise displaying one or more graphical representations of the one or more results.

The one or more graphical representations may have a shape, size, pattern and/or colour based on the one or more results.

Displaying the one or more results may comprise displaying a guiding line or guiding area on a target and/or subject, and/or overlaying a guiding line or guiding area on an image that corresponds to a target and/or subject.

Displaying the one or more results may comprise displaying the one or more results on one or more regions of a target and/or subject, and/or overlaying the one or more results on one or more areas of an image that correspond to one or more regions of a target and/or subject.

The method may be used in the context of one or more of: (i) humans; (ii) animals; (iii) plants; (iv) microbes; (v) food; (vi) drink; (vii) e-cigarettes; (viii) cells; (ix) tissues; (x) faeces; (xi) chemicals; and (xii) bio-pharma (e.g., fermentation broths).

In some embodiments, the method may encompass treatment of a human or animal body by surgery or therapy and/or may encompass diagnosis practiced on a human or animal body. The method may be surgical and/or therapeutic and/or diagnostic.

According to various embodiments there is provided a method of pathology, surgery, therapy, treatment, diagnosis, biopsy and/or autopsy comprising a method of spectrometric analysis as described herein in any aspect or embodiment.

In other embodiments, the method does not encompass treatment of a human or animal body by surgery or therapy and/or does not include diagnosis practiced on a human or animal body. The method may be non-surgical and/or non-therapeutic and/or non-diagnostic.

According to various embodiments there is provided a method of quality control comprising a method of spectrometric analysis as described herein in any aspect or embodiment.

Various embodiments are contemplated which relate to generating smoke, aerosol or vapour from a target (details of which are provided elsewhere herein) using an ambient ionisation ion source. The aerosol, smoke or vapour may then be mixed with a matrix and aspirated into a vacuum chamber of a mass spectrometer and/or ion mobility spectrometer. The mixture may be caused to impact upon a collision surface causing the aerosol, smoke or vapour to be ionised by impact ionization which results in the generation of analyte ions. The resulting analyte ions (or fragment or product ions derived from the analyte ions) may then be mass analysed and/or ion mobility analysed and the resulting mass spectrometric data and/or ion mobility spectrometric data may be subjected to multivariate analysis or other mathematical treatment in order to determine one or more properties of the target in real time.

According to an embodiment the device for generating aerosol, smoke or vapour from the target may comprise a tool which utilises an RF voltage, such as a continuous RF waveform.

Other embodiments are contemplated wherein the device for generating aerosol, smoke or vapour from the target may comprise an argon plasma coagulation ("APC") device. An argon plasma coagulation device involves the use of a jet of ionised argon gas (plasma) that is directed through a probe. The probe may be passed through an endoscope. Argon plasma coagulation is essentially a non-contact process as the probe is placed at some distance from the target. Argon gas is emitted from the probe and is then ionized by a high voltage discharge (e.g., 6 kV). High-frequency electric current is then conducted through the jet of gas, resulting in coagulation of the target on the other end of the jet. The depth of coagulation is usually only a few millimetres.

The device for generating aerosol, smoke or vapour, e.g., surgical or electrosurgical tool, device or probe or other sampling device or probe, disclosed in any of the embodiments herein may comprise a non-contact surgical device, such as one or more of a hydrosurgical device, a surgical water jet device, an argon plasma coagulation device, a hybrid argon plasma coagulation device, a water jet device and a laser device.

A non-contact surgical device may be defined as a surgical device arranged and adapted to dissect, fragment, liquefy, aspirate, fulgurate or otherwise disrupt biologic tissue without physically contacting the tissue. Examples include laser devices, hydrosurgical devices, argon plasma coagulation devices and hybrid argon plasma coagulation devices.

As the non-contact device may not make physical contact with the tissue, the procedure may be seen as relatively safe and can be used to treat delicate tissue having low intracellular bonds, such as skin or fat.

According to various embodiments the mass spectrometer and/or ion mobility spectrometer may obtain data in negative ion mode only, positive ion mode only, or in both positive and negative ion modes. Positive ion mode spectrometric data may be combined or concatenated with negative ion mode spectrometric data. Negative ion mode can provide particularly useful spectra for classifying aerosol, smoke or vapour samples, such as aerosol, smoke or vapour samples from targets comprising lipids.

Ion mobility spectrometric data may be obtained using different ion mobility drift gases, or dopants may be added to the drift gas to induce a change in drift time of one or more species. This data may then be combined or concatenated.

It will be apparent that the requirement to add a matrix or a reagent directly to a sample may prevent the ability to perform in vivo analysis of tissue and also, more generally, prevents the ability to provide a rapid simple analysis of target material.

According to other embodiments the ambient ionisation ion source may comprise an ultrasonic ablation ion source or a hybrid electrosurgical-ultrasonic ablation source that generates a liquid sample which is then aspirated as an aerosol. The ultrasonic ablation ion source may comprise a focused or unfocussed ultrasound.

Optionally, the device for generating aerosol, smoke or vapour comprises or forms part of an ion source selected from the group consisting of: (i) a rapid evaporative ionisation mass spectrometry ("REIMS") ion source; (ii) a desorption electrospray ionisation ("DESI") ion source; (iii) a laser desorption ionisation ("LDI") ion source; (iv) a thermal desorption ion source; (v) a laser diode thermal desorption ("LDTD") ion source; (vi) a desorption electroflow focusing ("DEFFI") ion source; (vii) a dielectric barrier discharge ("DBD") plasma ion source; (viii) an Atmospheric Solids Analysis Probe ("ASAP") ion source; (ix) an ultrasonic assisted spray ionisation ion source; (x) an easy ambient sonic-spray ionisation ("EASI") ion source; (xi) a desorption atmospheric pressure photoionisation ("DAPPI") ion source; (xii) a paperspray ("PS") ion source; (xiii) a jet desorption ionisation ("JeDI") ion source; (xiv) a touch spray ("TS") ion source; (xv) a nano-DESI ion source; (xvi) a laser ablation electrospray ("LAESI") ion source; (xvii) a direct analysis in real time ("DART") ion source; (xviii) a probe electrospray ionisation ("PESI") ion source; (xix) a solid-probe assisted electrospray ionisation ("SPA-ESI") ion source; (xx) a cavitron ultrasonic surgical aspirator ("CUSA") device; (xxi) a hybrid CUSA-diathermy device; (xxii) a focussed or unfocussed ultrasonic ablation device; (xxiii) a hybrid focussed or unfocussed ultrasonic ablation and diathermy device; (xxiv) a microwave resonance device; (xxv) a pulsed plasma RF dissection device; (xxvi) an argon plasma coagulation device; (xxvi) a hybrid pulsed plasma RF dissection and argon plasma coagulation device; (xxvii) a hybrid pulsed plasma RF dissection and JeDI device; (xxviii) a surgical water/saline jet device; (xxix) a hybrid electrosurgery and argon plasma coagulation device; and (xxx) a hybrid argon plasma coagulation and water/saline jet device.

According to an aspect there is provided a method of mass and/or ion mobility spectrometry comprising a method of spectrometric analysis as described herein in any aspect or embodiment.

According to an aspect there is provided a mass and/or ion mobility spectrometric analysis system and/or a mass and/or ion mobility spectrometer comprising a spectrometric analysis system as described herein in any aspect or embodiment.

Even if not explicitly stated, the methods of spectrometric analysis described herein may comprise performing any step or steps performed by the spectrometric analysis system as described herein in any aspect or embodiment, as appropriate.

Similarly, even if not explicitly stated, the (e.g., circuitry and/or devices of the) spectrometric analysis systems described herein may be arranged and adapted to perform any functional step or steps of a method of spectrometric analysis as described herein in any aspect or embodiment, as appropriate.

The functional step or steps may be implemented using hardware and/or software as desired.

Thus, according to an aspect there is provided a computer program comprising computer software code for performing a method of spectrometric analysis as described herein in any aspect or embodiment when the program is run on control circuitry of a spectrometric analysis system.

The computer program may be provided on a tangible computer readable medium (e.g., diskette, CD, DVD, ROM, RAM, flash memory, hard disk, etc.) and/or via a tangible medium (e.g., using optical or analogue communications lines) or intangible medium (e.g., using wireless techniques).

BRIEF DESCRIPTION OF THE DRAWINGS

Various embodiments will now be described, by way of example only, and with reference to the accompanying drawings in which:

FIG. 17 shows a multivariate space having three dimensions defined by intensity axes, wherein the multivariate space comprises plural reference points, each reference point corresponding to a set of three peak intensity values derived from a reference sample spectrum;

DETAILED DESCRIPTION

Overview

Various embodiments will now be described in more detail below which in general relate to obtaining one or more sample spectra for a sample, and then analyzing the one or more sample spectra so as to classify the sample.

In these embodiments, the sample is obtained from a target. The sample is then ionised so as to generate analyte ions. The resulting analyte ions (or fragment or product ions derived from the analyte ions) are then mass and/or ion mobility analyzed and the resulting mass and/or ion mobility spectrometric data is then subjected to pre-processing and then analysis in order to determine one or more properties of the target, for example in real time.

Figure 1:
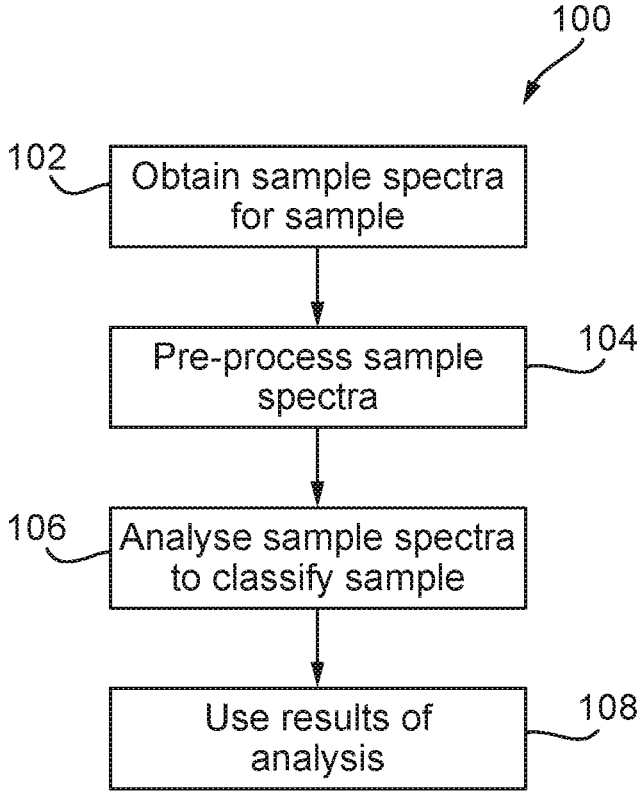
FIG. 1 shows an overview of a method of spectrometric analysis according to various embodiments.

FIG. 1 shows an overview of a method of spectrometric analysis 100 according to various embodiments.

The spectrometric analysis method 100 comprises a step 102 of obtaining one or more sample spectra for one or more samples. The spectrometric analysis method 100 then comprises a step 104 of pre-processing the one or more sample spectra. The spectrometric analysis method 100 then comprises a step 106 of analyzing the one or more sample spectra so as to classify the one or more samples. The spectrometric analysis method 100 then comprises a step 108 of using the results of the analysis. The steps in the spectrometric analysis method 100 will be discussed in more detail below.

Figure 2:
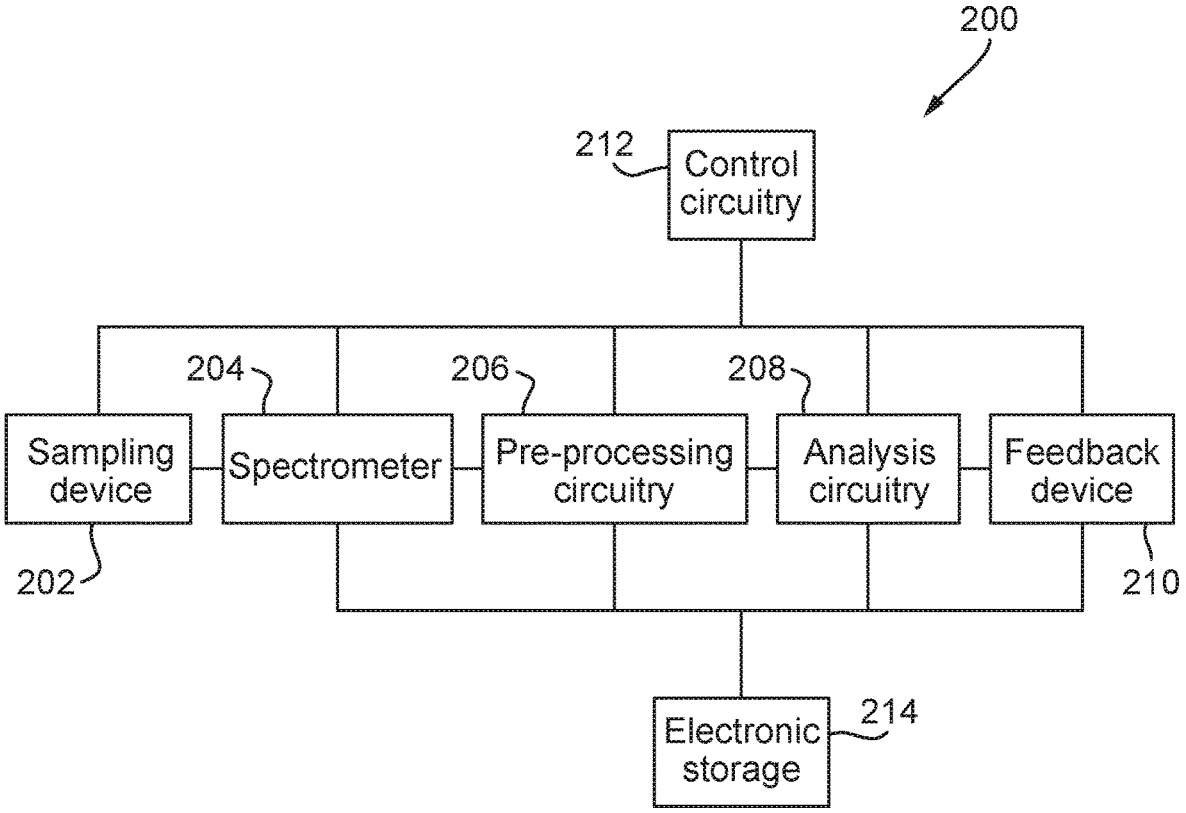
FIG. 2 shows an overview of a system arranged and adapted to perform spectrometric analysis according to various embodiments.

FIG. 2 shows an overview of a system 200 arranged and adapted to perform spectrometric analysis according to various embodiments.

The spectrometric analysis system 200 comprises a sampling device 202 and spectrometer 204 arranged and adapted to obtain one or more sample spectra for one or more samples.

The spectrometric analysis system 200 also comprises pre-processing circuitry 206 arranged and adapted to pre-process the one or more sample spectra obtained by the sampling device 202 and spectrometer 204. The pre-processing circuitry 206 may be directly connected or wirelessly connected to the spectrometer 204. A wireless connection can allow the one or more sample spectra to be obtained at a remote or distal disaster location, such as an earthquake or war zone, and then processed at a, for example more convenient or safer, local or proximal location. Furthermore, the spectrometer 204 may compress the data in the one or more sample spectra so that less data needs to be transmitted.

The spectrometric analysis system 200 also comprises analysis circuitry 208 arranged and adapted to analyze the one or more sample spectra so as to classify the one or more samples. The analysis circuitry 208 may be directly connected or wirelessly connected to the pre-processing circuitry 206. Again, a wireless connection can allow the one or more sample spectra to be obtained at a remote or distal disaster location and then processed at a, for example more convenient or safer, local or proximal location. Furthermore, the pre-processing circuitry 206 may reduce the amount of data in the one or more sample spectra so that less data needs to be transmitted.

The spectrometric analysis system 200 also comprises a feedback device 210 arranged and adapted to provide feedback based on the results of the analysis. The feedback device 210 may be directly connected or wirelessly connected to the analysis circuitry 208. A wireless connection can allow the one or more sample spectra to be pre-processed and analysed at a more convenient or safer local or proximal location and then feedback provided at a remote or distal disaster location. The feedback device may comprise a haptic, visual, and/or audible feedback device.

The system 200 also comprises control circuitry 212 arranged and adapted to control the operation of the elements of the system 200. The control circuitry 212 may be directly connected or wirelessly connected to each of the elements of the system 200. In some embodiments, one or more of the elements of the system 200 may also or instead have their own control circuitry.

The system 200 also comprises electronic storage 214 arranged and adapted to store the various data (e.g., sample spectra, background noise profiles, isotopic models, classification models and/or libraries, results, etc.) that are provided and/or used by the various elements of the system 200.

The various elements of the system 200 may be directly connected or wirelessly connected to one another to enable transfer of some or all of the data. Alternatively, some or all of the data may be transferred via a removable storage medium.

In some embodiments, the pre-processing circuitry 206, analysis circuitry 208, feedback device 210, control circuitry 212 and/or electronic storage 214 can form part of the spectrometer 204.

In some embodiments, the pre-processing circuitry 206 and analysis circuitry 208 can form part of the control circuitry 212.

The elements of the spectrometric analysis system 200 will be discussed in more detail below.

Obtaining Sample Spectra

As discussed above, the spectrometric analysis method 100 of FIG. 1 comprises a step 102 of obtaining the one or more sample spectra.

Also, as discussed above, the spectrometric analysis system 200 of FIG. 2 comprises a sampling device 202 and spectrometer 204 arranged and adapted to obtain one or more sample spectra for one or more samples.

The sample can be a bulk solid, liquid or gas sample or an aerosol, smoke or vapour sample.

The sample is obtained using the sampling device 202. The sample is then ionised either by the sampling device 202 or spectrometer 204. The resultant analyte ions are then analysed using the spectrometer 204 to produce one or more sample spectra.

By way of example, a number of different techniques for obtaining sample spectra will now be described.

Ambient Ionisation Ion Sources

According to various embodiments a sampling device is used to generate an aerosol, smoke or vapour sample from a target (e.g., in vivo tissue). The device may comprise an ambient ionisation ion source which is characterised by the ability to generate analyte aerosol, smoke or vapour samples from a native or unmodified target. For example, other types of ionisation ion sources such as Matrix Assisted Laser Desorption Ionisation ("MALDI") ion sources require a matrix or reagent to be added to the sample prior to ionisation.

Although embodiments can comprise doing so, it will be apparent that the requirement to add a matrix or a reagent to a sample may prevent the ability to perform in vivo analysis of tissue and also, more generally, may prevent the ability to provide a rapid simple analysis of target material.

In contrast, therefore, ambient ionisation techniques are particularly advantageous since firstly they do not require the addition of a matrix or a reagent (and hence are suitable for the analysis of in vivo tissue) and since secondly they enable a rapid simple analysis of target material to be performed.

A number of different ambient ionisation techniques are known and are intended to fall within the scope of the present invention. As a matter of historical record, Desorption Electrospray Ionisation ("DESI") was the first ambient ionisation technique to be developed and was disclosed in 2004. Since 2004, a number of other ambient ionisation techniques have been developed. These ambient ionisation techniques differ in their precise ionisation method but they share the same general capability of generating gas-phase ions directly from native (i.e., untreated or unmodified) samples. A particular advantage of various ambient ionisation techniques which may be used in embodiments is that they do not require any prior sample preparation. As a result, the various ambient ionisation techniques enable both in vivo tissue and ex vivo tissue samples to be analysed without necessitating the time and expense of adding a matrix or reagent to the tissue sample or other target material.

A list of ambient ionisation techniques which may be used in embodiments are given in the following table:

| Acronym | Ionisation technique |
|---|---|
| DESI | Desorption electrospray ionization |
| DeSSI | Desorption sonic spray ionization |
| DAPPI | Desorption atmospheric pressure photoionization |
| EASI | Easy ambient sonic-spray ionization |
| JeDI | Jet desorption electrospray ionization |
| TM-DESI | Transmission mode desorption electrospray ionization |
| LMJ-SSP | Liquid microjunction-surface sampling probe |
| DICE | Desorption ionization by charge exchange |
| Nano-DESI | Nanospray desorption electrospray ionization |
| EADESI | Electrode-assisted desorption electrospray ionization |
| APTDCI | Atmospheric pressure thermal desorption chemical ionization |
| V-EASI | Venturi easy ambient sonic-spray ionization |
| AFAI | Air flow-assisted ionization |
| LESA | Liquid extraction surface analysis |
| PTC-ESI | Pipette tip column electrospray ionization |
| AFADESI | Air flow-assisted desorption electrospray ionization |
| DEFFI | Desorption electro-flow focusing ionization |
| ESTASI | Electrostatic spray ionization |
| PASIT | Plasma-based ambient sampling ionization transmission |
| DAPCI | Desorption atmospheric pressure chemical ionization |
| DART | Direct analysis in real time |
| ASAP | Atmospheric pressure solid analysis probe |
| APTDI | Atmospheric pressure thermal desorption ionization |
| PADI | Plasma assisted desorption ionization |
| DBDI | Dielectric barrier discharge ionization |

-continued

| Acronym | Ionisation technique |
|---|---|
| FAPA | Flowing atmospheric pressure afterglow |
| HAPGDI | Helium atmospheric pressure glow discharge ionization |
| APGDDI | Atmospheric pressure glow discharge desorption ionization |
| LTP | Low temperature plasma |
| LS-APGD | Liquid sampling-atmospheric pressure glow discharge |
| MIPDI | Microwave induced plasma desorption ionization |
| MFGDP | Microfabricated glow discharge plasma |
| RoPPI | Robotic plasma probe ionization |
| PLASI | Plasma spray ionization |
| MALDESI | Matrix assisted laser desorption electrospray ionization |
| ELDI | Electrospray laser desorption ionization |
| LDTD | Laser diode thermal desorption |
| LAESI | Laser ablation electrospray ionization |
| CALDI | Charge assisted laser desorption ionization |
| LA-FAPA | Laser ablation flowing atmospheric pressure afterglow |
| LADESI | Laser assisted desorption electrospray ionization |
| LDESI | Laser desorption electrospray ionization |
| LEMS | Laser electrospray mass spectrometry |
| LSI | Laser spray ionization |
| IR-LAMICI | Infrared laser ablation metastable induced chemical ionization |
| LDSPI | Laser desorption spray post-ionization |
| PAMLDI | Plasma assisted multiwavelength laser desorption ionization |
| HALDI | High voltage-assisted laser desorption ionization |
| PALDI | Plasma assisted laser desorption ionization |
| ESSI | Extractive electrospray ionization |
| PESI | Probe electrospray ionization |
| ND-ESSI | Neutral desorption extractive electrospray ionization |
| PS | Paper spray |
| DIP-APCI | Direct inlet probe-atmospheric pressure chemical ionization |
| TS | Touch spray |
| Wooden-tip | Wooden-tip electrospray |
| CBS-SPME | Coated blade spray solid phase microextraction |
| TSI | Tissue spray ionization |
| RADIO | Radiofrequency acoustic desorption ionization |
| LIAD-ESI | Laser induced acoustic desorption electrospray ionization |
| SAWN | Surface acoustic wave nebulization |
| UASI | Ultrasonication-assisted spray ionization |
| SPA-nanoESI | Solid probe assisted nanoelectrospray ionization |
| PAUSI | Paper assisted ultrasonic spray ionization |
| DPESI | Direct probe electrospray ionization |
| ESA-Py | Electrospray assisted pyrolysis ionization |
| APPIS | Ambient pressure pyroelectric ion source |
| RASTIR | Remote analyte sampling transport and ionization relay |
| SACI | Surface activated chemical ionization |
| DEMI | Desorption electrospray metastable-induced ionization |
| REIMS | Rapid evaporative ionization mass spectrometry |
| SPAM | Single particle aerosol mass spectrometry |
| TDAMS | Thermal desorption-based ambient mass spectrometry |
| MAII | Matrix assisted inlet ionization |
| SAII | Solvent assisted inlet ionization |
| SwiFERR | Switched ferroelectric plasma ionizer |
| LPTD | Leidenfrost phenomenon assisted thermal desorption |

According to an embodiment the ambient ionisation ion source may comprise a rapid evaporative ionisation mass spectrometry ("REIMS") ion source wherein a RF voltage is applied to one or more electrodes in order to generate an aerosol or plume of surgical smoke by Joule heating.

However, it will be appreciated that other ambient ion sources including those referred to above may also be utilised. For example, according to another embodiment the ambient ionisation ion source may comprise a laser ionisation ion source. According to an embodiment the laser ionisation ion source may comprise a mid-IR laser ablation ion source. For example, there are several lasers which emit radiation close to or at 2.94 μm which corresponds with the peak in the water absorption spectrum. According to various embodiments the ambient ionisation ion source may comprise a laser ablation ion source having a wavelength close to 2.94 μm on the basis of the high absorption coefficient of water at 2.94 μm. According to an embodiment the laser ablation ion source may comprise a Er:YAG laser which emits radiation at 2.94 μm.

Other embodiments are contemplated wherein a mid-infrared optical parametric oscillator ("OPO") may be used to produce a laser ablation ion source having a longer wavelength than 2.94 μm. For example, an Er:YAG pumped ZGP-OPO may be used to produce laser radiation having a wavelength of e.g., 6.1 μm, 6.45 μm or 6.73 μm. In some situations it may be advantageous to use a laser ablation ion source having a shorter or longer wavelength than 2.94 μm since only the surface layers will be ablated and less thermal damage may result. According to an embodiment a $Co:MgF_2$ laser may be used as a laser ablation ion source wherein the laser may be tuned from 1.75-2.5 μm. According to another embodiment an optical parametric oscillator ("OPO") system pumped by a Nd:YAG laser may be used to produce a laser ablation ion source having a wavelength between 2.9-3.1 μm. According to another embodiment a CO2 laser having a wavelength of 10.6 μm may be used to generate the aerosol, smoke or vapour sample.

According to other embodiments the ambient ionisation ion source may comprise an ultrasonic ablation ion source which generates a liquid sample which is then aspirated as an aerosol. The ultrasonic ablation ion source may comprise a focused or unfocussed source.

According to an embodiment the sampling device for obtaining samples may comprise an electrosurgical tool which utilises a continuous RF waveform.

According to other embodiments a radiofrequency tissue dissection system may be used which is arranged to supply pulsed plasma RF energy to a tool. The tool may comprise, for example, a PlasmaBlade®. Pulsed plasma RF tools operate at lower temperatures than conventional electrosurgical tools (e.g., 40-170° C. c.f. 200-350° C.) thereby reducing thermal injury depth. Pulsed waveforms and duty cycles may be used for both cut and coagulation modes of operation by inducing electrical plasma along the cutting edge(s) of a thin insulated electrode.

Rapid Evaporative Ionisation Mass Spectrometry ("REIMS")

Figure 3:
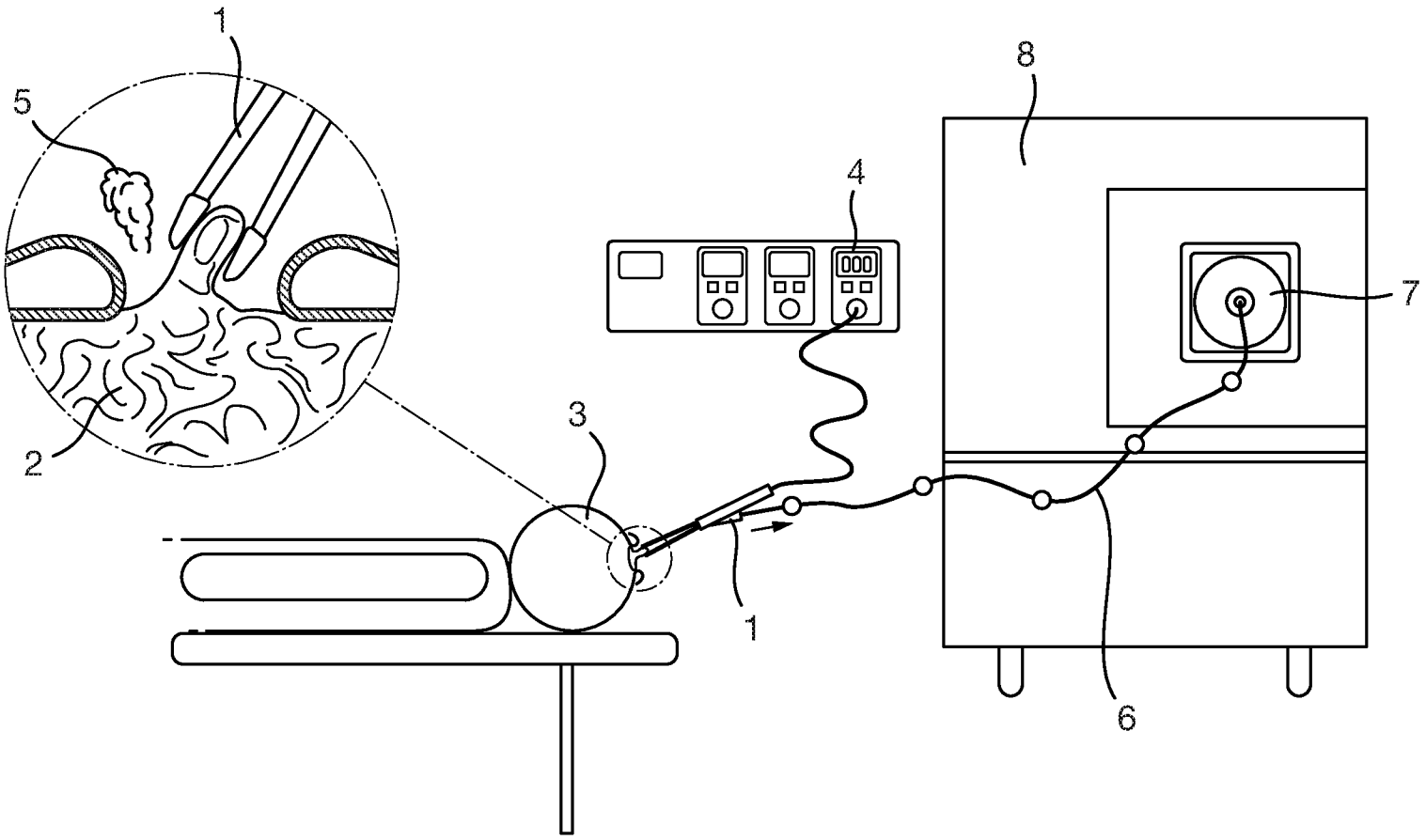
FIG. 3 shows a method of rapid evaporative ionisation mass spectrometry ("REIMS") wherein an RF voltage is applied to bipolar forceps resulting in the generation of an aerosol or surgical plume which is then captured through an irrigation port of the bipolar forceps and is then transferred to a mass spectrometer for mass and/or ion mobility analysis.

FIG. 3 illustrates a method of rapid evaporative ionisation mass spectrometry ("REIMS") wherein bipolar forceps 1 may be brought into contact with in vivo tissue 2 of a patient 3. In the example shown in FIG. 3, the bipolar forceps 1 may be brought into contact with brain tissue 2 of a patient 3 during the course of a surgical operation on the patient's brain. An RF voltage from an RF voltage generator 4 may be applied to the bipolar forceps 1 which causes localised Joule or diathermy heating of the tissue 2. As a result, an aerosol or surgical plume 5 is generated. The aerosol or surgical plume 5 may then be captured or otherwise aspirated through an irrigation port of the bipolar forceps 1. The irrigation port of the bipolar forceps 1 is therefore reutilised as an aspiration port. The aerosol or surgical plume 5 may then be passed from the irrigation (aspiration) port of the bipolar forceps 1 to tubing 6 (e.g., ⅛" or 3.2 mm diameter Teflon® tubing). The tubing 6 is arranged to transfer the aerosol or surgical plume 5 to an atmospheric pressure interface 7 of a mass and/or ion mobility spectrometer 8.

According to various embodiments a matrix comprising an organic solvent such as isopropanol may be added to the aerosol or surgical plume 5 at the atmospheric pressure interface 7. The mixture of aerosol 3 and organic solvent may then be arranged to impact upon a collision surface within a vacuum chamber of the mass and/or ion mobility spectrometer 8. According to one embodiment the collision surface may be heated. The aerosol is caused to ionise upon impacting the collision surface resulting in the generation of analyte ions. The ionisation efficiency of generating the analyte ions may be improved by the addition of the organic solvent. However, the addition of an organic solvent is not essential.

Other Ion Sources

Although ambient ion sources have been described above in detail, it will be appreciated that other ion source can be used in embodiments.

For example, the ion source may comprise one or more of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; (xxviii) a Laser Ablation Electrospray Ionisation ("LAESI") ion source; and (xxix) Surface Assisted Laser Desorption Ionisation ("SALDI").

Analysis of Analyte Ions

Analyte ions which are generated are passed through subsequent stages of the mass and/or ion mobility spectrometer and are subjected to mass and/or ion mobility analysis in a mass and/or ion mobility analyser.

Various embodiments are contemplated wherein analyte ions are subjected either to: (i) mass analysis by a mass analyser such as a quadrupole mass analyser or a Time of Flight mass analyser; (ii) ion mobility analysis (IMS) and/or differential ion mobility analysis (DMA) and/or Field Asymmetric Ion Mobility Spectrometry (FAIMS) analysis; and/or (iii) a combination of firstly (or vice versa) ion mobility analysis (IMS) and/or differential ion mobility analysis (DMA) and/or Field Asymmetric Ion Mobility Spectrometry (FAIMS) analysis followed by secondly (or vice versa) mass analysis by a mass analyser such as a quadrupole mass analyser or a Time of Flight mass analyser. Various embodiments also relate to an ion mobility spectrometer and/or mass analyser and a method of ion mobility spectrometry and/or method of mass analysis. Ion mobility analysis may be performed prior to mass to charge ratio analysis or vice versa.

Various references are made in the present application to mass analysis, mass analysers, mass analysing, mass spectrometric data, mass spectrometers and other related terms referring to apparatus and methods for determining the mass or mass to charge of analyte ions. It should be understood that it is equally contemplated that the present invention may extend to ion mobility analysis, ion mobility analysers, ion mobility analysing, ion mobility data, ion mobility spectrometers, ion mobility separators and other related terms referring to apparatus and methods for determining the ion mobility, differential ion mobility, collision cross section or interaction cross section of analyte ions. Furthermore, it should also be understood that embodiments are contemplated wherein analyte ions may be subjected to a combination of both ion mobility analysis and mass analysis, i.e., that both (a) the ion mobility, differential ion mobility, collision cross section or interaction cross section of analyte ions together with (b) the mass to charge of analyte ions is determined. Accordingly, hybrid ion mobility-mass spectrometry (IMS-MS) and mass spectrometry-ion mobility (MS-IMS) embodiments are contemplated wherein both the ion mobility and mass to charge ratio of analyte ions generated are determined. Ion mobility analysis may be performed prior to mass to charge ratio analysis or vice versa. Furthermore, it should be understood that embodiments are contemplated wherein references to mass spectrometric data and databases comprising mass spectrometric data should also be understood as encompassing ion mobility data and differential ion mobility data etc. and databases comprising ion mobility data and differential ion mobility data etc. (either in isolation or in combination with mass spectrometric data).

The mass and/or ion mobility analyser may, for example, comprise a quadrupole mass analyser or a Time of Flight mass analyser. The output of the mass analyser comprises plural sample spectra for the sample with each spectrum being represented by a set of time-intensity pairs. Each set of time-intensity pairs is obtained by binning ion detections into plural bins. In this embodiment, each bin has a mass or mass to charge ratio equivalent width of 0.1 Da or Th.

Pre-Processing Sample Spectra

As discussed above, the spectrometric analysis method 100 of FIG. 1 comprises a step 104 of pre-processing the one or more sample spectra.

Also, as discussed above, the spectrometric analysis system 200 of FIG. 2 comprises pre-processing circuitry 206 arranged and adapted to pre-process the one or more sample spectra.

By way of example, a number of different pre-processing steps will now be described. In addition to a step of deisotoping, any one or more of the steps may be performed so as to pre-process one or more sample spectra. The one or more steps may also be performed in any desired and suitable order.

Figure 4:
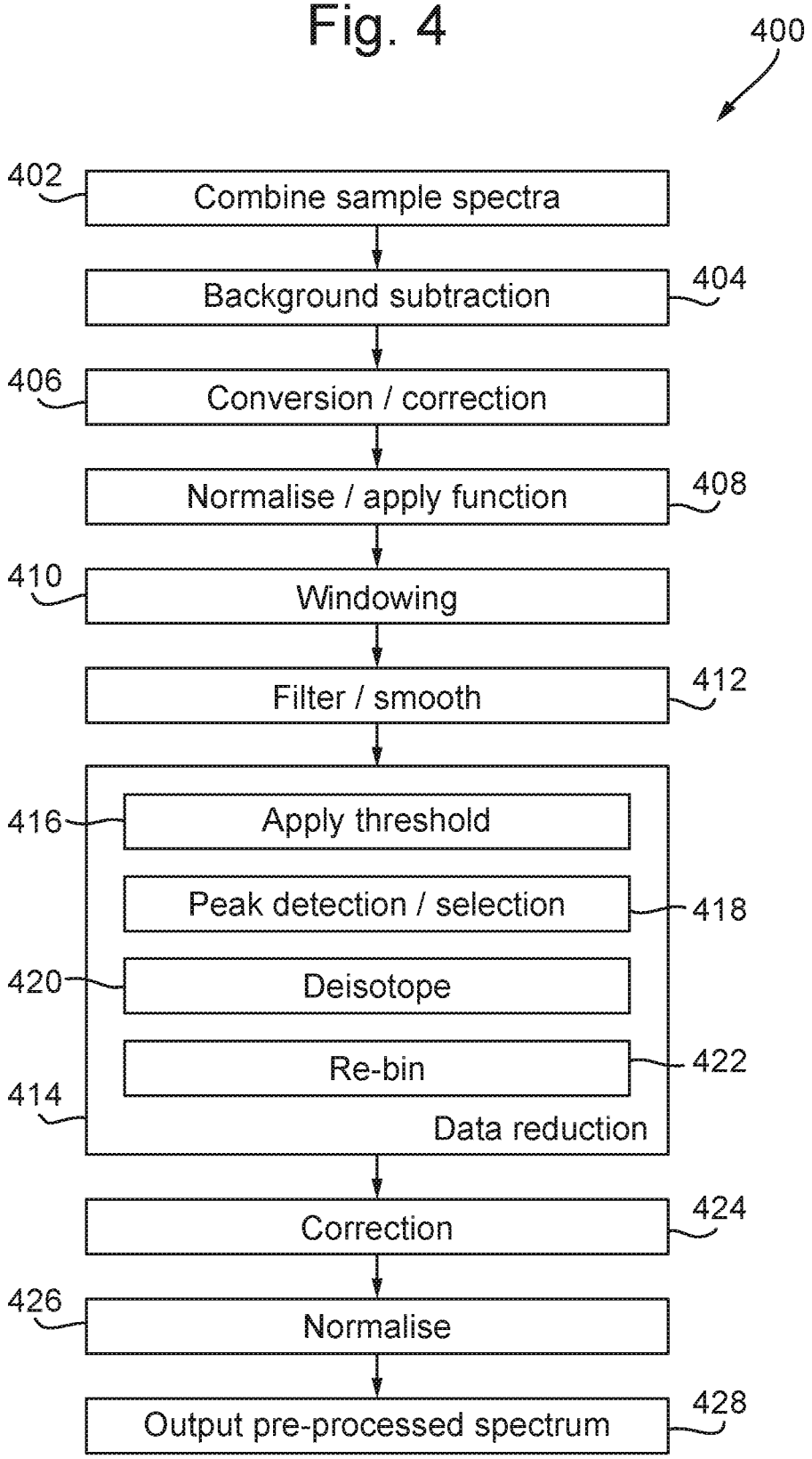
FIG. 4 shows a method of pre-processing sample spectra according to various embodiments.

FIG. 4 shows a method 400 of pre-processing plural sample spectra according to various embodiments.

The pre-processing method 400 comprises a step 402 of combining plural sample spectra. In some embodiments, ion detections or intensity values in corresponding bins of plural spectra are summed to produce a combined sample spectrum for a sample. In other embodiments, the plural spectra may have been obtained using different degrees of ion attenuation, and a suitably weighted summation of ion detections or intensity values in corresponding bins of the plural spectra can be used to produce a combined sample spectrum for the sample. In other embodiments, plural sample spectra may be concatenated, thereby providing a larger dataset for pre-processing and/or analysis. The pre-processing method 400 then comprises a step 404 of background subtraction. The background subtraction process comprises obtaining background noise profiles for the sample spectrum and subtracting the background noise profiles from the sample spectrum to produce one or more background-subtracted sample spectra. A background subtraction process is described in more detail below.

The pre-processing method 400 then comprises a step 406 of converting and correcting ion arrival times for the sample spectrum to suitable masses and/or mass to charge ratios and/or ion mobilities. In some embodiments, the correction process comprises offsetting and scaling the sample spectrum based on known masses and/or ion mobilities corresponding to known spectral peaks for lockmass and/or lockmobility ions that were provided together with the analyte ions.

The pre-processing method 400 then comprises a step 408 of normalizing the intensity values of the sample spectrum. In some embodiments, this normalization comprises offsetting and scaling the intensity values base on statistical property for the sample spectrum, such as total ion current (TIC), a base peak intensity, an average or quantile intensity value or an average or quantile of some function of intensity. In some embodiments, step 408 also includes applying a function to the intensity values in the sample spectrum. The function can be a variance stabilizing function that removes a correlation between intensity variance and intensity in the sample spectrum. The function can also enhance particular masses and/or mass to charge ratios and/or ion mobilities in the sample spectrum that may be useful for classification.

The pre-processing method 400 then comprises a step 410 of windowing in which parts of the sample spectrum are selected for further pre-processing. In some embodiments, parts of the sample spectrum corresponding to masses or mass to charge ratios in the range of 600-900 Da or Th are retained since this can provide particularly useful sample spectra for classifying tissues. In other embodiments, parts of the sample spectrum corresponding to masses or mass to charge ratios in the range of 600-2000 Da or Th are retained since this can provide particularly useful sample spectra for classifying bacteria.

The pre-processing method 400 then comprises a step 412 of filtering and/or smoothing process using a Savitzky-Golay process. This process removes unwanted higher frequency fluctuations in the sample spectrum.

The pre-processing method 400 then comprises a step 414 of a data reduction to reduce the number of intensity values to be subjected to analysis. Various forms of data reduction are contemplated. In addition to a step of deisotoping, any one or more of the following data reduction steps may be performed. The one or more data reduction steps may also be performed in any desired and suitable order.

The data reduction process can comprise a step 416 of retaining parts of the sample spectrum that are above an intensity threshold or intensity threshold function. The intensity threshold or intensity threshold function may be based on statistical property for the sample spectrum, such as total ion current (TIC), a base peak intensity, an average or quantile intensity value or an average or quantile of some function of intensity.

The data reduction process can comprise a step 418 of peak detection and selection. The peak detection and selection process can comprise finding the gradient of the sample spectra and using a gradient threshold in order to identify rising and falling edges of peaks.

The data reduction process comprises a step 420 of deisotoping in which isotopic peaks are identified and reduced or removed from the sample spectrum and/or in which isotopic deconvolution is performed. A deisotoping process is described in more detail below. The step 420 of deisotoping may be performed after a step 418 of peak detection and selection, i.e., using the detected and selected peaks. This can reduce the amount of processing required during the step 420 of deisotoping.

The data reduction process can comprise a step 422 of re-binning in which ion intensity values from narrower bins are accumulated in a set of wider bins. In this embodiment, each bin has a mass or mass to charge ratio equivalent width of 1 Da or Th.

The pre-processing method 400 then comprises a further step 424 of correction that comprises offsetting and scaling the selected peaks of the sample spectrum based on known masses and/or ion mobilities corresponding to known spectral peaks for lockmass and/or lockmobility ions that were provided together with the analyte ions.

The pre-processing method 400 then comprises a further step 426 of normalizing the intensity values for the selected peaks of the one or more sample spectra. In some embodiments, this normalization comprises offsetting and scaling the intensity values based on statistical property for the selected peaks of the sample spectrum, such as total ion current (TIC), a base peak intensity, an average or quantile intensity value or an average or quantile of some function of intensity. This normalization can prepare the intensity values of the selected peaks of the sample spectrum for analysis. For example, the intensity values can be normalized so as to have a particular average (e.g., mean or median) value, such as 0 or 1, so as to have a particular minimum value, such as −1, and so as to have a particular maximum value, such as 1.

The pre-processing method 400 then comprises a step 428 of outputting the pre-processed spectrum for analysis.

In some embodiments, plural pre-processed spectra are produced using the pre-processing method 400 of FIG. 4. The plural pre-processed spectra can be combined or concatenated.

Background Subtraction

As discussed above, the pre-processing method 400 of FIG. 4 comprises a step 404 of background subtraction. This step can comprise obtaining a background noise profile for a sample spectrum.

The background noise profile for a sample spectrum may be derived from the sample spectrum itself. However, it can be difficult to derive adequate background noise profiles for sample spectra themselves, particularly where relatively little sample or poor quality sample is available such that the sample spectrum for the sample comprises relatively weak peaks and/or comprises poorly defined noise.

To address this issue, background noise profiles can instead be derived from reference sample spectra and stored in electronic storage for later use. The reference sample spectra for each class of sample will often have a characteristic (e.g., periodic) background noise profile due to particular ions that tend to be generated when generating ions for the samples of that class. A background noise profile can therefore be derived for each class of sample. A well-defined background noise profile can accordingly be derived in advance for each class using reference sample spectra that are obtained for a relatively higher quality or larger amount of sample. The background noise profiles can then be retrieved for use in a background subtraction process prior to classifying a sample.

By way of example, methods of deriving and using background noise profiles will now be described in more detail.

Figure 5:
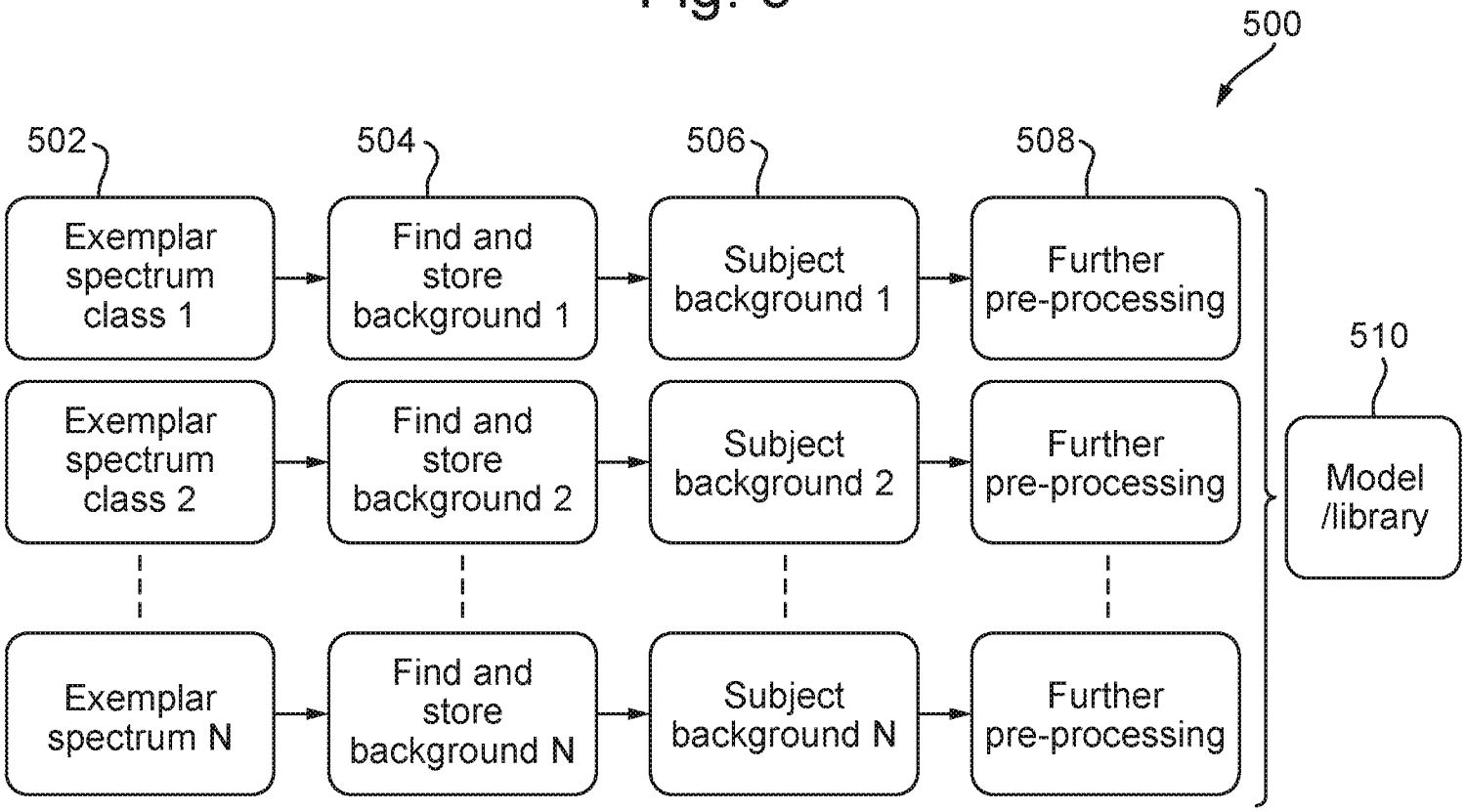
FIG. 5 shows a method of generating background noise profiles from plural reference sample spectra and then using background-subtracted reference sample spectra to develop a classification model and/or library.

FIG. 5 shows a method 500 of generating background noise profiles from plural reference sample spectra and then using background-subtracted sample spectra to develop a classification model and/or library.

The method 500 comprises a step 502 of inputting plural reference sample spectra. The method then comprises a step 504 of deriving and storing a background noise profile for each of the plural reference sample spectra. The method then comprises a step 506 of subtracting each background noise profile from its corresponding reference sample spectrum. The method then comprises a step 508 of performing further pre-processing, for example as described above with reference to FIG. 4, on the background-subtracted sample spectra. The method then comprises a step 510 of developing a classification model and/or library using the background-subtracted sample spectra.

A method of generating a background noise profile from a sample spectrum will now be described in more detail with reference to an example.

Figure 6:
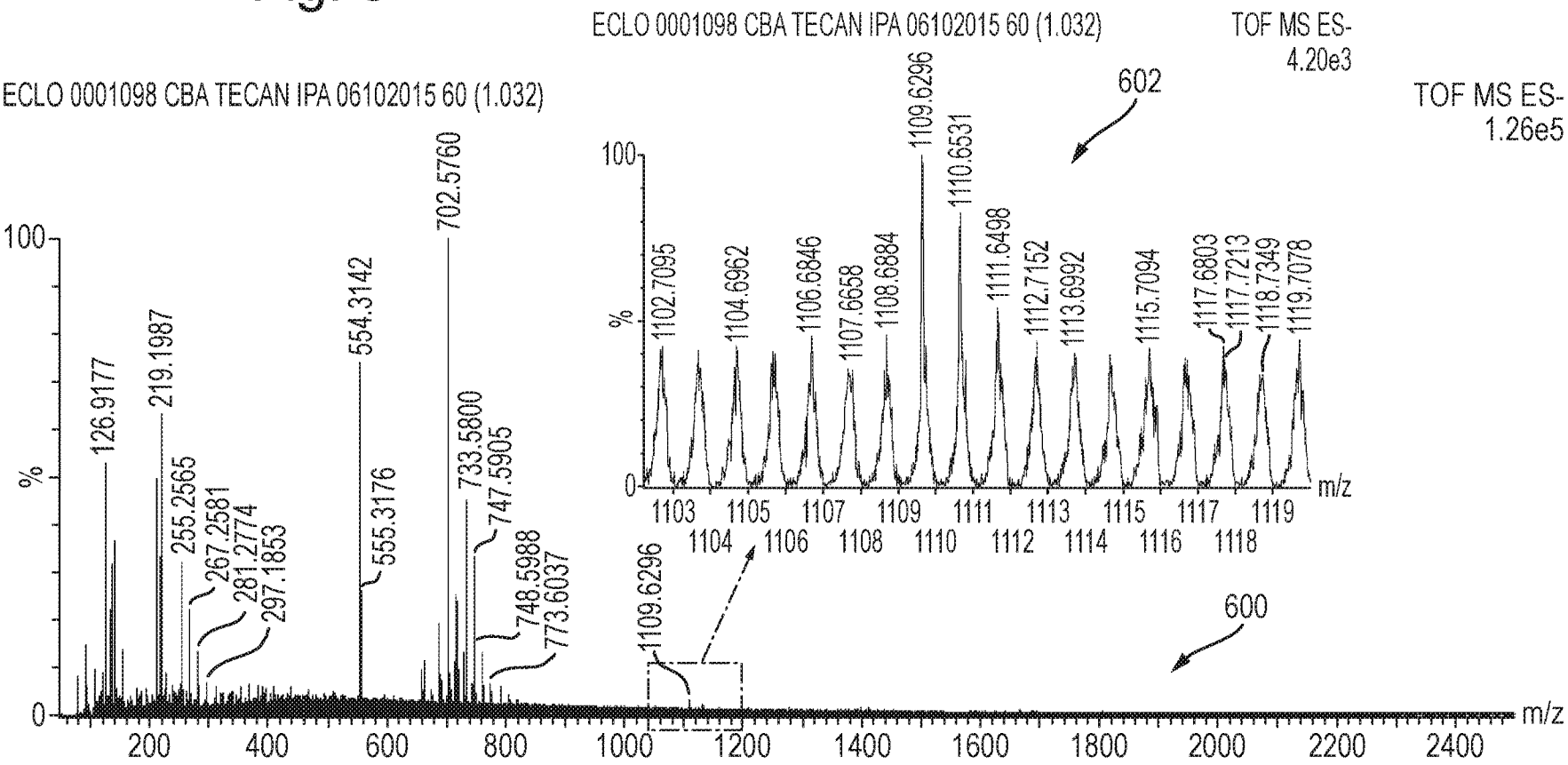
FIG. 6 shows a sample mass spectrum for which a background noise profile is to be derived.

FIG. 6 shows a sample spectrum 600 for which a background noise profile is to be derived. The sample spectrum 600 is divided into plural overlapping windows that are each processed separately. Alternatively, a translating window may be used.

Figure 7:
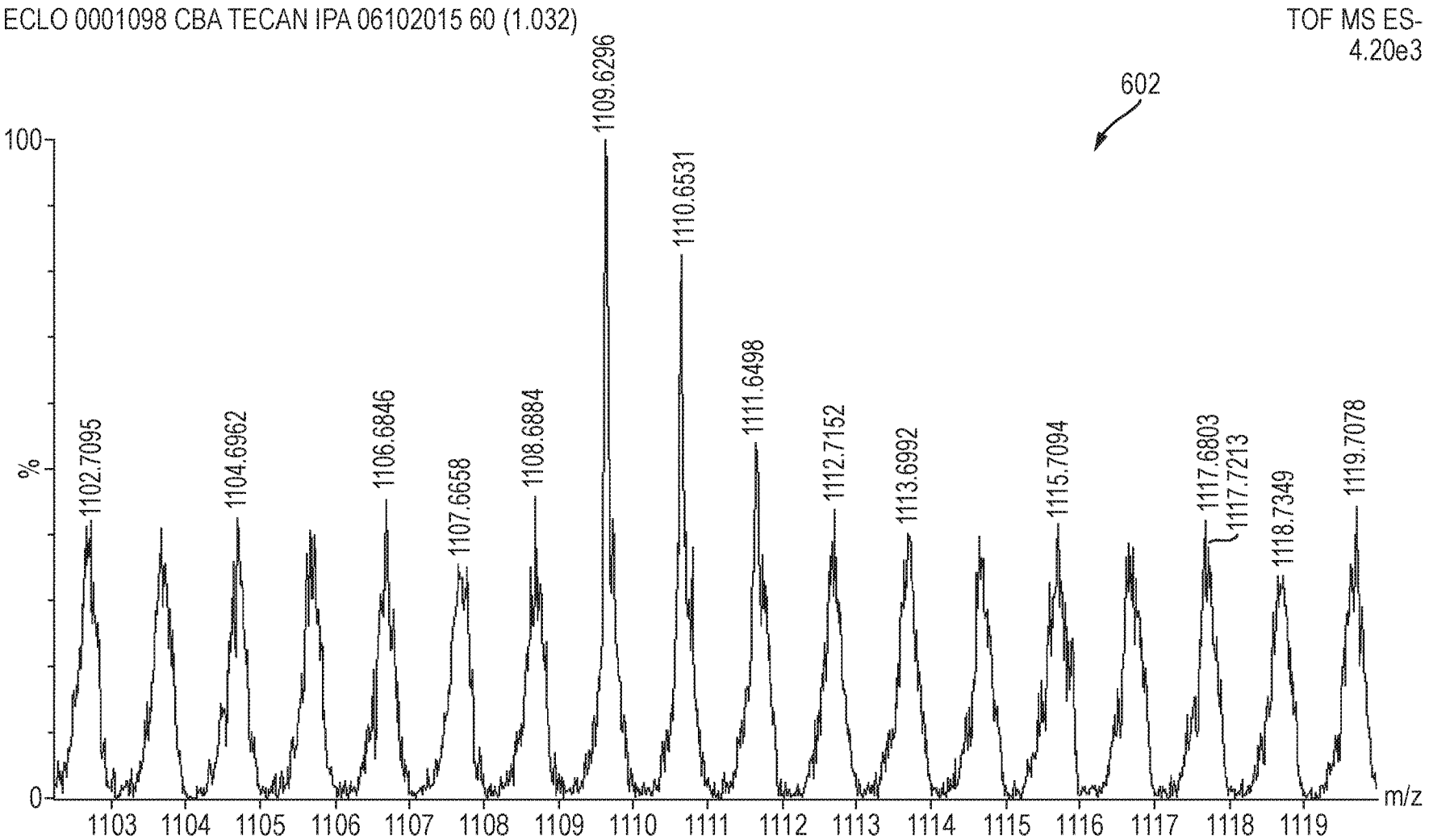
FIG. 7 shows a window of the sample mass spectrum of FIG. 6 that is used to derive a background noise profile.

FIGS. 6 and 7 show a window 602 of the sample spectrum 600 in more detail. In this embodiment, the window is 18 Da or Th wide.

Figure 8:
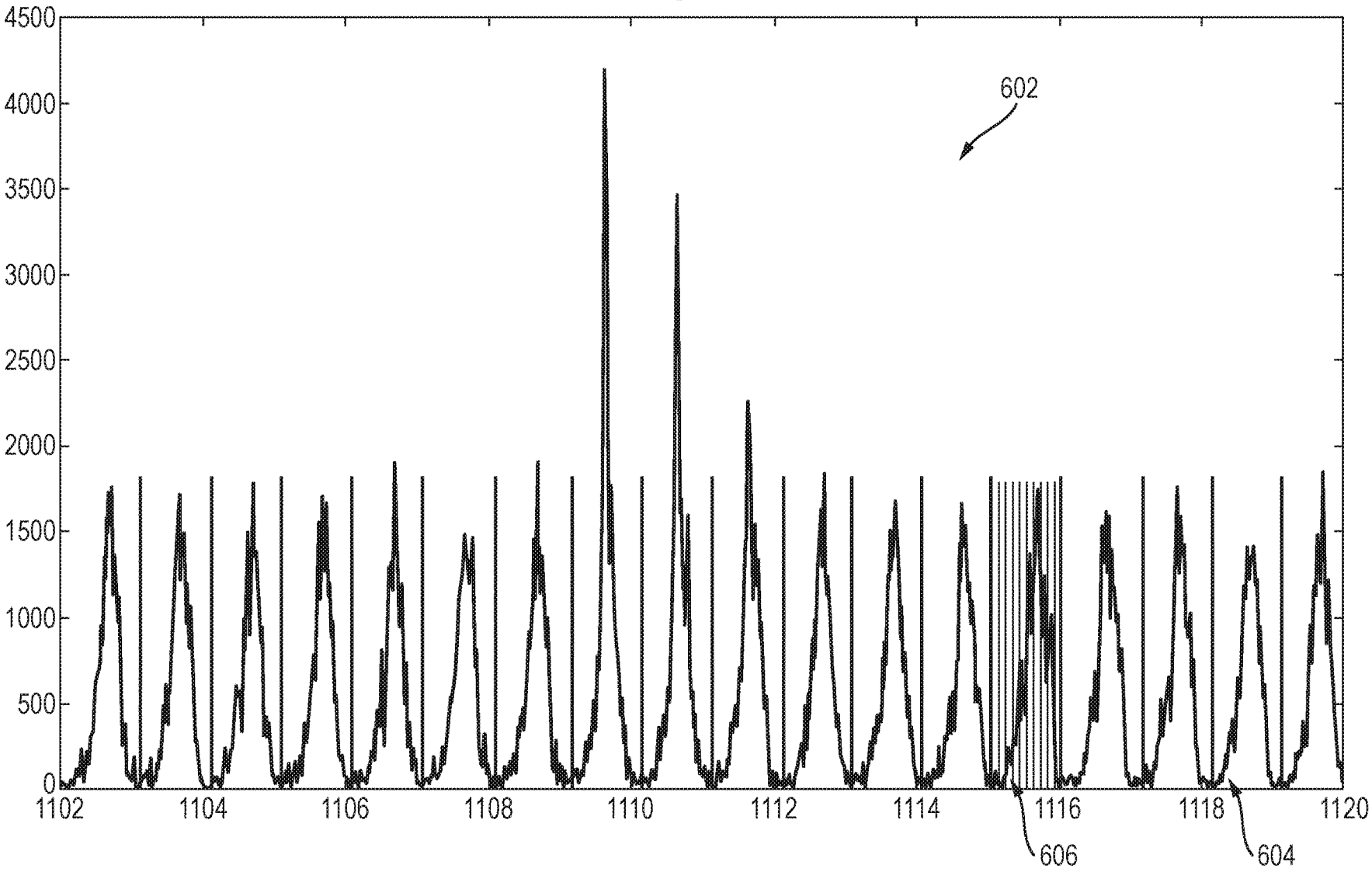
FIG. 8 shows segments and sub-segments of the window of the sample mass spectrum of FIG. 7 that are used to derive a background noise profile.

As is shown in FIG. 8, in order to derive the background noise profile, the window 602 is divided into plural segments 604. In this embodiment, the window 602 is divided into 18 segments, which each segment being 1 Da or Th wide.

Each segment 604 is further divided into plural sub-segments 606. In this embodiment, each segment 604 is divided into 10 sub-segments, which each sub-segment being 0.1 Da or Th wide.

The background noise profile value for a given sub-segment 606 is then a combination of the intensity values for the sub-segment 606 and the other sub-segments of the segments 604 in the window 602 that correspond to the sub-segment 606. In this embodiment, the combination is a 45% quantile of the intensity values for the corresponding sub-segments.

Figure 9:
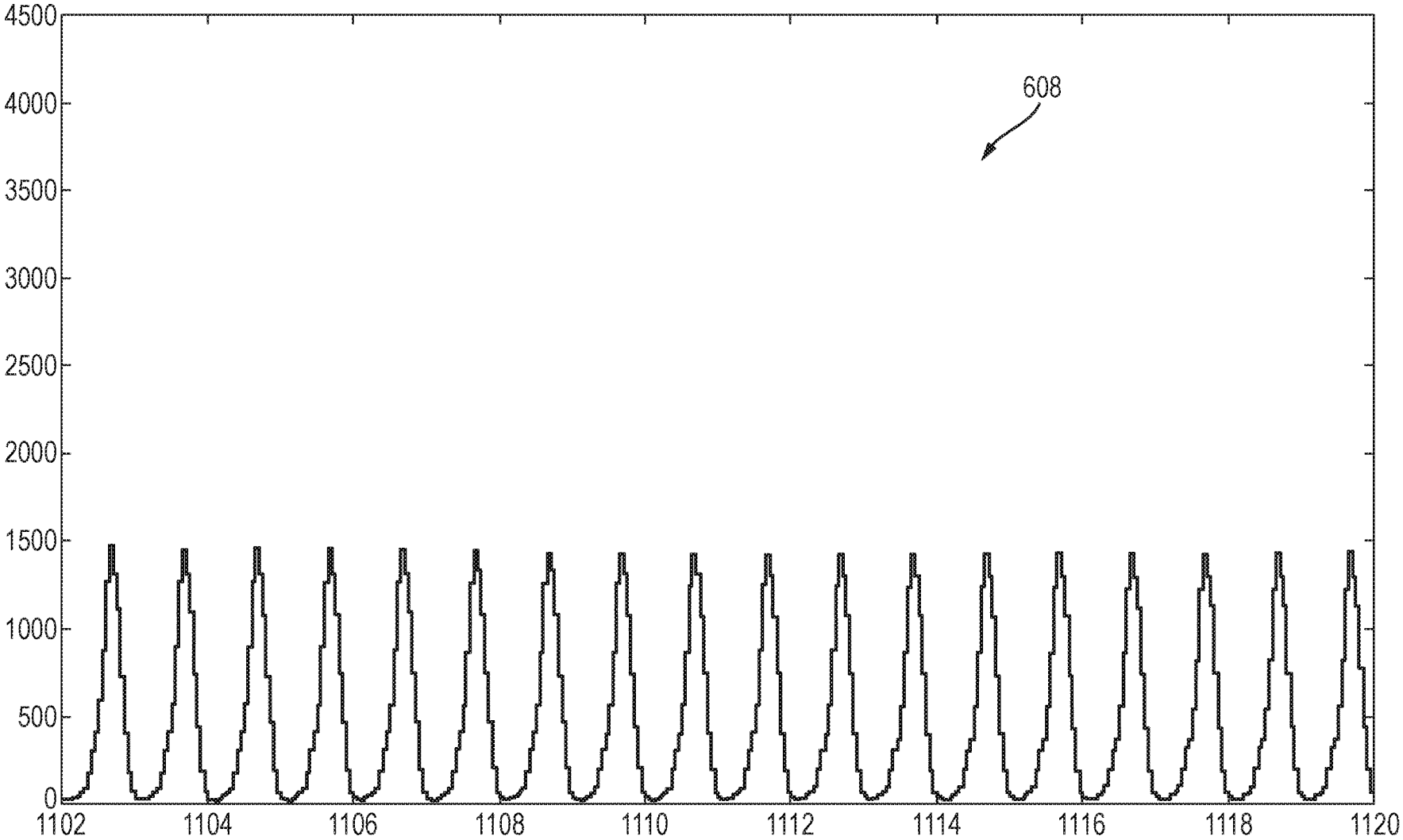
FIG. 9 shows a background noise profile derived for the window of the sample mass spectrum of FIG. 7.

FIG. 9 shows the resultant background noise profile derived for the window 602 of FIGS. 6 and 7. As is shown in FIG. 9, the window 602 comprises a periodic background noise profile having a period of 1 Da or Th.

Figure 10:
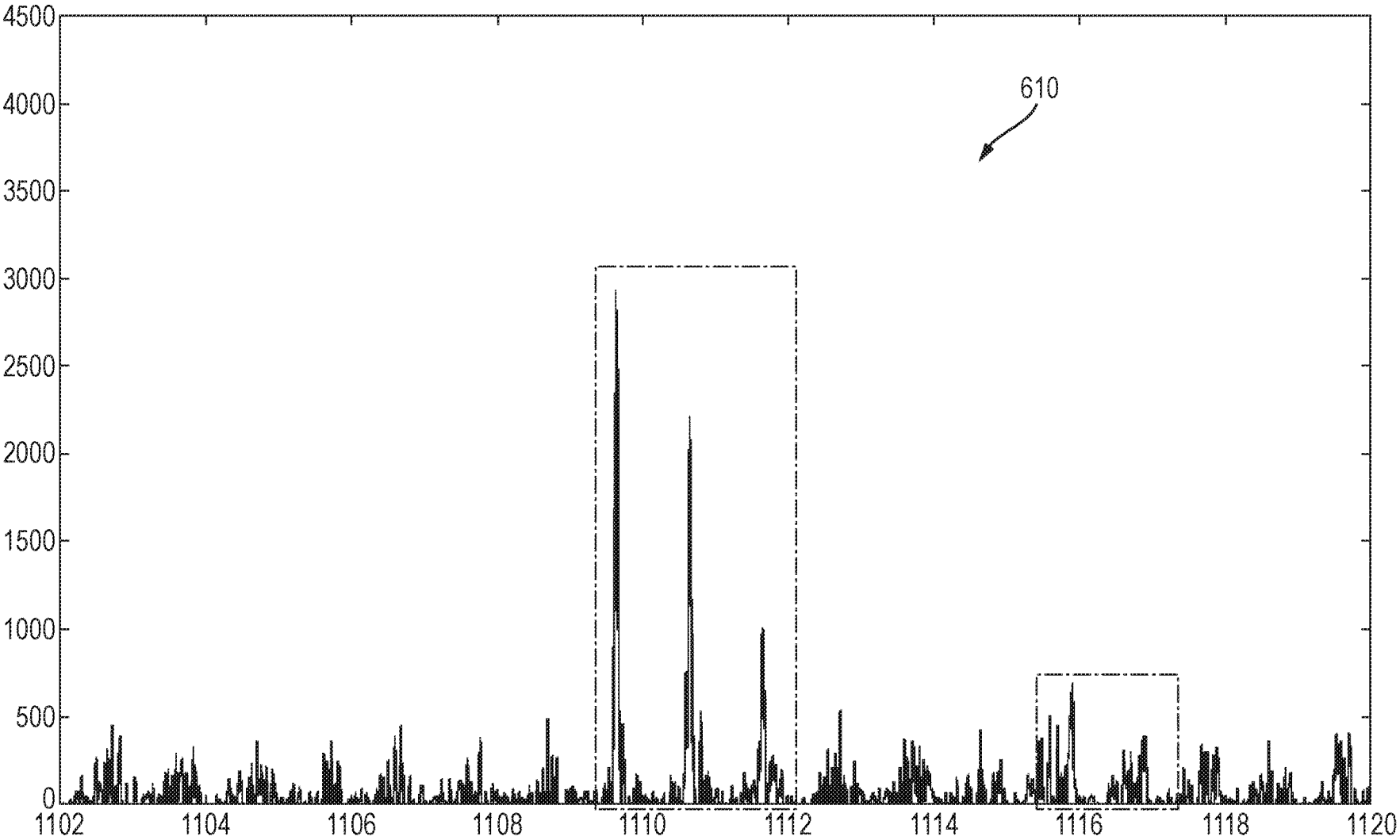
FIG. 10 shows the window of the sample mass spectrum of FIG. 7 with the background noise profile of FIG. 9 subtracted.

FIG. 10 shows the window 602 of FIG. 7 with the background noise profile of FIG. 9 subtracted. Comparing FIG. 10 to FIG. 7, it is clear that the background-subtracted spectrum of FIG. 10 has improved mass accuracy and additional identifiable peaks. Subsequent processing (e.g., peak detection, deisotoping, classification, etc.) can provide improved results following the background subtraction process.

In other embodiments, the background noise profile may be derived by fitting a piecewise polynomial to the spectrum. The piecewise polynomial describing the background noise profile may be fitted such that a selected proportion of the spectrum lies below the polynomial in each segment of the piecewise polynomial.

In other embodiments, the background noise profile may be derived by filtering in the frequency domain, for example using (e.g., fast) Fourier transforms. The filtering can remove components of the spectrum that vary relatively slowly or that are periodic.

A method of using background noise profiles from reference sample spectra will now be described in more detail with reference to an example.

Figure 11:
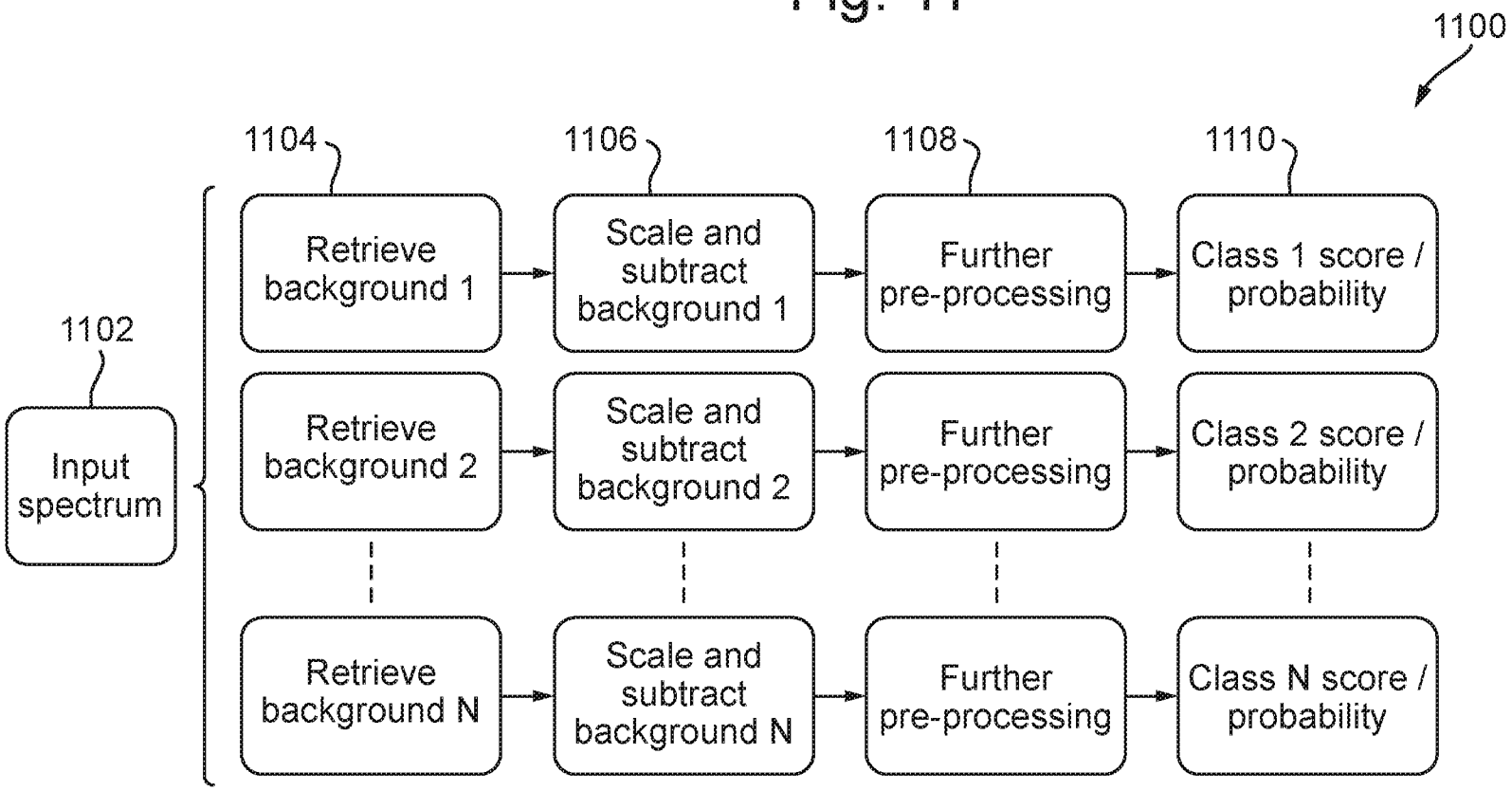
FIG. 11 shows a method of background subtraction and classification for a sample spectrum according to various embodiments.

FIG. 11 shows a method 1100 of background subtraction and classification for a sample spectrum.

The method 110 comprises a step 1102 of inputting a sample spectrum. The method then comprises a step 1104 of retrieving plural background noise profiles for respective classes of sample from electronic storage. The method then comprises a step 1106 of scaling and then subtracting each background noise profile from the sample spectrum to produce plural background subtracted spectra. The method then comprises a step 1108 of performing further pre-processing, for example as described above with reference to FIG. 4, on the background-subtracted sample spectra. The method then comprises a step 1110 of using a classification model and/or library so as to provide a classification score or probability for each class of sample using the background-subtracted sample spectra corresponding to that class.

The sample spectrum may then be classified as belonging to the class having the highest classification score or probability.

Deisotoping

As discussed above, the pre-processing method 400 of FIG. 4 comprises a step 420 of deisotoping. By way of example, a method of deisotoping will now be described in more detail.

Figure 12A:
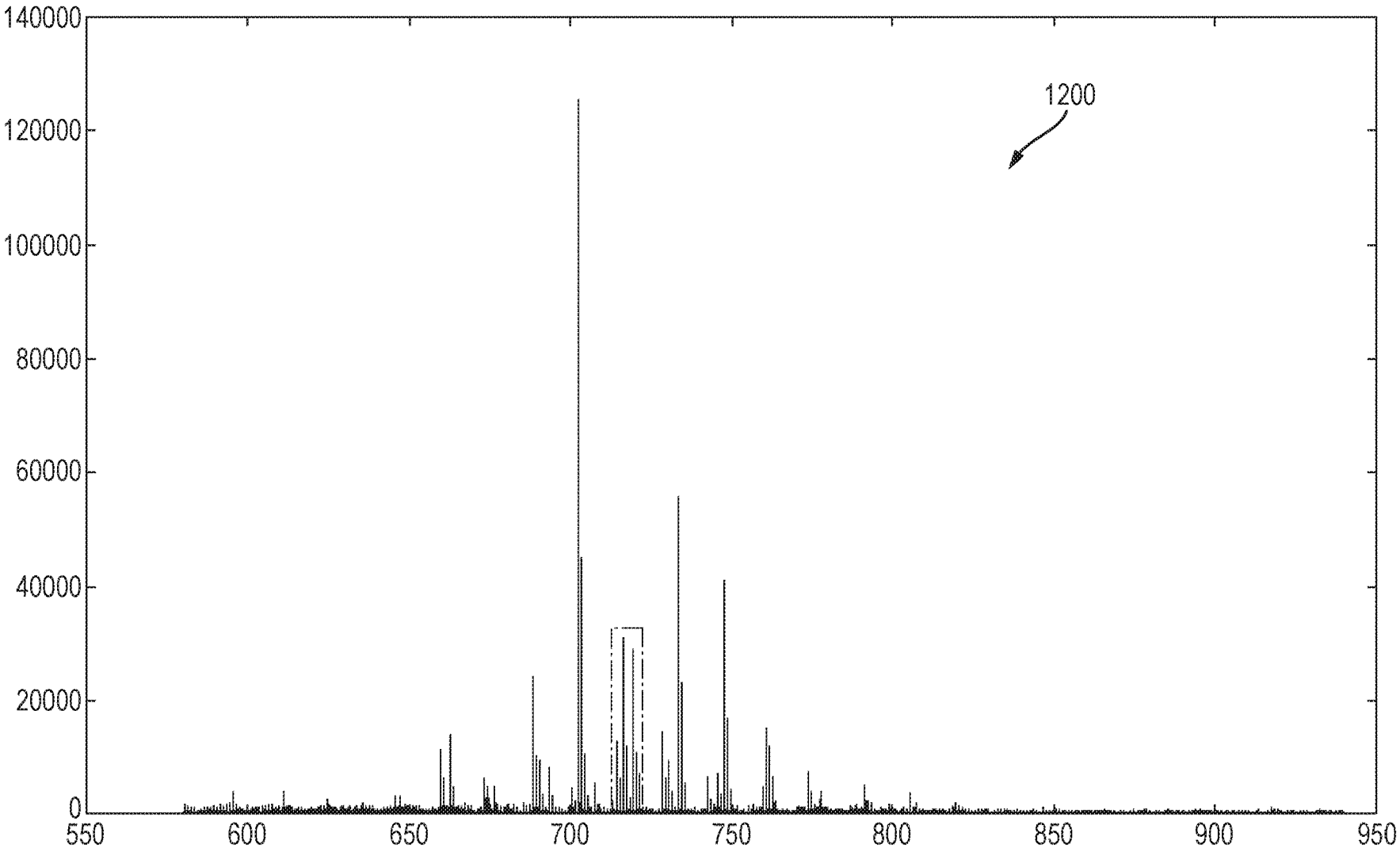
FIGS. 12A and 12B show a sample mass spectrum to which a deisotoping process is to be applied.
Figure 12B:
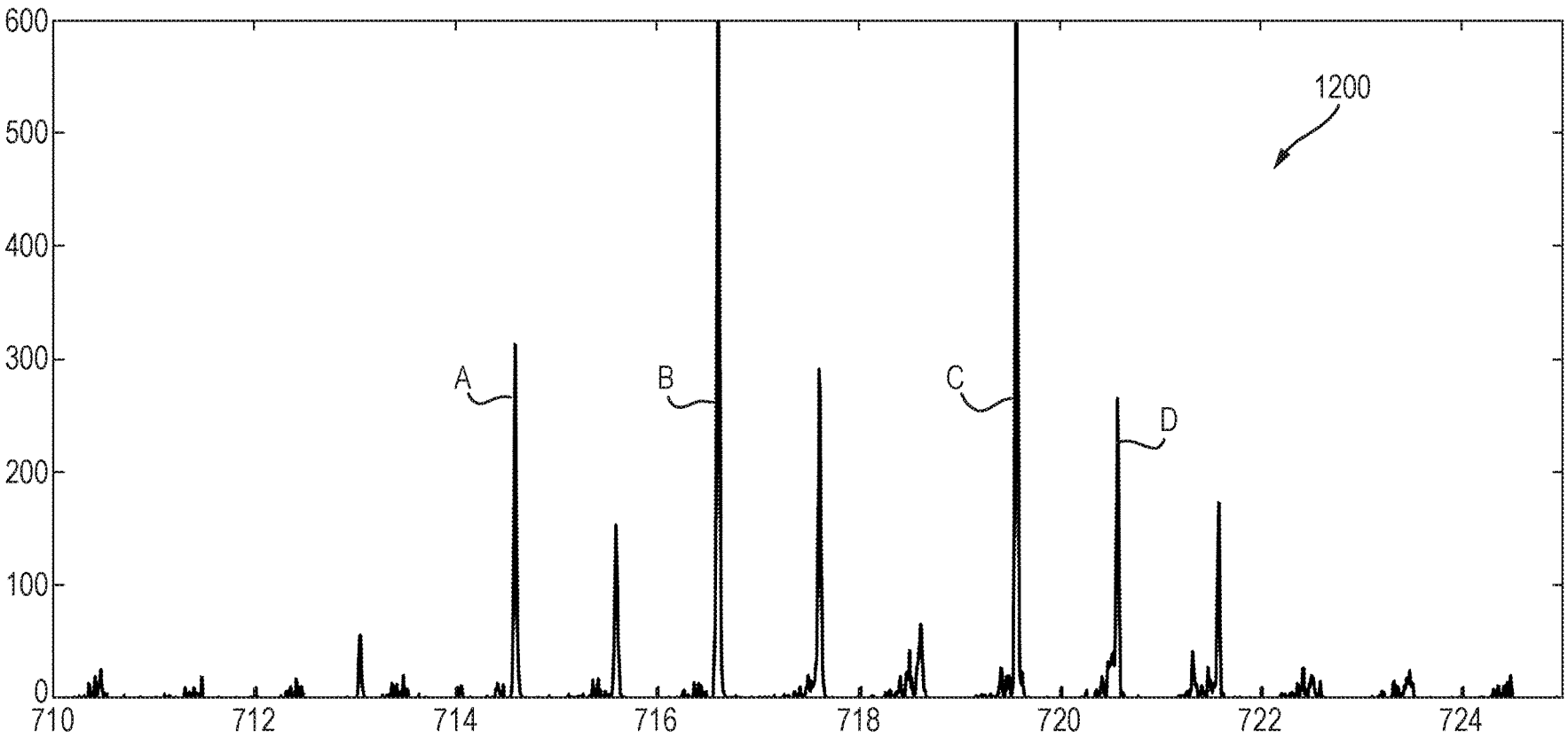

FIG. 12A shows a sample mass spectrum 1200 to which a deisotoping process will be applied. The sample mass spectrum 1200 was obtained by Rapid Evaporative Ionisation Mass Spectrometry analysis of a microbe culture. FIG. 12B shows a closer view of a portion of the sample mass spectrum 1200.

The range of mass to charge (m/z) shown contains a series of phospholipids whose relative intensities can be used to differentiate between different species of microbes.

The sample mass spectrum 1200 contains at least three distinct singly charged species with masses of approximately $M_A$=714.5, $M_B$=716.5 and $M_C$=719.5, each accompanied by a characteristic isotope distribution giving rise to peaks at M+1, M+2, etc.

In this embodiment, the peaks at $M_A$=714.5, $M_B$=716.5 relate to species A and B that are chemically closely related. Because of this, the isotopic peak of species A at m/z 716.5 lies on top of the monoisotopic peak of species B. The peak at 716.5 therefore receives contributions from both species A and species B.

If the relative abundance of species A and B is different for different microbes, then the intensity of the peak with m/z 716.5 relative to the surrounding peaks is complicated. Situations may arise in which a single mass spectral peak may receive contributions from more than two species, and also species having different charge states. This complexity complicates the classification problem, and may require the use of more sophisticated and/or computationally demanding algorithms than would be required if every peak in the spectrum originated from a single molecular species.

Another related problem that arises is the presence of partially resolved peaks such as the peak at $M_D$=720.5 for species D.

Although the identity of the molecular species represented in a spectrum such as this may not be known, it is often the case that their composition is sufficiently well constrained that the isotope distribution can be predicted with good accuracy given only knowledge of their molecular weight and charge state. This is true especially of molecules built from a common set of components or repeating units (e.g., polymers, oligo-nucleotides, peptides, proteins, lipids, carbohydrates etc.) for which molecular weight and composition are strongly correlated.

It is possible to process mass spectral data containing species of this type to produce a simplified spectrum containing only monoisotopic peaks (in other words a single representative peak for each species). It is also possible for the charge state of each species to be identified from isotopic spacing and for the output of the deisotoping process to be a reconstructed singly charged or neutral spectrum. Although these methods may be used in embodiments, they are more suitable for processing relatively simple spectra as they may fail to deal with overlapping isotope clusters. This can result in assignment of the wrong mass to species, quantitative errors and complete failure to classify some species.

The term "isotopic deconvolution" is used herein to describe deisotoping methods that can deconvolve complicated spectra containing overlapping/interfering or partially resolved species. In these embodiments, the relative intensities of species may be preserved during the deisotoping process, even when isotopic peaks overlap.

In the following embodiment, the deisotoping process is an isotopic deconvolution process in which overlapping and/or interfering isotopic peaks can be removed or reduced, rather than simply being removed.

In this embodiment, the deisotoping process is an iterative forward modelling process using a Monte Carlo, probabilistic (Bayesian inference) and nested sampling method.

Firstly, a set of trial hypothetical monoisotopic sample spectra X are generated. The set of trial monoisotopic sample spectra X are generated using known probability density functions for mass, intensity, charge state and number of peaks for the suspected class of sample to which the sample spectra relates.

A set of modelled sample spectra having isotopic peaks are then generated from the trial monoisotopic sample spectra X using known average isotopic distributions for the suspected class of sample to which the sample spectra relates.

Figure 13:
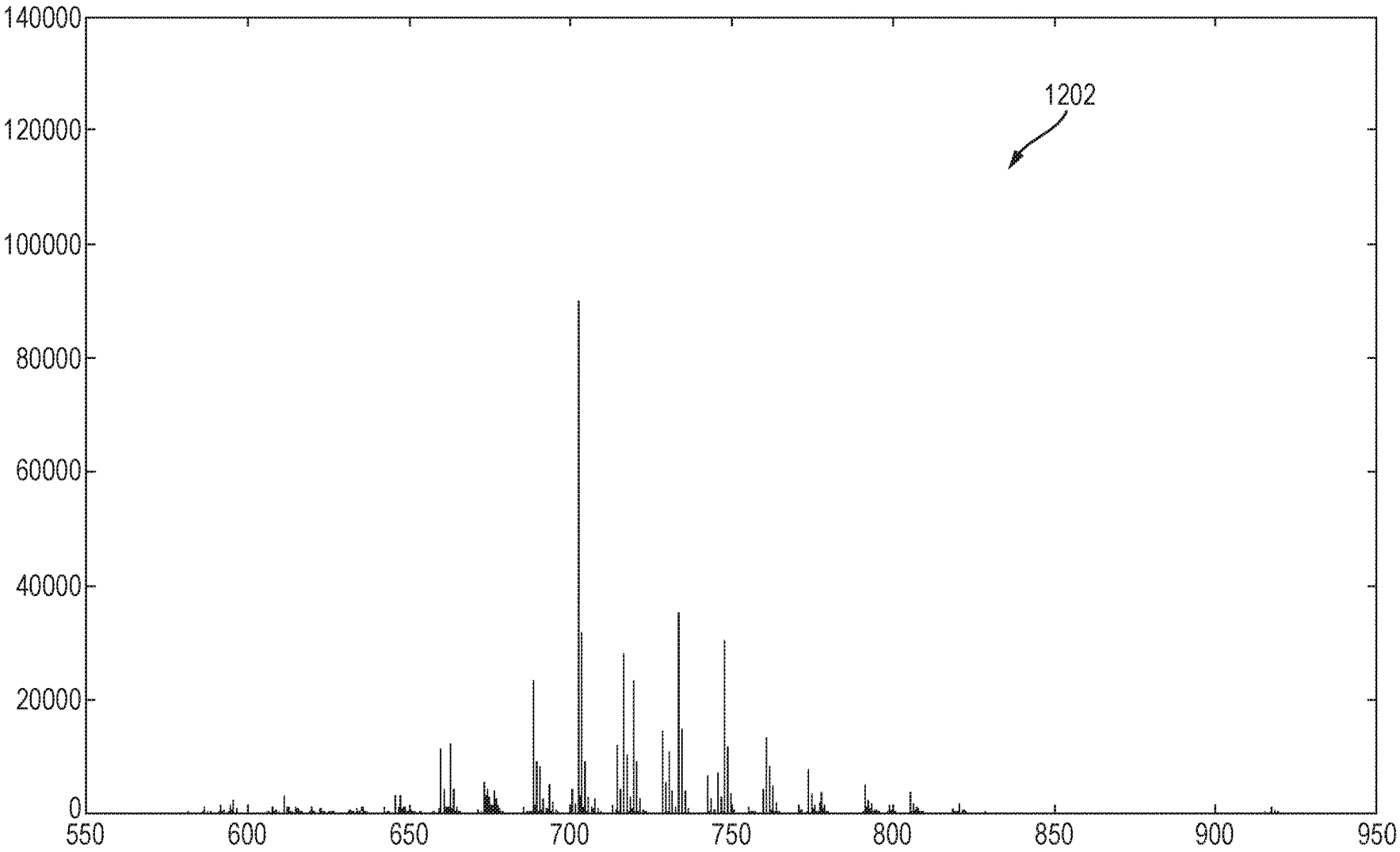
FIG. 13 shows a modelled isotopic version of a trial monoisotopic sample mass spectrum.

FIG. 13 shows one example of a modelled sample spectrum 1202 generated from a trial monoisotopic sample spectrum.

A likelihood L of the sample spectrum 1200 given each trial monoisotopic sample spectrum 1202 is then derived by comparing each model sample spectrum to the sample spectrum 1200.

The trial monoisotopic sample spectrum $x_0$ having the lowest likelihood $L_0$ is then re-generated using the known probability density functions for mass, intensity, charge state and number of peaks until the re-generated trial monoisotopic sample spectrum $x_1$ gives a likelihood $L_1>L_0$.

The trial monoisotopic sample spectrum $x_2$ having the next lowest likelihood $L_2$ is then re-generated using the using known probability density functions for mass, intensity, charge state and number of peaks until the re-generated trial monoisotopic sample spectrum $x_3$ gives a $L_3>L_2$.

This iterative process of regenerating trial monoisotopic sample spectra continues for each subsequent trial monoisotopic sample spectra $x_n$ having the next lowest likelihood $L_n$, requiring that $L_{n+1}>L_n$, until a maximum likelihood $L_m$ is or appears to have been reached for all the trial monoisotopic sample spectra X.

Figure 14A:
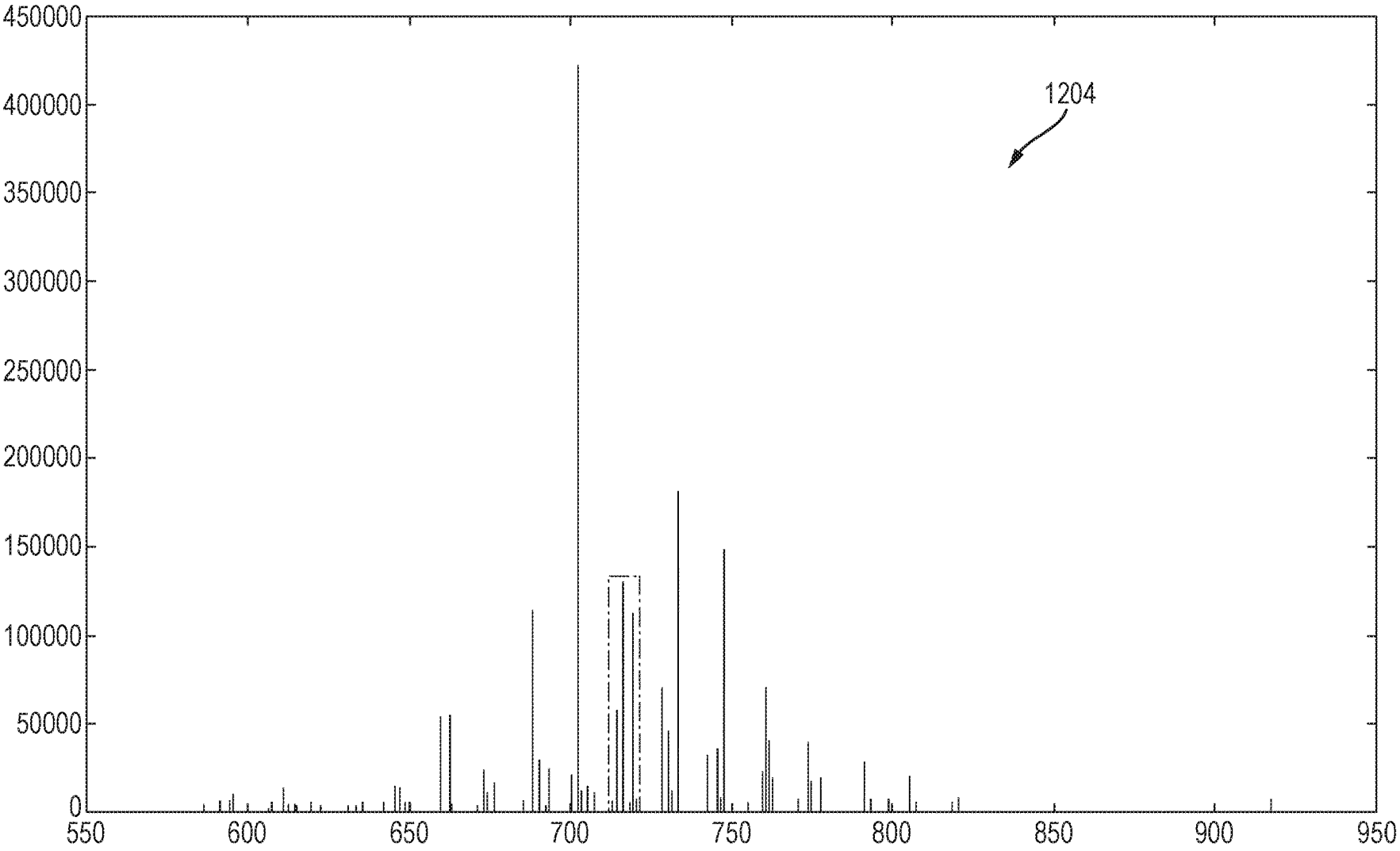
FIGS. 14A and 14B show a deisotoped sample mass spectrum for the sample mass spectrum of FIGS. 12A and 12B.
Figure 14B:
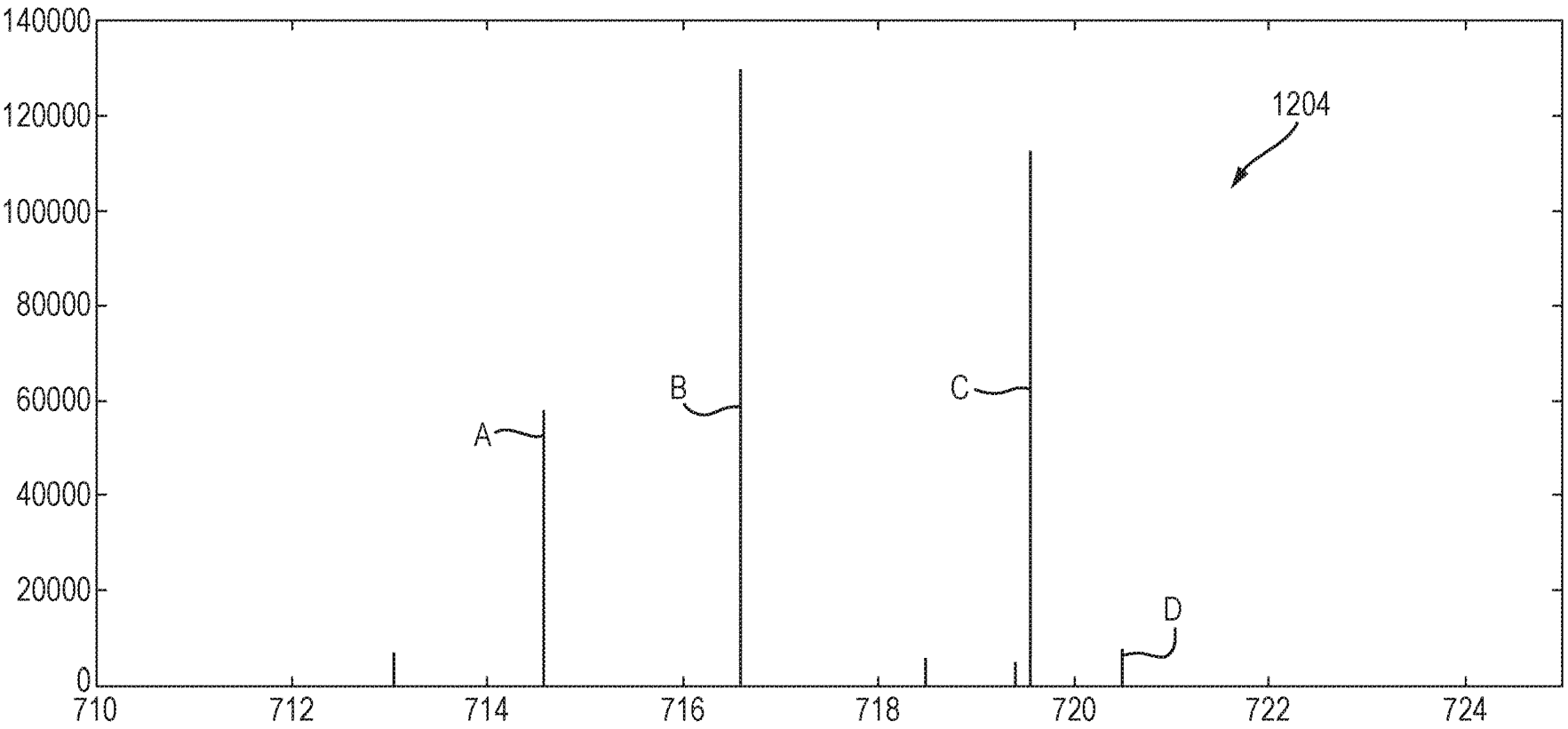

FIGS. 14A and 14B show a deisotoped spectrum 1204 for the sample spectrum 1200 of FIGS. 12A and 12B that is derived from the final set of trial monoisotopic sample spectra X.

In this embodiment, each peak in the deisotoped version 1204 has: at least a threshold probability of presence (e.g., occurrence rate) in a representative set of deisotoped sample spectra generated from the final set of trial monoisotopic sample spectra X; less than a threshold monoisotopic mass uncertainty in the representative set of deisotoped sample spectra; and less than a threshold intensity uncertainty in the representative set of deisotoped sample spectra.

In other embodiments, an average of peak clusters identified across a representative set of deisotoped sample spectra generated from the final set of trial monoisotopic sample spectra X may be used to derive peaks in a deisotoped spectrum.

It will be apparent that the deisotoped spectrum 1204 is considerably simpler than the original spectrum 1200 of FIGS. 12A and 12B, and that a lower dimensional representation of the data is provided (e.g., involving fewer data channels, bins, detected peaks, etc.). This is particularly useful when carrying out multivariate and/or library-based analysis of sample spectra so as to classify a sample. In particular, simpler and/or less resource intensive analysis may be carried out.

Furthermore, deisotoping can help to distinguish between spectra by removing commonality due to isotopic distributions. Again, this is particularly useful when carrying out multivariate and/or library-based analysis of sample spectra so as to classify a sample. In particular, a more accurate or confident classification may be provided, for example due to greater separation between classes in multivariate space and greater differences between classification scores or probabilities in library based analysis.

In other embodiments, other iterative forward modelling processes such as massive inference or maximum entropy may be used. These are also typically isotopic deconvolution approaches.

In other embodiments, other approaches such as least squares, non-negative least squares and (fast) Fourier transforms may be used. These are also typically isotopic deconvolution approaches.

In some embodiments, when one or more species with known elemental composition are known to be present or likely to be present in the spectrum, they may be included in the deconvolution process with the correct mass and an exact isotope distribution based on their true composition rather than an estimate of their composition based on their mass.

Analysing Sample Spectra

As discussed above, the spectrometric analysis method 100 of FIG. 1 comprises a step 106 of analyzing the one or more sample spectra so as to classify a sample.

Also, as discussed above, the spectrometric analysis system 200 of FIG. 2 comprises analysis circuitry 208 arranged and adapted to analyze the one or more sample spectra so as to classify a sample.

Analyzing the one or more sample spectra so as to classify a sample can comprise building a classification model and/or library using reference sample spectra and/or using a classification model and/or library to identify sample spectra. The classification model and/or library can be developed and/or modified for a particular target or subject (e.g., patient). The classification model and/or library can also be developed, modified and/or used whilst a sampling device that is being used to obtain the sample spectra is in use.

By way of example, a number of different analysis techniques will now be described.

A list of analysis techniques which are intended to fall within the scope of the present invention are given in the following table:

| Analysis Techniques |
|---|
| Univariate Analysis |
| Multivariate Analysis |
| Principal Component Analysis (PCA) |
| Linear Discriminant Analysis (LDA) |
| Maximum Margin Criteria (MMC) |
| Library Based Analysis |
| Soft Independent Modelling Of Class Analogy (SIMCA) |
| Factor Analysis (FA) |
| Recursive Partitioning (Decision Trees) |
| Random Forests |
| Independent Component Analysis (ICA) |
| Partial Least Squares Discriminant Analysis (PLS-DA) |
| Orthogonal (Partial Least Squares) Projections |
| To Latent Structures (OPLS) |
| OPLS Discriminant Analysis (OPLS-DA) |
| Support Vector Machines (SVM) |
| (Artificial) Neural Networks |
| Multilayer Perceptron |
| Radial Basis Function (RBF) Networks |
| Bayesian Analysis |
| Cluster Analysis |
| Kernelized Methods |
| Subspace Discriminant Analysis |
| K-Nearest Neighbours (KNN) |
| Quadratic Discriminant Analysis (QDA) |
| Probabilistic Principal Component Analysis (PPCA) |
| Non negative matrix factorisation |
| K-means factorisation |
| Fuzzy c-means factorisation |
| Discriminant Analysis (DA) |

Combinations of the foregoing analysis approaches can also be used, such as PCA-LDA, PCA-MMC, PLS-LDA, etc.

Analysing the sample spectra can comprise unsupervised analysis for dimensionality reduction followed by supervised analysis for classification.

By way of example, a number of different analysis techniques will now be described in more detail.

Multivariate Analysis—Developing a Model for Classification

By way of example, a method of building a classification model using multivariate analysis of plural reference sample spectra will now be described.

Figure 15:
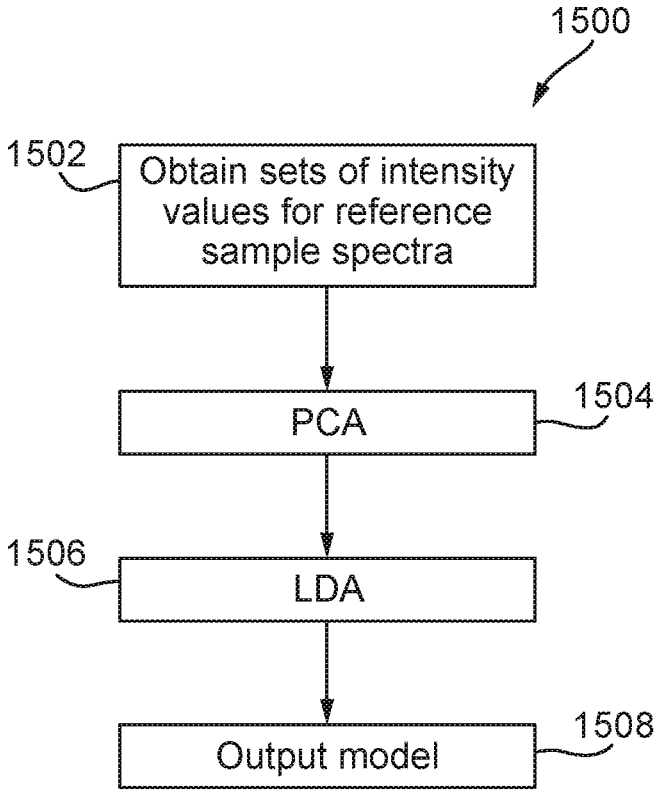
FIG. 15 shows a method of analysis that comprises building a classification model according to various embodiments.

FIG. 15 shows a method 1500 of building a classification model using multivariate analysis. In this example, the method comprises a step 1502 of obtaining plural sets of intensity values for reference sample spectra. The method then comprises a step 1504 of unsupervised principal component analysis (PCA) followed by a step 1506 of supervised linear discriminant analysis (LDA). This approach may be referred to herein as PCA-LDA. Other multivariate analysis approaches may be used, such as PCA-MMC. The PCA-LDA model is then output, for example to storage, in step 1508.

The multivariate analysis such as this can provide a classification model that allows a sample to be classified using one or more sample spectra obtained from the sample. The multivariate analysis will now be described in more detail with reference to a simple example.

Figure 16:
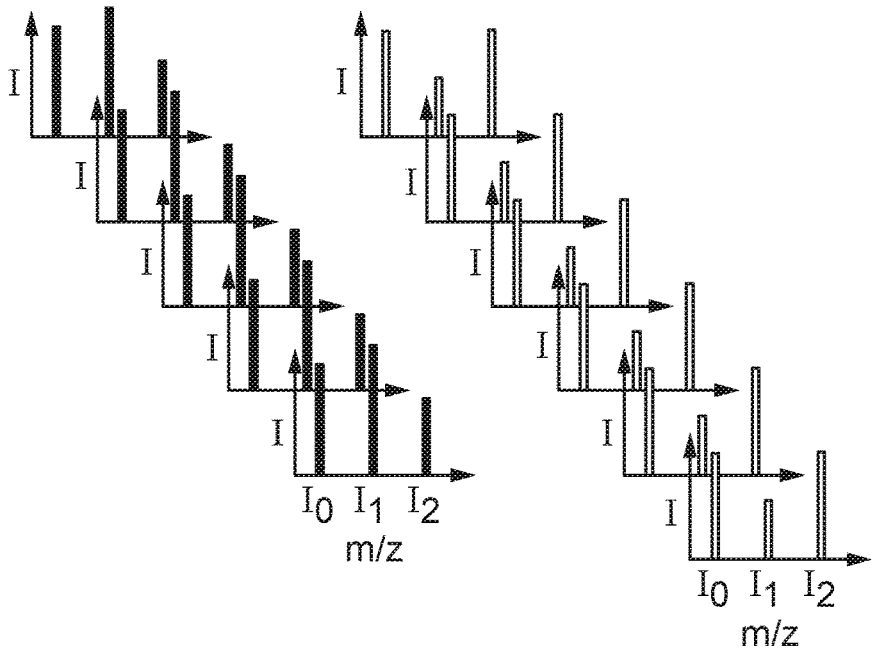
FIG. 16 shows a set of reference sample spectra obtained from two classes of known reference samples.

FIG. 16 shows a set of reference sample spectra obtained from two classes of known reference samples. The classes may be any one or more of the classes of target described herein. However, for simplicity, in this example the two classes will be referred as a left-hand class and a right-hand class.

Each of the reference sample spectra has been preprocessed in order to derive a set of three reference peak-intensity values for respective mass to charge ratios in that reference sample spectrum. Although only three reference peak-intensity values are shown, it will be appreciated that many more reference peak-intensity values (e.g., ~100 reference peak-intensity values) may be derived for a corresponding number of mass to charge ratios in each of the reference sample spectra. In other embodiments, the reference peak-intensity values may correspond to: masses; mass to charge ratios; ion mobilities (drift times); and/or operational parameters.

FIG. 17 shows a multivariate space having three dimensions defined by intensity axes. Each of the dimensions or intensity axes corresponds to the peak-intensity at a particular mass to charge ratio. Again, it will be appreciated that there may be many more dimensions or intensity axes (e.g., ~100 dimensions or intensity axes) in the multivariate space. The multivariate space comprises plural reference points, with each reference point corresponding to a reference sample spectrum, i.e., the peak-intensity values of each reference sample spectrum provide the co-ordinates for the reference points in the multivariate space.

The set of reference sample spectra may be represented by a reference matrix D having rows associated with respective reference sample spectra, columns associated with respective mass to charge ratios, and the elements of the matrix being the peak-intensity values for the respective mass to charge ratios of the respective reference sample spectra. In many cases, the large number of dimensions in the multivariate space and matrix D can make it difficult to group the reference sample spectra into classes. PCA may accordingly be carried out on the matrix D in order to calculate a PCA model that defines a PCA space having a reduced number of one or more dimensions defined by principal component axes. The principal components may be selected to be those that comprise or "explain" the largest variance in the matrix D and that cumulatively explain a threshold amount of the variance in the matrix D.

Figure 18:
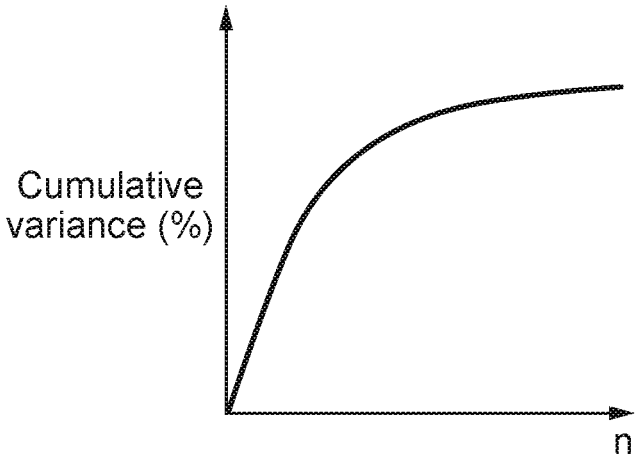
FIG. 18 shows a general relationship between cumulative variance and number of components of a PCA model.

FIG. 18 shows how the cumulative variance may increase as a function of the number n of principal components in the PCA model. The threshold amount of the variance may be selected as desired.

The PCA model may be calculated from the matrix D using a non-linear iterative partial least squares (NIPALS) algorithm or singular value decomposition, the details of which are known to the skilled person and so will not be described herein in detail. Other methods of calculating the PCA model may be used.

The resultant PCA model may be defined by a PCA scores matrix S and a PCA loadings matrix L. The PCA may also produce an error matrix E, which contains the variance not explained by the PCA model. The relationship between D, S, L and E may be:

$$D=SL^T+E \quad (1)$$

Figure 19:
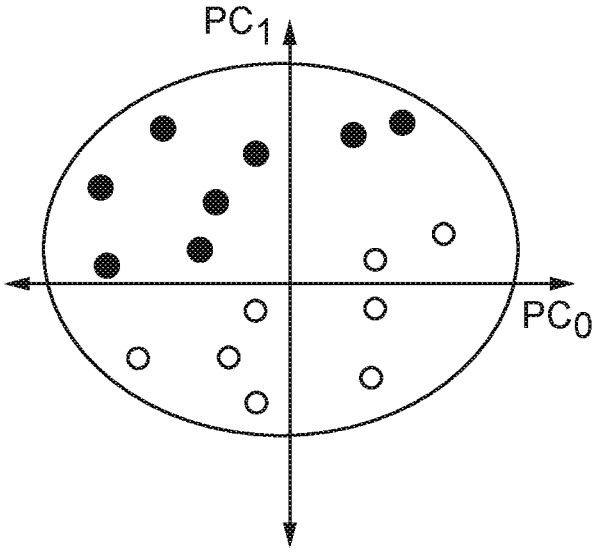
FIG. 19 shows a PCA space having two dimensions defined by principal component axes, wherein the PCA space comprises plural transformed reference points or scores, each transformed reference point corresponding to a reference point of FIG. 17.

FIG. 19 shows the resultant PCA space for the reference sample spectra of FIGS. 16 and 17. In this example, the PCA model has two principal components $PC_0$ and $PC_1$ and the PCA space therefore has two dimensions defined by two principal component axes. However, a lesser or greater number of principal components may be included in the PCA model as desired. It is generally desired that the number of principal components is at least one less than the number of dimensions in the multivariate space.

The PCA space comprises plural transformed reference points or PCA scores, with each transformed reference point or PCA score corresponding to a reference sample spectrum of FIG. 16 and therefore to a reference point of FIG. 17.

As is shown in FIG. 19, the reduced dimensionality of the PCA space makes it easier to group the reference sample spectra into the two classes. Any outliers may also be identified and removed from the classification model at this stage.

Further supervised multivariate analysis, such as multi-class LDA or maximum margin criteria (MMC), in the PCA space may then be performed so as to define classes and, optionally, further reduce the dimensionality.

As will be appreciated by the skilled person, multi-class LDA seeks to maximise the ratio of the variance between classes to the variance within classes (i.e., so as to give the largest possible distance between the most compact classes possible). The details of LDA are known to the skilled person and so will not be described herein in detail.

The resultant PCA-LDA model may be defined by a transformation matrix U, which may be derived from the PCA scores matrix S and class assignments for each of the transformed spectra contained therein by solving a generalised eigenvalue problem, for example using regularisation (e.g., Tikhonov regularisation or pseudoinverses) if required to make the problem well conditioned.

The transformation of the scores S from the original PCA space into the new LDA space may then be given by:

$$Z=SU \tag{2}$$

where the matrix Z contains the scores transformed into the LDA space.

Figure 20:
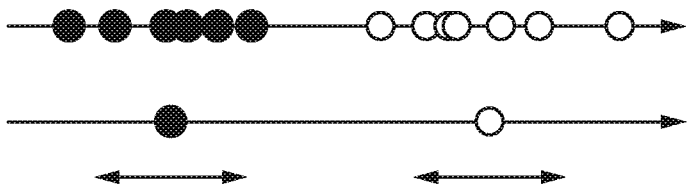
FIG. 20 shows a PCA-LDA space having a single dimension or axis, wherein the LDA is performed based on the PCA space of FIG. 19, the PCA-LDA space comprising plural further transformed reference points or class scores, each further transformed reference point corresponding to a transformed reference point or score of FIG. 19.

FIG. 20 shows a PCA-LDA space having a single dimension or axis, wherein the LDA is performed in the PCA space of FIG. 19. As is shown in FIG. 20, the LDA space comprises plural further transformed reference points or PCA-LDA scores, with each further transformed reference point corresponding to a transformed reference point or PCA score of FIG. 19.

In this example, the further reduced dimensionality of the PCA-LDA space makes it even easier to group the reference sample spectra into the two classes. Each class in the PCA-LDA model may be defined by its transformed class average and covariance matrix or one or more hyperplanes (including points, lines, planes or higher order hyperplanes) or hypersurfaces or Voronoi cells in the PCA-LDA space.

The PCA loadings matrix L, the LDA matrix U and transformed class averages and covariance matrices or hyperplanes or hypersurfaces or Voronoi cells may be output to a database for later use in classifying a sample.

The transformed covariance matrix in the LDA space $V'_g$ for class g may be given by $$V'_g=U^TV_gU \tag{3}$$

where $V_g$ are the class covariance matrices in the PCA space.

The transformed class average position $z_g$ for class g may be given by $$S_gU=z_g \tag{4}$$

where $s_g$ is the class average position in the PCA space.

Multivariate Analysis—Using a Model for Classification

By way of example, a method of using a classification model to classify a sample will now be described.

Figure 21:
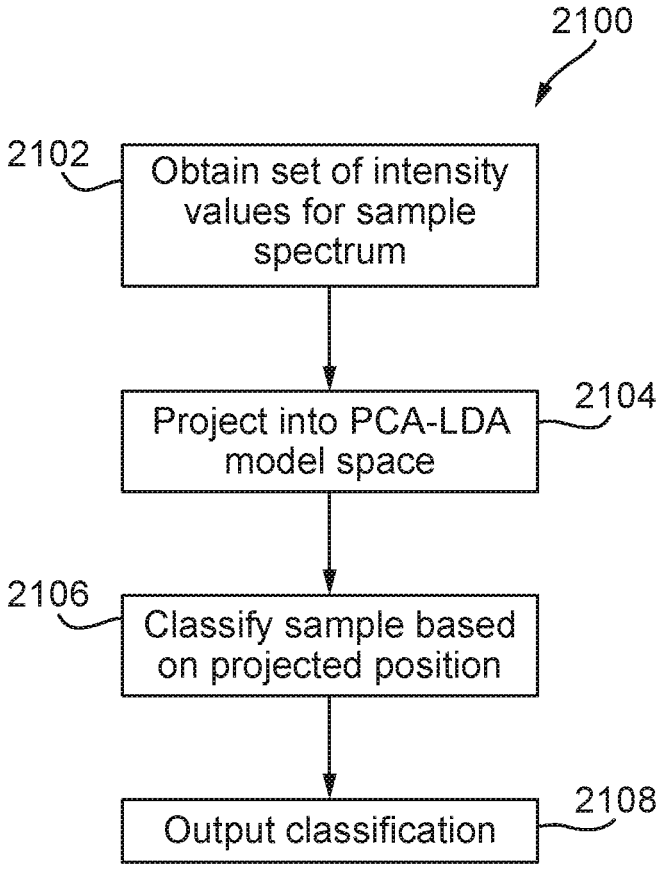
FIG. 21 shows a method of analysis that comprises using a classification model according to various embodiments.

FIG. 21 shows a method 2100 of using a classification model. In this example, the method comprises a step 2102 of obtaining a set of intensity values for a sample spectrum. The method then comprises a step 2104 of projecting the set of intensity values for the sample spectrum into PCA-LDA model space. Other classification model spaces may be used, such as PCA-MMC. The sample spectrum is then classified at step 2106 based on the project position and the classification is then output in step 2108.

Classification of a sample will now be described in more detail with reference to the simple PCA-LDA model described above.

Figure 22:
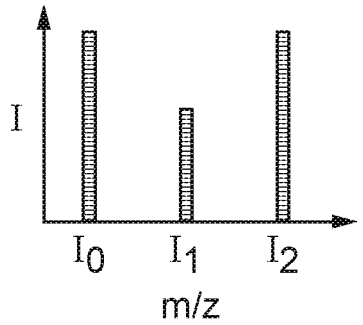
FIG. 22 shows a sample spectrum obtained from an unknown sample.

FIG. 22 shows a sample spectrum obtained from an unknown sample. The sample spectrum has been pre-processed in order to derive a set of three sample peak-intensity values for respective mass to charge ratios. As mentioned above, although only three sample peak-intensity values are shown, it will be appreciated that many more sample peak-intensity values (e.g., ~100 sample peak-intensity values) may be derived at many more corresponding mass to charge ratios for the sample spectrum. Also, as mentioned above, in other embodiments, the sample peak-intensity values may correspond to: masses; mass to charge ratios; ion mobilities (drift times); and/or operational parameters.

The sample spectrum may be represented by a sample vector $d_x$, with the elements of the vector being the peak-intensity values for the respective mass to charge ratios. A transformed PCA vector $s_x$ for the sample spectrum can be obtained as follows:

$$d_xL=s_x \tag{5}$$

Then, a transformed PCA-LDA vector $z_x$ for the sample spectrum can be obtained as follows:

$$S_xU=z_x \tag{6}$$

Figure 23:
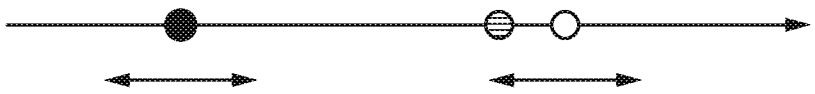
FIG. 23 shows the PCA-LDA space of FIG. 20, wherein the PCA-LDA space further comprises a PCA-LDA projected sample point derived from the peak intensity values of the sample spectrum of FIG. 22.

FIG. 23 again shows the PCA-LDA space of FIG. 20. However, the PCA-LDA space of FIG. 23 further comprises the projected sample point, corresponding to the transformed PCA-LDA vector $z_x$, derived from the peak intensity values of the sample spectrum of FIG. 22.

In this example, the projected sample point is to one side of a hyperplane between the classes that relates to the right-hand class, and so the sample may be classified as belonging to the right-hand class.

Alternatively, the Mahalanobis distance from the class centres in the LDA space may be used, where the Mahalanobis distance of the point $z_x$ from the centre of class g may be given by the square root of:

$$(z_x-z_g)^T(V'_g)^{-1}(z_x-z_g) \tag{8}$$

and the data vector $d_x$ may be assigned to the class for which this distance is smallest.

In addition, treating each class as a multivariate Gaussian, a probability of membership of the data vector to each class may be calculated.

As discussed above, a different set of class-specific background-subtracted sample intensity values may be derived for each class of one or more classes of sample. Step 2100 may therefore comprise obtaining a set of class-specific background-subtracted intensity values for each class of sample. Steps 2102 and 2104 may then be performed in respect of each set of class-specific background-subtracted intensity values to provide a class-specific projected position. The sample spectrum may then be classified at step 2106 based on the class-specific projected positions. For example, the sample spectrum may be assigned to the class having a class-specific projected position that gives the shortest distance or highest probability of membership to its class.

Library Based Analysis—Developing a Library for Classification

By way of example, a method of building a classification library using plural input reference sample spectra will now be described.

Figure 24:
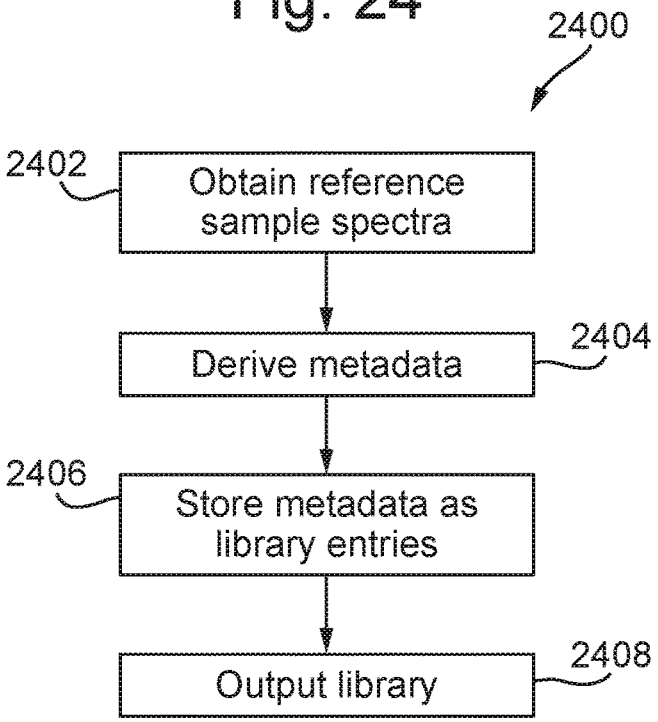
FIG. 24 shows a method of analysis that comprises building a classification library according to various embodiments.

FIG. 24 shows a method 2400 of building a classification library. In this example, the method comprises a step 2402 of obtaining reference sample spectra and a step 2404 of deriving metadata from the plural input reference sample spectra for each class of sample. The method then comprises a step 2406 of storing the metadata for each class of sample as a separate library entry. The classification library is then output, for example to electronic storage, in step 2408.

A classification library such as this allows a sample to be classified using one or more sample spectra obtained from the sample. The library based analysis will now be described in more detail with reference to an example.

In this example, each entry in the classification library is created from plural pre-processed reference sample spectra that are representative of a class. In this example, the reference sample spectra for a class are pre-processed according to the following procedure:

First, a re-binning process is performed, for example as discussed above. In this embodiment, the data are resampled onto a logarithmic grid with abscissae:

$$x_i = \left\lfloor N_{chan} \log\frac{m}{M_{min}} / \log\frac{M_{max}}{M_{min}} \right\rfloor$$

where $N_{chan}$ is a selected value and denotes the nearest integer below x. In one example, $N_{chan}$ is $2^{12}$ or 4096.

Then, a background subtraction process is performed, for example as discussed above. In this embodiment, a cubic spline with k knots is then constructed such that p % of the data between each pair of knots lies below the curve. This curve is then subtracted from the data. In one example, k is 32. In one example, p is 5. A constant value corresponding to the q % quantile of the intensity subtracted data is then subtracted from each intensity. Positive and negative values are retained. In one example, q is 45. Then, a normalisation process is performed, for example as discussed above. In this embodiment, the data are normalised to have mean $\overline{y}_i$. In one example, $\overline{y}_i=1$.

An entry in the library then consists of metadata in the form of a median spectrum value $\mu_i$ and a deviation value $D_i$ for each of the $N_{chan}$ points in the spectrum.

The likelihood for the i'th channel is given by:

$$Pr(y_i \mid \mu_i, D_i) = \frac{1}{D_i} \frac{C^{C-1/2}\Gamma(C)}{\sqrt{\pi}\,\Gamma(C-1/2)} \frac{1}{\left(C + \frac{(y_i-\mu_i)^2}{D_i^2}\right)^C}$$

where $1/2 \leq C < \infty$ and where $\Gamma(C)$ is the gamma function.

The above equation is a generalised Cauchy distribution which reduces to a standard Cauchy distribution for C=1 and becomes a Gaussian (normal) distribution as $C \rightarrow \infty$. The parameter $D_i$ controls the width of the distribution (in the Gaussian limit $D_i=\sigma_i$ is simply the standard deviation) while the global value C controls the size of the tails.

In one example, C is 3/2, which lies between Cauchy and Gaussian, so that the likelihood becomes:

$$Pr(y_i \mid \mu_i, D_i) = \frac{3}{4}\frac{1}{D_i}\frac{1}{(3/2 + (y_i-\mu_i)^2/D_i^2)^{3/2}}$$

For each library entry, the parameters $\mu_i$ are set to the median of the list of values in the i'th channel of the input reference sample spectra while the deviation $D_i$ is taken to be the interquartile range of these values divided by $\sqrt{2}$. This choice can ensure that the likelihood for the i'th channel has the same interquartile range as the input data, with the use of quantiles providing some protection against outlying data.

Library-Based Analysis—Using a Library for Classification

By way of example, a method of using a classification library to classify a sample will now be described.

Figure 25:
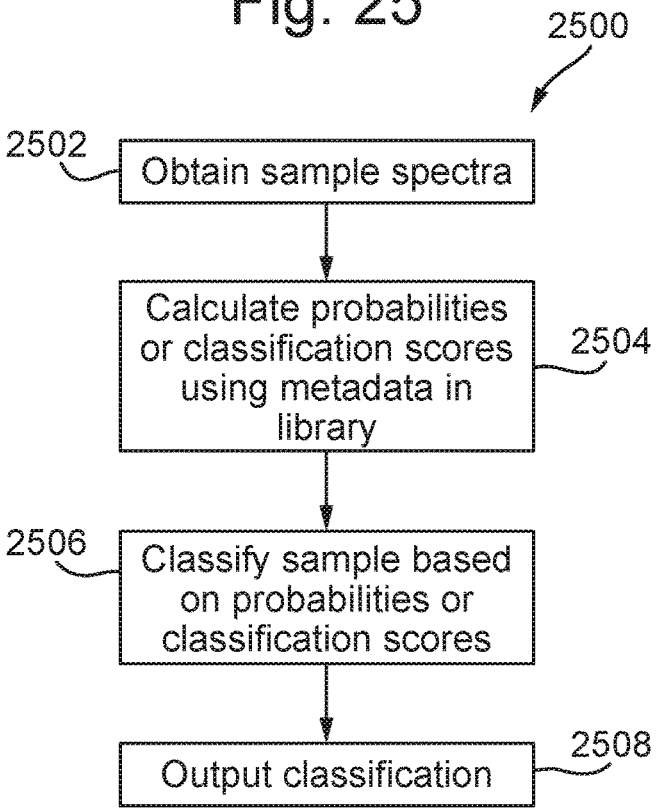
FIG. 25 shows a method of analysis that comprises using a classification library according to various embodiments.

FIG. 25 shows a method 2500 of using a classification library. In this example, the method comprises a step 2502 of obtaining a set of plural sample spectra. The method then comprises a step 2504 of calculating a probability or classification score for the set of plural sample spectra for each class of sample using metadata for the class entry in the classification library. This may comprise using a different set of class-specific background-subtracted sample spectra for each class so as to provide a probability or classification score for that class. The sample spectra are then classified at step 2506 and the classification is then output in step 2508.

Classification of a sample will now be described in more detail with reference to the classification library described above.

In this example, an unknown sample spectrum y is the median spectrum of a set of plural sample spectra. Taking the median spectrum y can protect against outlying data on a channel by channel basis.

The likelihood $L_s$ for the input data given the library entry s is then given by:

$$L_s = Pr(y \mid \mu, D) = \prod_{i=1}^{N_{chan}} Pr(y_i \mid \mu_i, D_i)$$

where $\mu_i$ and $D_i$ are, respectively, the library median values and deviation values for channel i. The likelihoods $L_s$ may be calculated as log likelihoods for numerical safety.

The likelihoods $L_s$ are then normalised over all candidate classes 's' to give probabilities, assuming a uniform prior probability over the classes. The resulting probability for the class $\tilde{s}$ is given by:

$$Pr(\tilde{s} \mid y) = \frac{L_{\tilde{s}}^{(1/F)}}{\sum_s L_s^{(1/F)}}$$

The exponent (1/F) can soften the probabilities which may otherwise be too definitive. In one example, F=100. These probabilities may be expressed as percentages, e.g., in a user interface.

Alternatively, RMS classification scores $R_s$ may be calculated using the same median sample values and derivation values from the library:

$$R_s(y, \mu, D) = \sqrt{\frac{1}{N_{chan}} \sum_{i=1}^{N_{chan}} \frac{(y_i - \mu_i)^2}{D_i^2}}$$

Again, the scores $R_s$ are normalised over all candidate classes 's'.

The sample may then be classified as belonging to the class having the highest probability and/or highest RMS classification score.

Using Results of Analysis

As discussed above, the spectrometric analysis method 100 of FIG. 1 comprises a step 108 of using the results of the analysis.

This may comprise, for example, displaying the results of the classification using the feedback device 210 and/or controlling the operation of the sampling device 202, spectrometer 204, pre-processing circuitry 206 and/or analysis circuitry 208.

The results can be used and/or provided whilst a sampling device that is being used to obtain the sample spectra is in use.

APPLICATIONS

Various different applications are contemplated.

According to some embodiments the methods disclosed above may be performed on organic matter, biological matter and/or in vivo, ex vivo or in vitro tissue. The tissue may comprise human or non-human animal tissue.

Various surgical, therapeutic, medical treatment and diagnostic methods are contemplated. However, other embodiments are contemplated which relate to non-surgical and non-therapeutic methods of spectrometry which are not performed on in vivo tissue. Other related embodiments are contemplated which are performed in an extracorporeal manner such that they are performed outside of the human or animal body.

Further embodiments are contemplated wherein the methods are performed on a non-living human or animal, for example, as part of an autopsy procedure.

Further non-surgical, non-therapeutic and non-diagnostic embodiments are contemplated. According to some embodiments the methods disclosed above may be performed on inorganic and/or non-biological matter.

Although the present invention has been described with reference to various embodiments, it will be understood by those skilled in the art that various changes in form and detail may be made without departing from the scope of the invention as set forth in the accompanying claims.

The invention claimed is:

1. A method of spectrometric analysis comprising:

obtaining one or more sample spectra for a sample;

pre-processing the one or more sample spectra, wherein pre-processing the one or more sample spectra comprises using isotopic deconvolution as a deisotoping process to generate a deisotoped version of the one or more sample spectra in which one or more isotopic peaks are reduced or removed;

analysing the one or more pre-processed sample spectra, wherein analysing the one or more pre-processed sample spectra comprises performing at least one of a multivariate and library-based analysis on the deisotoped version of the one or more sample spectra; and classifying the sample using the at least one of a multivariate and library-based analysis on the deisotoped version of the one or more sample spectra, wherein classifying the sample comprises projecting at least one of a sample point and vector for the deisotoped version of the one or more sample spectra into a classification model space.

2. A method as claimed in claim 1, wherein the deisotoped version of the one or more sample spectra is a lower dimensional representation of the one or more sample spectra; and the at least one of a multivariate and library-based analysis is performed on the lower dimensional representation of the one or more sample spectra.

3. A method as claimed in claim 1, wherein the deisotoping process comprises using one or more of: nested sampling; massive inference; and maximum entropy to generate the deisotoped version of the one or more sample spectra.

4. A method as claimed in claim 1, wherein the deisotoping process comprises generating a set of trial hypothetical monoisotopic sample spectra.

5. A method as claimed in claim 4, wherein the deisotoping process comprises deriving a likelihood of the one or more sample spectra given each trial hypothetical monoisotopic sample spectrum.

6. A method as claimed in claim 4, wherein the deisotoping process comprises generating a set of modelled sample spectra having isotopic peaks from the set of trial hypothetical monoisotopic sample spectra.

7. A method as claimed in claim 6, wherein each modelled sample spectra is generated using known average isotopic distributions for one or more classes of sample.

8. A method as claimed in claim 6, wherein the deisotoping process comprises deriving a likelihood of the one or more sample spectra given each trial hypothetical monoisotopic sample spectrum by comparing a modelled sample spectrum to the one or more sample spectra.

9. A method as claimed in claim 1, wherein the deisotoping process comprises one or more of: a least squares process, a non-negative least squares process; and a Fourier transform process.

10. A method as claimed in claim 1, wherein performing at least one of a multivariate and library-based analysis on the deisotoped version of the one or more sample spectra comprises developing at least one of a classification model and library using one or more reference sample spectra.

11. A method as claimed in claim 1, wherein performing at least one of a multivariate and library-based analysis on the deisotoped version of the one or more sample spectra comprises performing one or more of: principal component analysis (PCA), linear discriminant analysis (LDA), and a maximum margin criteria (MMC) process on the deisotoped version of the one or more sample spectra.

12. A method as claimed in claim 1, wherein performing at least one of a multivariate and library-based analysis on the deisotoped version of the one or more sample spectra comprises deriving one or more sets of metadata for the deisotoped version of the one or more sample spectra, wherein each set of metadata is representative of a class of one or more classes of sample, and each set of metadata is stored in an electronic library.

13. A method as claimed in claim 1, wherein performing at least one of a multivariate and library-based analysis on the deisotoped version of the one or more sample spectra comprises using at least one of a classification model and library to classify the deisotoped version of the one or more sample spectra as belonging to one or more classes of sample.

14. A method as claimed in claim 1, wherein performing at least one of a multivariate and library-based analysis on the deisotoped version of the one or more sample spectra comprises calculating one or more probabilities or classification scores based on the degree to which the deisotoped version of the one or more sample spectra correspond to one or more classes of sample represented in an electronic library.

15. A method of mass or ion mobility spectrometry comprising a method as claimed in claim 1.

16. A spectrometric analysis system comprising:

control circuitry arranged and adapted to:

obtain one or more sample spectra for a sample;

pre-process the one or more sample spectra, wherein pre-processing the one or more sample spectra comprises using isotopic deconvolution as a deisotoping process to generate a deisotoped version of the one or more sample spectra in which one or more isotopic peaks are reduced or removed;

analyse the one or more pre-processed sample spectra, wherein analysing the one or more pre-processed sample spectra comprises performing at least one of a multivariate and library-based analysis on the deisotoped version of the one or more sample spectra; and classify the sample using the at least one of a multivariate and library-based analysis on the deisotoped version of the one or more sample spectra, wherein classifying the sample comprises projecting at least one of a sample point and vector for the deisotoped version of the one or more sample spectra into a classification model space.

17. A mass or ion mobility spectrometric analysis system or a mass or ion mobility spectrometer comprising a spectrometric analysis system as claimed in claim 16.

18. A tangible computer readable medium comprising computer software code which, when run on control circuitry of a spectrometric analysis system, performs a method of spectrometric analysis comprising:

obtaining one or more sample spectra for a sample;

pre-processing the one or more sample spectra, wherein pre-processing the one or more sample spectra comprises using isotopic deconvolution as a deisotoping process to generate a deisotoped version of the one or more sample spectra in which one or more isotopic peaks are reduced or removed;

analysing the one or more pre-processed sample spectra, wherein analysing the one or more pre-processed sample spectra comprises performing at least one of multivariate and library-based analysis on the deisotoped version of the one or more sample spectra; and classifying the sample using the at least one of a multivariate and library-based analysis on the deisotoped version of the one or more sample spectra, wherein classifying the sample comprises projecting at least one of a sample point and vector for the deisotoped version of the one or more sample spectra into a classification model space.

19. A method as claimed in claim 1, wherein the deisotoping process comprises including one or more species with a known elemental composition in the deconvolution process with a correct mass and an exact isotope distribution.

* * * * *